US010002484B2

(12) United States Patent
Takeda

(10) Patent No.: US 10,002,484 B2
(45) Date of Patent: Jun. 19, 2018

(54) PAPER SHEET PROCESSING APPARATUS AND PAPER SHEET PROCESSING SYSTEM

(71) Applicant: Universal Entertainment Corporation, Koto-ku, Tokyo (JP)

(72) Inventor: Kengo Takeda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days. days.

(21) Appl. No.: 15/472,544

(22) Filed: Mar. 29, 2017

(65) Prior Publication Data

US 2017/0287255 A1 Oct. 5, 2017

(30) Foreign Application Priority Data

Mar. 31, 2016 (JP) ..... 2016-071448

(51) Int. Cl.

| | |
|---|---|
| ***G07D 7/00*** | (2016.01) |
| ***G07D 11/00*** | (2006.01) |
| ***B65H 43/04*** | (2006.01) |
| ***G07D 7/12*** | (2016.01) |
| ***G07F 17/32*** | (2006.01) |

(52) U.S. Cl.

CPC ..... *G07D 11/0051* (2013.01); *B65H 43/04* (2013.01); *G07D 7/12* (2013.01); *G07D 11/0021* (2013.01); *G07F 17/3241* (2013.01); *G07F 17/3246* (2013.01); *B65H 2301/331* (2013.01); *B65H 2557/13* (2013.01); *B65H 2557/23* (2013.01); *B65H 2701/1912* (2013.01)

(58) Field of Classification Search

CPC .. G07D 7/00; G07D 11/0084; G07D 2211/00; G07F 19/00

See application file for complete search history.

(56) References Cited

U.S. PATENT DOCUMENTS

| | | | | |
|---|---|---|---|---|
| 6,729,957 | B2 * | 5/2004 | Burns | G07F 7/04 463/25 |
| 2003/0087691 | A1 * | 5/2003 | Kiely | G07F 17/32 463/25 |
| 2010/0246928 | A1 * | 9/2010 | Takahama | G07D 7/00 382/140 |
| 2014/0337211 | A1 * | 11/2014 | Crist | G07F 19/203 705/43 |
| 2016/0343191 | A1 * | 11/2016 | Kobayashi | G07D 11/0066 |
| 2017/0053489 | A1 * | 2/2017 | Colvin | G07F 17/3244 |

* cited by examiner

*Primary Examiner* — Mark J Beauchaine

(74) *Attorney, Agent, or Firm* — Simpson & Simpson, PLLC; S. Peter Konzel

(57) ABSTRACT

Provided is a paper sheet processing system capable of preventing a large number of wrong paper bills put in a paper sheet processing apparatus at one time from being exchanged with clean money. A bill processing apparatus sends information on a total amount of the bills supplied to the bill processing apparatus incorporated in a gaming machine and the number of games played by a player counted by a counter to a management server. The management server compares the total amount with a predetermined amount and if the total amount is higher than the predetermined amount, compares the counted number of games with a predetermined number. If the counted number of games is smaller than the predetermined number, the management server sends a report signal to a management apparatus.

16 Claims, 63 Drawing Sheets

FIG.27

ERROR DISPLAY TABLE

| CODE | MESSAGE FOR PTS TERMINAL | MESSAGE FOR MANAGEMENT APPARATUS |
|---|---|---|
| 001 | SYSTEM ERROR | COUNTERFEIT BILL A |
| 002 | PAPER JAM | COUNTERFEIT BILL B |
| 003 | ··· | COUNTERFEIT BILL C |
| 004 | ··· | ··· |
| 005 | ··· | ··· |
| 006 | ··· | ··· |
| ⋮ | ⋮ | ⋮ |
| 0XX | SYSTEM ERROR | MULTIPLE TIMES OF READING OF COUNTERFEIT BILL |

FIG.29

EVENT

ERROR

DATE : 2016. XX. XX
TIME : 00:00
CODE : 001
KIND: COUNTERFEIT BILL A
PLACE: BLOCK A01
MODEL : XXXXX

REMARKS

FIG.55

| | 1ST SYMBOL ARRAY | 2ND SYMBOL ARRAY | 3RD SYMBOL ARRAY | 4TH SYMBOL ARRAY | 5TH SYMBOL ARRAY |
|---|---|---|---|---|---|
| CODE NUMBER | SYMBOL | SYMBOL | SYMBOL | SYMBOL | SYMBOL |
| 00 | JACKPOT 7 | JACKPOT 7 | JACKPOT 7 | JACKPOT 7 | JACKPOT 7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

FIG.56

PAYOUT MANAGEMENT TABLE

| WINNING COMBINATION | NORMAL GAME |
|---|---|
| PLUM | 5 |
| ORANGE | 8 |
| BELL | 10 |
| CHERRY | 20 |
| STRAWBERRY | 30 |
| BLUE 7 | 40 |

FIG.61

| DATE AND TIME OF INSERTION | KIND OF BILL (USD) | SERIAL NUMBER | D |
|---|---|---|---|
| 2016.03.01 | 100 | AB1234567 | A00001 |
| 2016.03.01 | 100 | DEB334566 | A00001 |
| 2016.03.01 | 100 | XXXXXXXX | A00001 |
| 2016.03.01 | 100 | XXXXXXXX | E00234 |
| 2016.03.01 | 100 | XXXXXXXX | E00234 |

PAPER SHEET PROCESSING APPARATUS AND PAPER SHEET PROCESSING SYSTEM

CROSS-REFERENCE TO RELATED APPLICATIONS

This application claims the benefit of Japanese Patent Application No. 2016-071448 filed Mar. 31, 2016, which is incorporated herein by reference in its entirety.

TECHNICAL FIELD

The present invention relates to a paper sheet processing system capable of distinguishing a wrong paper sheet from paper sheets including bills and barcode tickets put in a gaming machine such as a slot machine.

BACKGROUND ART

There is a known paper sheet processing apparatus configured to identify the kind of a paper sheet, verify the paper sheet, and store the verified genuine paper sheet (refer to U.S. Patent Application Publication No. 2011/0198191).

Technical Problem

In a casino hall including a plurality of gaming machines equipped with the above-described paper sheet processing apparatus, players can put a large number of bills in a gaming machine to play games. This configuration allows a wrongdoer to commit so-called money laundering by putting a large number of illegally acquired bills into a gaming machine to credit a large amount of cash, playing several games using a small amount, and cashing out by recording the remaining amount into a barcode ticket or an IC card. Since the bills acquired illegally, for example by theft, can be identified by the serial numbers, the wrongdoer may put the wrong bills in a gaming machine and cash out by recording the amount into a barcode ticket or an IC card, instead of putting the wrong bills into circulation. The wrong bills could be a new type of counterfeit bills that can be recognized as genuine bills.

The present invention has been accomplished in view of the above-described problem, aiming to provide a paper sheet processing system capable of distinguishing a wrong bill to stop a wrongdoing.

Solution to Problem

The present invention provides a paper sheet processing system as follows.

The paper sheet processing system in an embodiment of the present invention includes:

a paper sheet processing apparatus capable of successively reading an inserted paper sheet and sending image data including information on a monetary amount;

a storage unit configured to store a total amount calculated from the information on the monetary amount sent from the paper sheet processing apparatus, a predetermined monetary amount, and a predetermined number of games;

a counter configured to count number of games in a gaming machine;

a detector configured to detect cashout from the gaming machine; and a determination unit configured to, in response to detection of cashout from the gaming machine at the detector, compare the total amount with the predetermined amount stored in the storage unit, compare a count value counted by the counter with the predetermined number of games, and determine whether the inserted paper sheets are wrong paper sheets in accordance with results of the comparison.

In this configuration, each time a paper sheet (for example a bill) is inserted, the paper sheet processing apparatus sends information on the amount of money to the storage unit and the storage unit calculates a total amount and stores the calculated total amount. Each time a game is conducted after receipt of the paper sheets, the counter counts the number of games. In cashing out the amount remaining in the gaming machine after finishing the games, the determination unit compares the total amount stored in the storage unit with the predetermined amount and compares the count value of the counter with the predetermined number of games to determine whether the supplied paper sheets are wrong paper sheet in accordance with the results of the comparison. Accordingly, in the case where a wrongdoer puts a large number of bills into a gaming machine and cashes out after playing several games (for example, two or three games) with a bet of small amount regardless of a large remaining amount (for example, more than one hundred thousand dollars), it can be presumed that wrong bills have been put in the gaming machine.

In the foregoing configuration, it is preferable that the storage unit be further configured to store predetermined identification information, and that the determination unit be configured to extract the same type of identification information as the predetermined identification information from identification information included in the image data sent from the paper sheet processing apparatus, compare the extracted identification information with the predetermined identification information, and determine whether the paper sheet is a wrong paper sheet in accordance with a result of the comparison This configuration presets identification information such as serial numbers of stolen bills and, in response to insertion of a large number of bills into a gaming machine, compares the serial numbers of the inserted bills with the preset serial numbers. Accordingly, whether the bills are stolen bills or whether money laundering is being committed can be determined accurately.

In the foregoing configuration, it is further preferable that the paper sheet processing apparatus include:

an imaging device configured to take a facial image of a supplier of a paper sheet and acquire image data; and a line sensor configured to scan identification information on a paper sheet inserted in the paper sheet processing apparatus, and that the storage unit be configured to store the image data acquired by the imaging device and the identification information read by the line sensor, and when the determination unit determines that the paper sheet inserted in the paper sheet processing apparatus is a wrong paper sheet, associate the image data acquired by the imaging device with the identification information read by the line sensor.

This configuration stores the identification information of the wrong paper sheet determined by the determination unit associated with the facial image of the supplier of the paper sheet in the storage unit; accordingly, the wrongdoer can be identified.

Advantageous Effects

The paper sheet processing system of the present invention prevents wrong paper sheets from being exchanged to a paper sheet having a real value.

BRIEF DESCRIPTION OF DRAWINGS

FIG. 27 is a diagram showing an error display table;

FIG. 29 is a diagram showing an error displayed on a display device of a management apparatus;

FIG. 55 is an explanatory diagram of a code number determination table;

FIG. 56 is an explanatory diagram of a payout management table;

FIG. 61 is a diagram showing a state where a database of a management server is displayed on a display device;

DESCRIPTION OF EMBODIMENTS

Embodiments of the present invention are described with reference to the drawings.

First Embodiment

Figure 1:
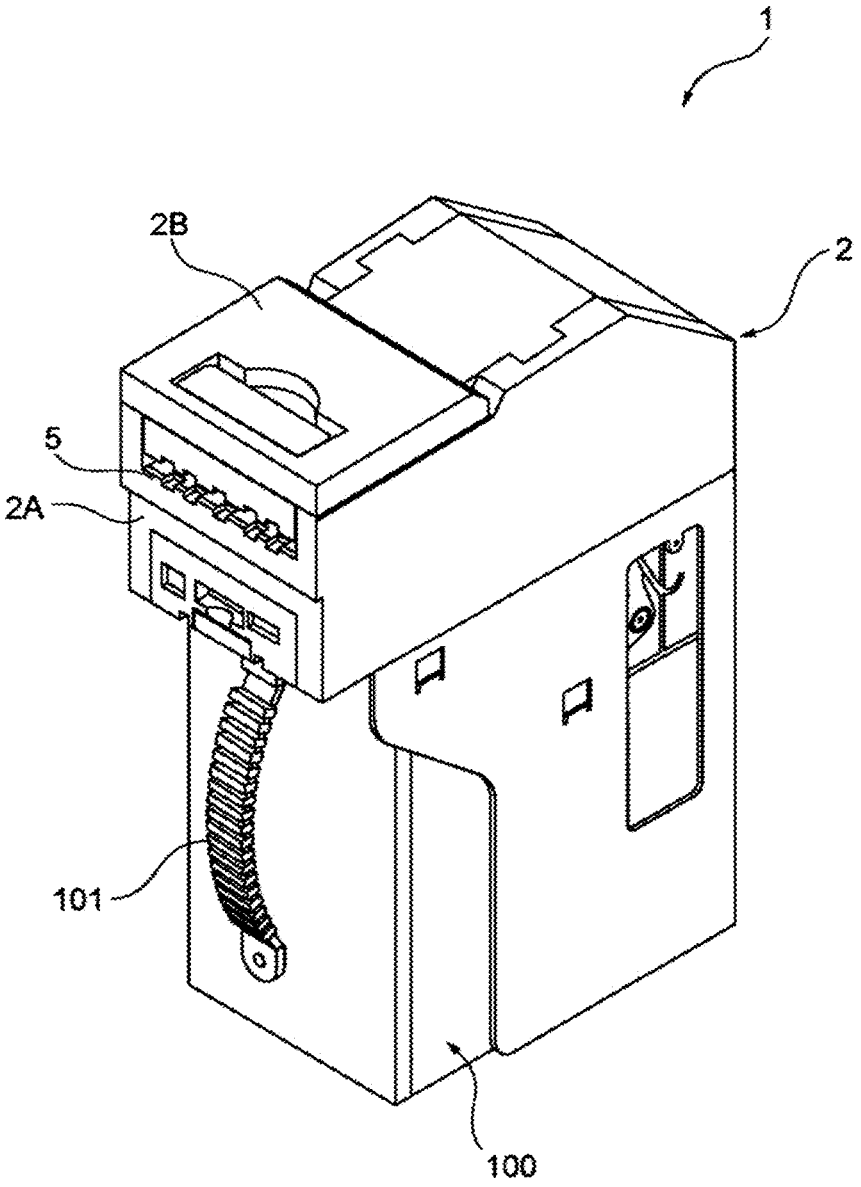
FIG. 1 is a perspective view for illustrating an overall structure of a paper sheet processing apparatus.
Figure 2:
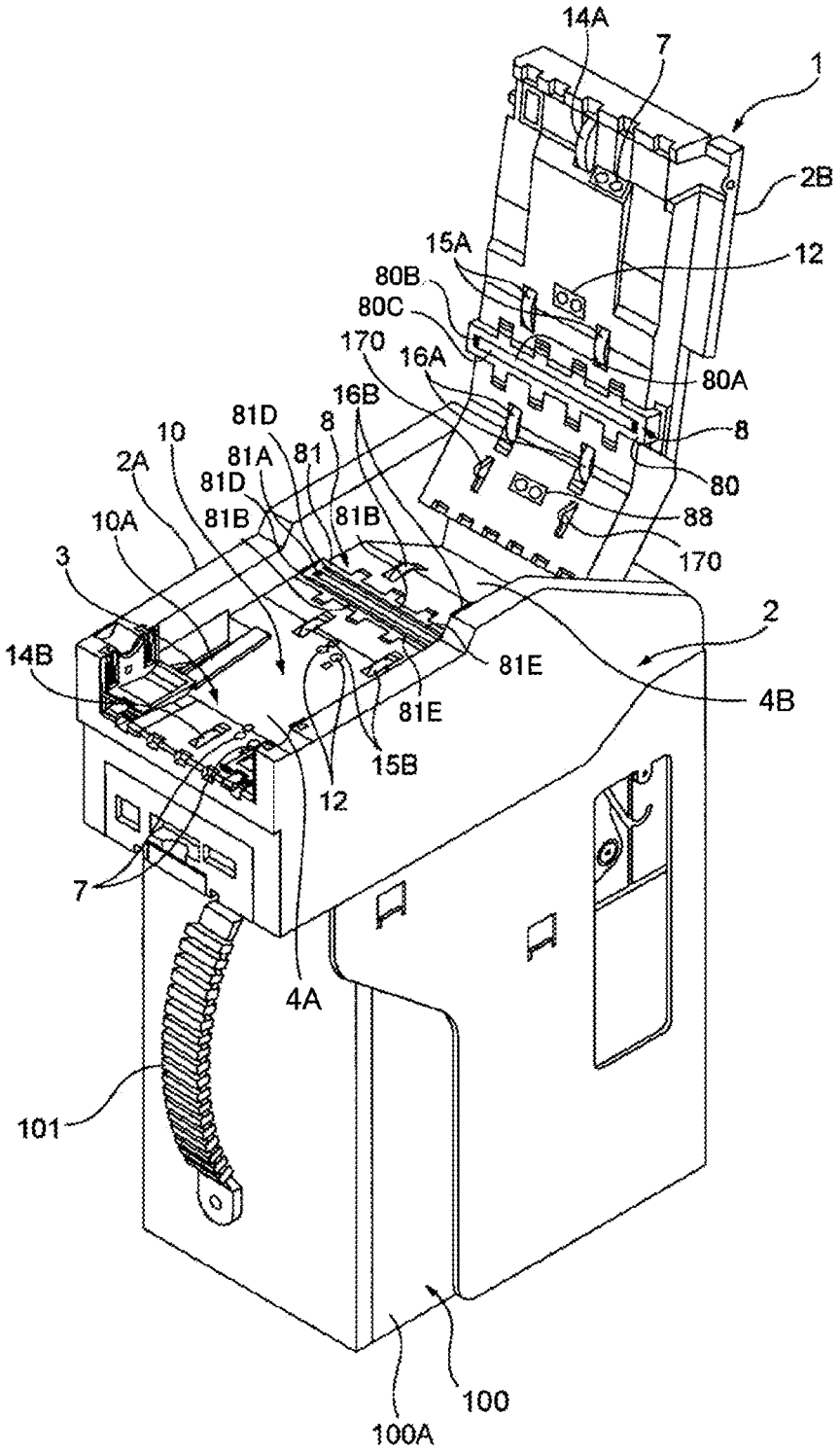
FIG. 2 is a perspective view for illustrating a state where the openable member is opened with respect to the body frame of the apparatus main body.
Figure 3:
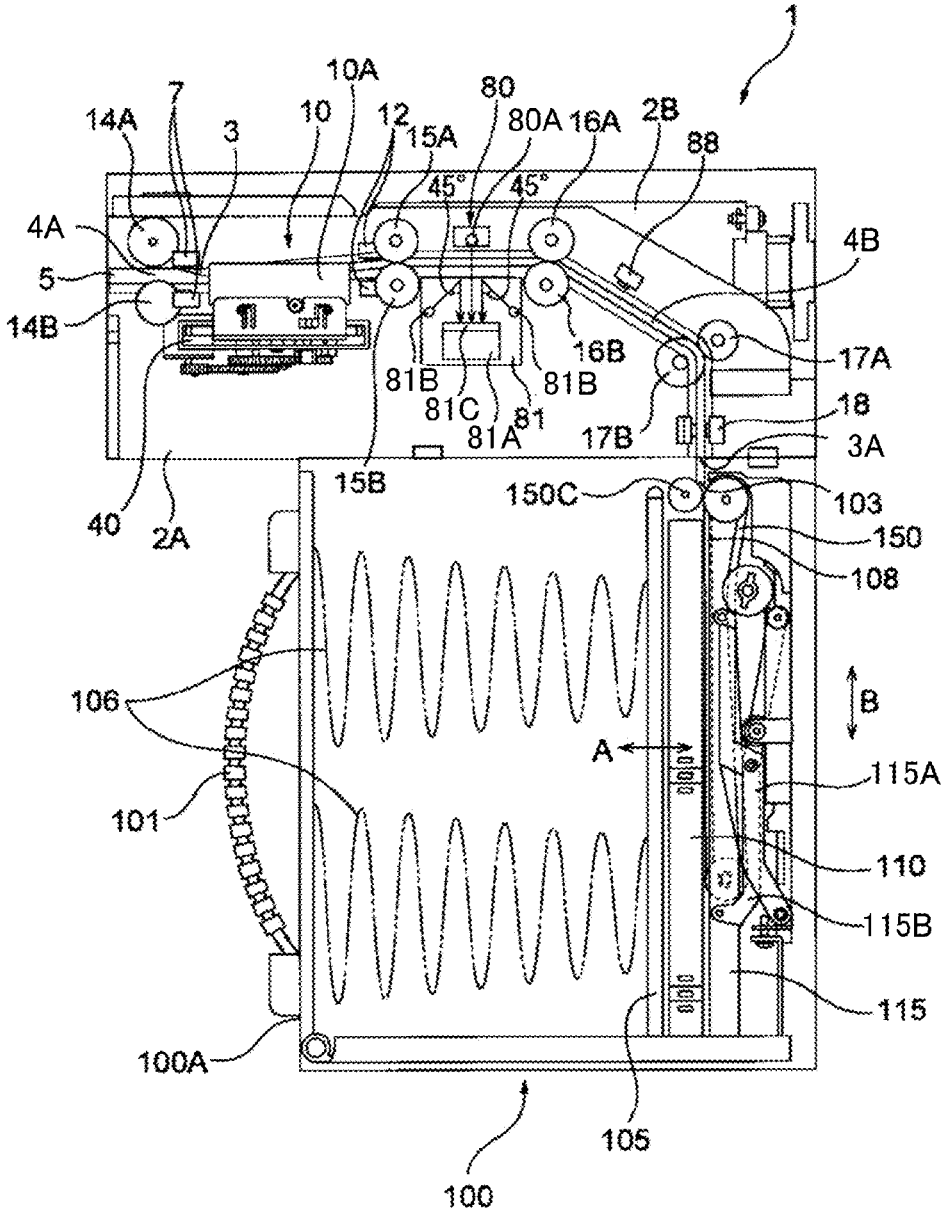
FIG. 3 is a right side view for schematically illustrating a conveyance path for a bill inserted from the insertion slot.
Figure 4:
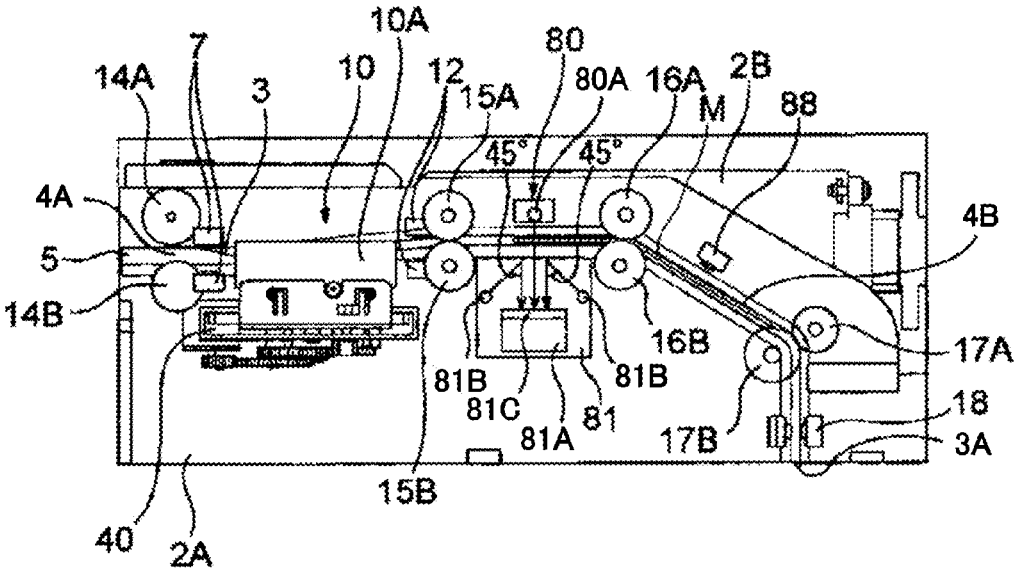
FIG. 4 is a transparent right side view for schematically illustrating a state where a bill inserted from the insertion slot passes through the conveyance path.
Figure 5:
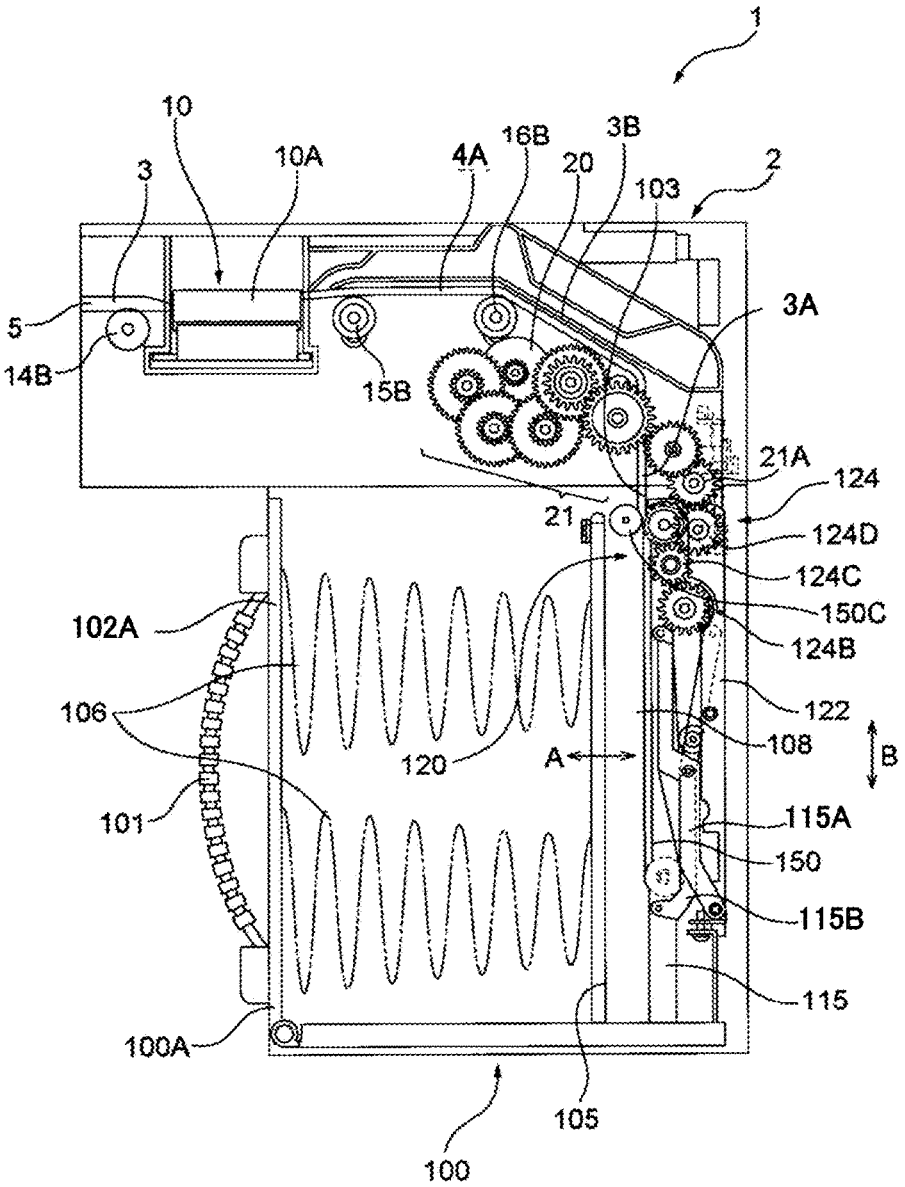
FIG. 5 is a right side view for schematically illustrating the structure of a power transmission mechanism for driving a presser plate provided in a bill holder.
Figure 6:
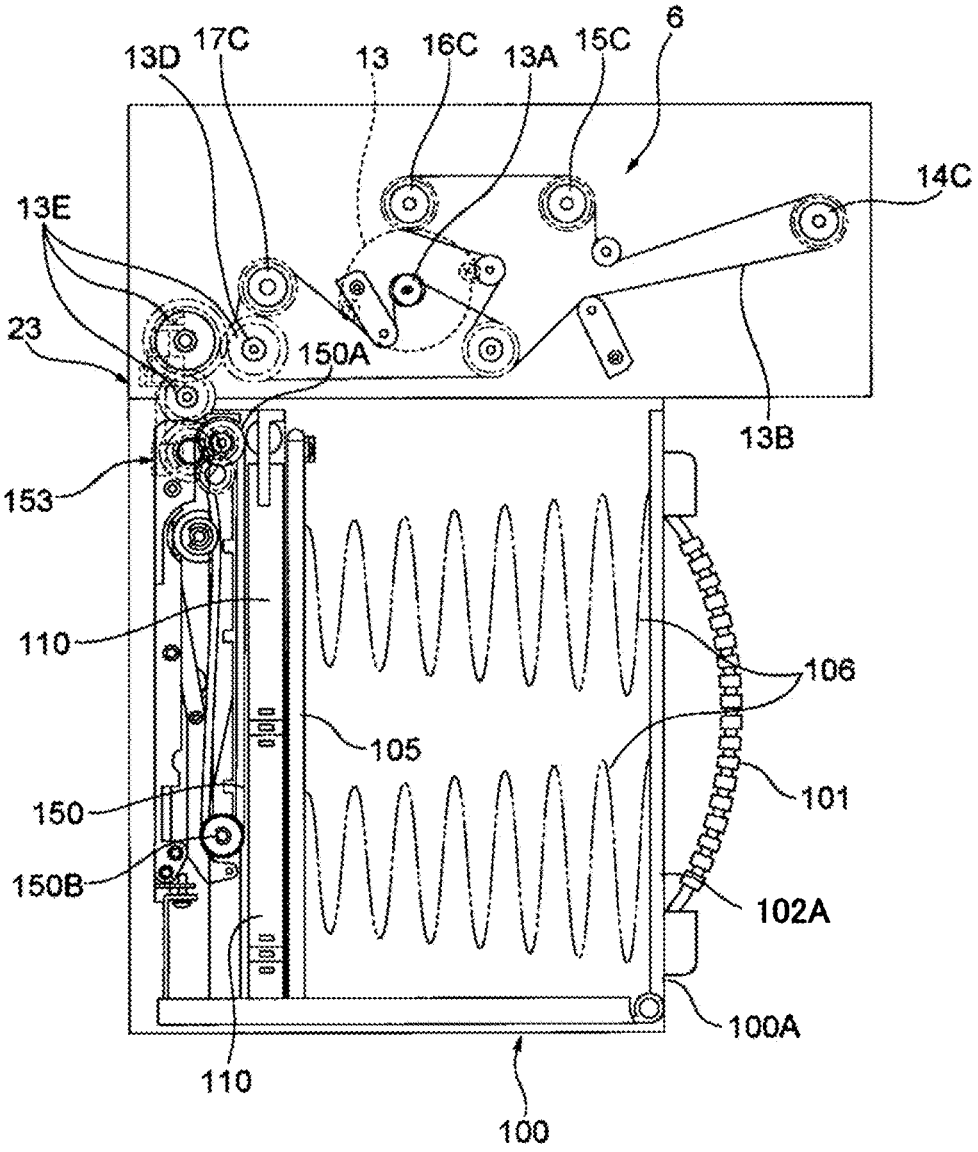
FIG. 6 is a left side view for schematically illustrating structures of a driving source and a driving power transmission mechanism for driving the bill conveyance mechanism.
Figure 7:
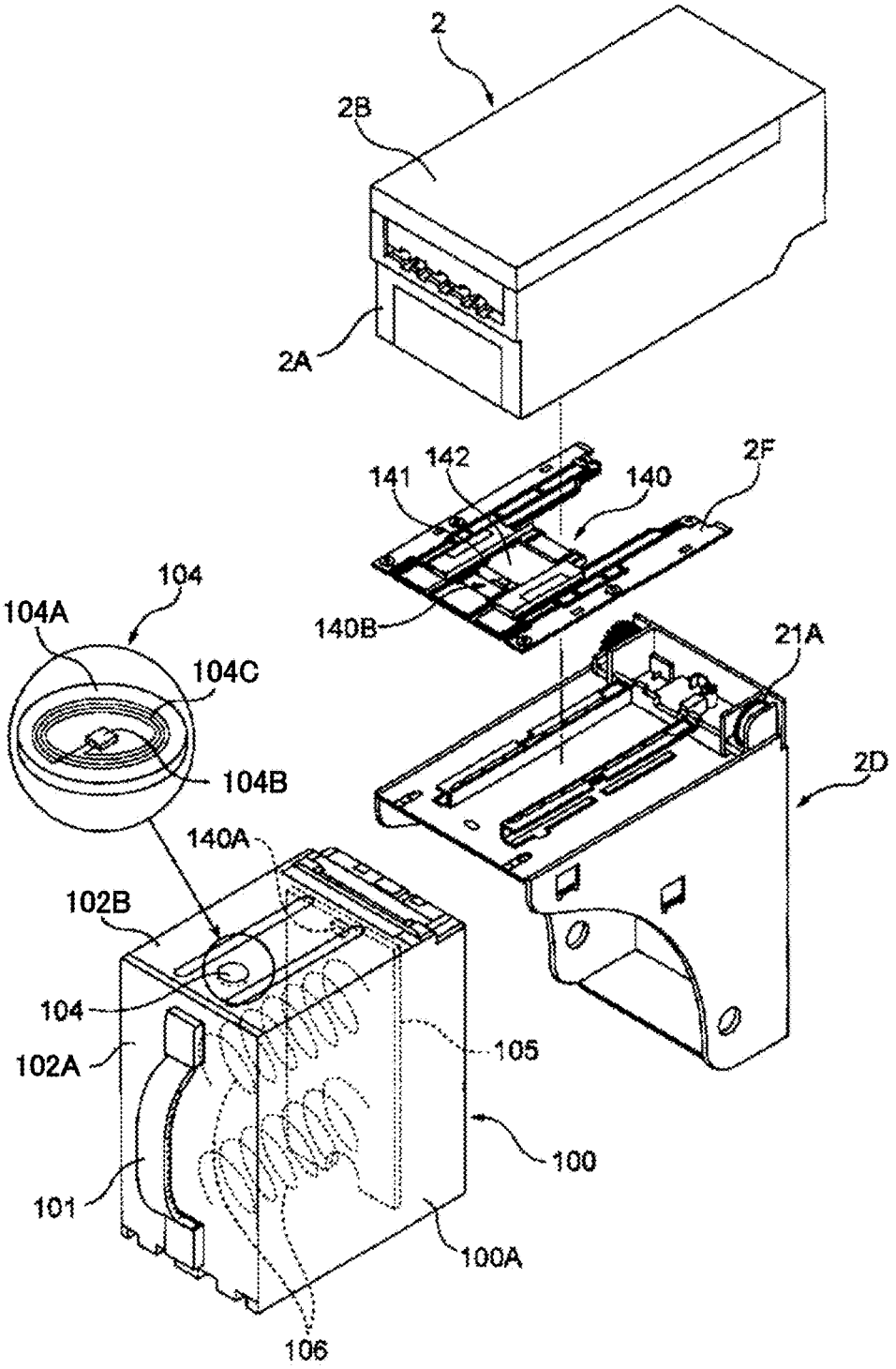
FIG. 7 is an exploded perspective view of the paper sheet processing apparatus.

FIGS. 1 to 7 are diagrams for illustrating a configuration of a paper sheet processing apparatus in the present embodiment. FIG. 1 is a perspective view for illustrating the overall structure; FIG. 2 is a perspective view for illustrating a state where the openable member is opened with respect to the body frame of the apparatus main body; FIGS. 3 and 4 are right side views for schematically illustrating the conveyance path for a bill inserted from the insertion slot; FIG. 5 is a right side view for schematically illustrating the structure of a power transmission mechanism for driving a presser plate provided in a bill holder; FIG. 6 is a left side view for schematically illustrating the structures of a driving source and a driving power transmission mechanism for driving the bill conveyance mechanism; and FIG. 7 is an exploded perspective view of the paper sheet processing apparatus.

The paper sheet processing apparatus 1 in the present embodiment is configured to be incorporated into various gaming machines such as slot machines. The paper sheet processing apparatus 1 is structured with three major structural bodies: an apparatus main body 2, a stand (frame) 2D for mounting the apparatus main body 2 thereon in a removable manner, and a bill holder (stacker or cash box) 100 attached to the stand 2D in a removable manner. The bill holder 100 may be removable from the apparatus main body 2. For example, the bill holder 100 can be removed from the apparatus main body 2 by pulling a handle 101 provided on the front face when a not-shown lock mechanism is off. The paper sheet processing apparatus 1 corresponds to the paper sheet processing apparatus in the present invention. The bill holder 100 corresponds to the holder unit in the present invention.

Figure 19:
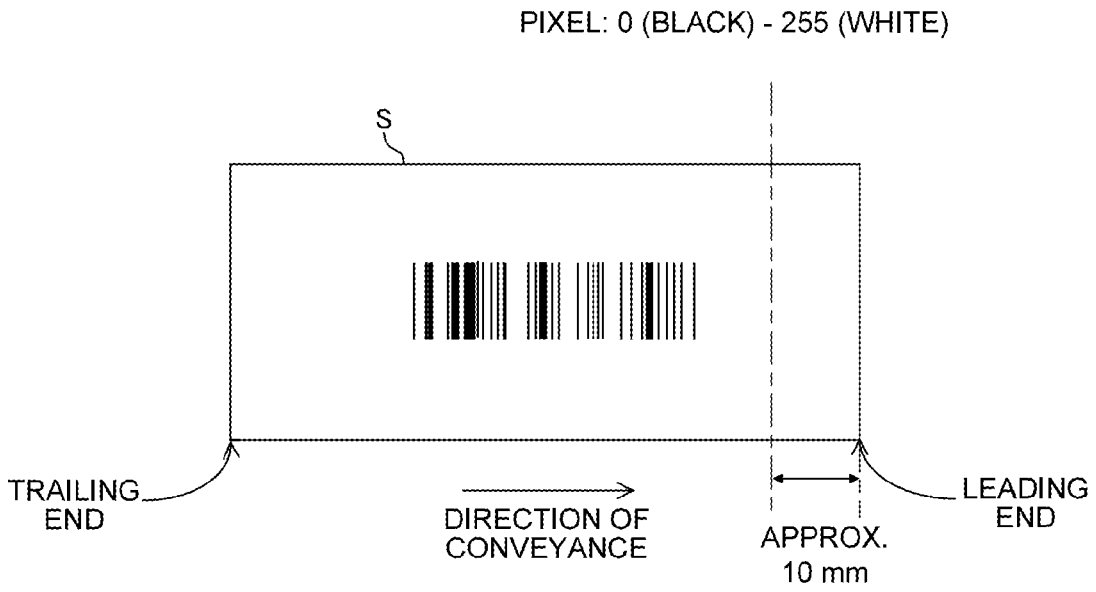
FIG. 19 is a schematic diagram for illustrating an outline of processing to read a paper sheet with a barcode.

The paper sheet processing apparatus 1 in the present invention is configured to process so-called paper sheets which could be sheets of paper or synthetic resin with a barcode printed thereon, as well as bills. The barcode includes numerical information valuable equally to a bill, information on the amount of credit, and identification information on the credit. The paper sheets with barcodes are made by a dedicated printer. For example, as shown in FIG. 19, a paper sheet with a barcode is made by printing a barcode including the above-mentioned information and an identification code for identifying the paper sheet on a paper sheet having the same size as a bill. More specifically, the information included in a barcode may be a variety of information such as information on the date of issuance and information on the place of issuance in addition to the aforementioned numerical information valuable equally to a bill, information on the amount of credit, and an identification code of the credit. The paper sheet processing apparatus 1 is configured to verify bills and also such paper sheets with barcodes using a bill reader 8 to be described later. That is to say, the paper sheet processing apparatus 1 is configured to be able to handle the paper sheets with specific barcodes printed thereon as well as bills. The verification of the barcode may be made in any way, for example by checking the data on the place of issuance included in the barcode or by determining whether the identification code is an actually issued one. The bill reader 8 corresponds to the reading unit in the present invention.

As shown in FIG. 2, the apparatus main body 2 has a body frame 2A and an openable member 2B to be opened and closed with respect to the body frame 2A by pivoting about one end thereof. The body frame 2A and the openable member 2B are structured to form a space (bill conveyance path 3) between the body frame 2A and the openable member 2B to convey a bill therethrough and also a bill slot 5 connecting to this space of the bill conveyance path 3 between their front faces when the openable member 2B is closed with respect to the body frame 2 as shown in FIG. 3. The bill slot 5 is a slit opening for allowing a bill to be inserted into the apparatus main body 2 from either short side of the bill.

The apparatus main body 2 include a bill conveyance mechanism 6 (see FIG. 6), an insertion detection sensor 7, a bill reader (first sensor) 8, a skew correction mechanism 10, a movable panel passage detection sensor 12, a barcode sensor (second sensor) 88, and a delivery detection sensor 18. The bill conveyance mechanism 6 conveys a bill along the bill conveyance path 3. The insertion detection sensor 7 detects a bill inserted in the bill slot 5. The bill reader 8 is provided downstream of the insertion detection sensor 7 and reads information on the bill being conveyed. The skew correction mechanism 10 sets a bill to a correct position to be conveyed to the bill reader 8. The movable panel passage detection sensor 12 detects passage of a bill between a pair of movable panels included in the skew correction mechanism 10. The barcode sensor 88 reads the barcode on a paper sheet when the bill reader 8 cannot read the barcode on the paper sheet being conveyed or when the paper sheet has been inserted with the printed surface up. The delivery detection sensor 18 detects delivery of a bill to the bill holder 100.

Hereinafter, the aforementioned components are described in detail. The bill conveyance path 3 includes a first conveyance path 4A and a first conveyance path 4B. The first conveyance path 4A extends from the bill slot 5 toward the back. The first conveyance path 4B extends from the first conveyance path 4A toward the downstream and inclines downward at a specific angle with respect to the first conveyance path 4A. The downstream side of the first conveyance path 4B is bent in the vertical direction and the downstream end is provided with a delivery slit 3A for ejecting a bill to the bill holder 100. The bill ejected from the delivery slit 3A is forwarded in the vertical direction to the introduction slit (receiving slit) 103 of the bill holder 100.

The bill conveyance mechanism 6 is a mechanism for conveying a bill inserted from the bill slot 5 along the direction of the insertion and also for conveying the inserted bill back toward the bill slot 5. The bill conveyance mechanism 6 includes a motor 13 (see FIG. 6) of a driving source provided inside the apparatus main body 2 and a plurality of pairs of feed rollers (14A, 14B), (15A, 15B), (16A, 16B), and (17A, 17B) provided with intervals in the bill conveyance direction. The feed rollers are driven to rotate by the motor 13.

The feed roller pairs are placed to be partially exposed to the bill conveyance path 3. In these feed roller pairs, the rollers 14B, 15B, 16B, and 17B provided under the bill conveyance path 3 are driving rollers to be driven by the motor 13. The rollers 14A, 15A, 16A, and 17A provided above these driving rollers are pinch rollers to be driven by the driving rollers. The feed roller pair (14A, 14B) for first pinching a bill inserted from the bill slot 5 and sending the bill toward the back are provided at one place of the center of the bill conveyance path 3, as shown in FIG. 2. Each of the other feed roller pairs (15A, 15B), (16A, 16B), and (17A, 17B) provided downstream in series are provided at two places with a specific distance in the direction of the width of the bill conveyance path 3.

As to the feed roller pair (14A, 14B) provided in the vicinity of the bill slot 5, the upper roller 14A is usually not in contact with the lower roller 14B. As soon as the insertion detection sensor 7 detects insertion of a bill from the bill slot 5, the upper roller 14A is lowered to the lower roller 14B to pinch the inserted bill.

That is to say, the upper roller 14A is controllably driven by a roller lifting motor 70 (see FIG. 8) of a driving source to engage and disengage the lower roller 14B. With these operations, the skew correction mechanism 10 corrects the skew of the inserted bill. To perform positioning the bill for the bill reader 8 (skew correction), the upper roller 14A is disengaged from the lower roller 14B to eliminate the load on the bill. Upon completion of the skew correction, the upper roller 14A is driven to engage the lower roller 14B again to pinch the bill. The driving source can be a solenoid or a different component, instead of a motor.

The skew correction mechanism 10 includes a pair of movable panels 10A for correcting the skew on the both sides of the bill conveyance path 3 (only one of them is shown). The skew correction mechanism 10 drives a motor 40 for the skew correction mechanism to move the pair of movable panels 10A on both sides to get closer to each other. As a result, the skew correction is performed on the bill.

The feed rollers 14B, 15B, 16B, and 17B provided under the bill conveyance path 3 are driven to rotate by the motor 13, and pulleys 14C, 15C, 16C, and 17C provided at ends of the driving shafts of the feed rollers. That is to say, the output shaft of the motor 13 is provided with a driving pulley 13A; the driving pulley 13A and the pulleys 14C, 15C, 16C, and 17C provided at the ends of the driving shafts of the feed rollers are winded with a driving belt 13B. The driving belt 13B also engages tension pulleys provided at appropriate places not to slack.

According to the above-mentioned configuration, when the motor 13 is driven to rotate forward, the feed rollers 14B, 15B, 16B, and 17B are synchronously driven to rotate forward, so that the bill is conveyed in the direction of insertion. When the motor 13 is driven to rotate reversely, the feed rollers 14B, 15B, 16B, and 17B are synchronously driven to rotate reversely, so that the bill is conveyed toward the bill slot 5.

The insertion detection sensor 7 is to generate a detection signal when the sensor 7 detects a bill inserted in the bill slot 5. In response to the detection signal from the insertion detection sensor 7, the motor 13 is driven to rotate forward to convey the bill in the direction of insertion. The insertion detection sensor 7 in the present embodiment is provided between the feed roller pair (14A, 14B) and the skew correction mechanism 10. The insertion detection sensor 7 is made of an optical sensor, for example, a retroreflective photo-sensor, but can be a contactless type sensor or a mechanical sensor.

The movable panel passage detection sensor 12 is to generate a detection signal when the sensor 12 detects that the leading end of a bill has passed through the pair of movable side panels 10A of the skew correction mechanism 10. In response to the detection signal from the movable panel passage detection sensor 12, the motor 13 is stopped to perform skew correction. The movable panel passage detection sensor 12 in the present embodiment is provided upstream of the bill reader 8. The movable panel passage detection sensor 12 is made of an optical sensor, a contactless type sensor, or a mechanical sensor, like the insertion detection sensor 7.

The delivery detection sensor 18 is to detect the trailing end of a passing bill to detect delivery of the bill to the bill holder 100. The delivery detection sensor 18 is provided on the downstream of the first conveyance path 4B and just before the receiving slit 103 of the bill holder 100. In response to the detection signal from the delivery detection sensor 18, the motor 13 is stopped to complete the conveyance of the bill. The delivery detection sensor 18 is also made of an optical sensor, a contactless type sensor, or a mechanical sensor, like the insertion detection sensor 7.

The bill reader (first sensor) 8 reads information (acquires image data) on a paper sheet which is being conveyed after the skew correction mechanism 10 has corrected the skew and determines the validity (whether the paper sheet is genuine or counterfeit). In the present embodiment, the bill reader 8 includes a line sensor configured to irradiate the both surfaces of the paper sheet being conveyed with light and read the information by detecting the transmitted light and the reflected light with photodetectors. If the inserted paper sheet is a paper sheet with a barcode and the barcode is printed on the undersurface of the paper sheet, the bill reader 8 uses the reflected light to read the barcode with the line sensor; if the barcode is printed on the top surface of the paper sheet, the bill reader 8 reads the barcode with a barcode sensor. In the case of a bill, the bill reader 8 acquires the image with the line sensor. The bill reader 8 is provided on the first conveyance path 4A. The acquired image data is stored to a RAM 224.

The verification of a bill in the present embodiment is performed by irradiating the printed region of the surface of the bill being conveyed with a specific wavelength of light emitted from a light emission unit, acquiring data on the light transmitted through the bill and data on the light reflected by the bill, and comparing the acquired transmitted light data and reflected light data with reference data on a genuine bill stored in advance, to increase the accuracy in verification.

A genuine bill has a region from which different image data is acquired depending on the wavelength of the light (for example, whether visible light or infrared light) to be used. Utilizing this feature, the present embodiment irradiates a bill with different wavelengths of light (red light and infrared light in the present embodiment) emitted from a plurality of light sources and detects the light transmitted through and the light reflected off the bill to increase the accuracy in verification. In other words, because of the difference in wavelength, red light and infrared light show different transmission rates and reflection rates between the specific region of a genuine bill and the corresponding region of a counterfeit bill. Accordingly, the present embodiment employs a plurality of light sources for different wavelengths of light and uses transmitted light data and reflected light data at each wavelength in verifying a bill to increase the accuracy in identification of the bill as genuine or counterfeit (the accuracy in determination).

A specific method of verifying a bill is not described here in detail because a variety of received-light data (transmitted light data and reflected light data) can be acquired depending on the wavelength of the light to be used to irradiate the bill and the region to be irradiated. However, an example can be provided as follows. An image of a watermark region of a bill can be seen significantly different when seen in different wavelengths of light; accordingly, the watermark region can be used for the specific region. In the verification, the transmitted light data and the reflected light data may be acquired from the specific region and compared with correct data acquired from the same specific region of a genuine bill stored in advance in a storage (ROM) to determine whether the bill being processed is genuine or counterfeit. The specific region can be determined separately for each kind of bill and the transmitted light data and the reflection data acquired from the specific region can be assigned weights to further increase the accuracy in verification.

As will be described later, the bill reader 8 controls the light emission unit to light at predetermined intervals and detects the transmitted light and the reflected light with the line sensor when a bill is passing through. As a result, the line sensor can acquire image data in units of pixels each having a predetermined size. The image data acquired by the line sensor is converted by a later-described converter module pixel by pixel, into data including information on color including brightness. The information on color including brightness of a pixel obtained at the converter module is a gray level. The gray level corresponds to the density value (brightness value); each pixel is assigned one of the numerical values of 0 to 255 (0: black to 255: white) in the form of one-byte information, in accordance with the density value. Accordingly, verification of a bill can be performed by extracting a specific region of the bill, substituting the pixel information (density values) on the region and the pixel information on the same region of a genuine bill for an appropriate correlation equation, calculating the correlation coefficient, and determining whether the bill is genuine or counterfeit in accordance with the calculated correlation coefficient.

Other than the foregoing example, verification can be performed by creating analog waveforms from the transmitted light data and the reflected light data and comparing the shapes of these waveforms.

As described above, the paper sheet processing apparatus 1 in the present invention is configured to process a paper sheet with a barcode as well as a bill. In verifying a paper sheet, the reading specifications in the bill reader 8 are different between the case of a bill and the case of a paper sheet with a barcode.

For example, regarding the resolution of the image to be acquired, higher resolution is required to read a printed barcode than to read a bill because a barcode includes thin lines. In other words, the thin lines of the barcode cannot be clearly discriminated at the resolution suitable to read a bill and reading a bill at the resolution suitable to read a barcode causes high load to slow down the processing.

The resolution of the image acquired by a photodetector can be raised by shortening the interval between irradiation of the object to be verified. Accordingly, the present embodiment changes the resolution by changing the interval between lighting of the light emission unit between the case of reading a bill and the case of reading a paper sheet with a barcode.

The paper sheet with a barcode has characteristics that the barcode absorbs and does not reflect infrared light but reflect red light. In view of employment of multiple light sources to emit different wavelengths of light for higher accuracy in verification of a bill as described above, the present embodiment performs control to select a light source suitable to read a barcode and turn off the unnecessary light sources.

Hereinafter, the configuration of the bill reader 8 is described in detail with reference to FIGS. 2 and 3.

The bill reader 8 is composed of a light emission unit 80 provided on the openable member 2B and a light receiving and emission unit 81 provided on the body frame 2A. The light emission unit 80 includes a first light emission device 80A capable of emitting infrared light and red light toward the top surface of the bill being conveyed.

The light receiving and emission unit 81 includes a light receiving device 81A and a second light emission device 81B. The light receiving device 81A includes a photo-sensor opposed to the first light emission device 80A with a bill (paper sheet) interposed. The second light emission device 81B is capable of emitting infrared light and red light and provided at the vicinities on both sides of the light receiving device 81A when seen in the bill conveyance direction.

The first light emission device 80A opposed to the light receiving device 81A works as a light source for the light to pass through. The first light emission device 80A is made of a rectangular bar-like synthetic resin member that can shine by transmitting light from an LED element 80B attached to one end through a light guide member 80C provided inside thereof. The first light emission device 80A is provided in a line and in parallel to the light receiving device 81A (photo-sensor), so that the entire range of a conveyed bill in the direction of the width of the conveyance path can be irradiated uniformly with such a simple configuration.

The light receiving device 81A of the light receiving and emission unit 81 is a thin and narrow plate-like device extending in the direction crossing the bill conveyance path 3 and having a width that will not affect the sensitivity of the not-shown photo-sensor included in the light receiving device 81A. The photo-sensor includes multiple CCDs (charge coupled devices) aligned at the center in the direction of the thickness of the light receiving device 81A and a linear grin lens array 81C to focus the transmitted light and the reflected light at positions above the CCDs. That is to say, the photo-sensor is configured as a so-called line sensor. This configuration enables receiving the transmitted or reflected infrared and red light emitted from the first light emission device 80A and the second light emission device 81B toward the bill to be verified, creating grayscale data in accordance with the brightness (pixel data including information on brightness) as received-light data, and creating two-dimensional image from this grayscale data.

The second light emission device 81B in the light receiving and emission unit 81 functions as a light source for the light to be reflected. This second light emission device 81B is also made of a rectangular bar-like synthetic resin member that can shine by transmitting light from an LED element 81D attached to one end through a light guide member 81E provided inside thereof, like the first light emission device 80A. The second light emission device 81B is also provided in a line and in parallel to the light receiving device 81A (line sensor).

The second light emission device 81B emits light toward the bill at an elevation angle of 45 degrees, for example. That is to say, the second light emission device 81B is disposed at such a position that the light receiving device 81A will receive the reflection off the bill. Although this example is configured so that the light emitted from the second light emission device 81B will enter the light receiving device 81A at 45 degrees, the angle of incidence is not limited to 45 degrees. The second light emission device 81B can be disposed as appropriate as far as the surface of the bill can be solidly and uniformly irradiated with light. Accordingly, the design of the arrangement of the second light emission device 81B and the light receiving device 81A can be changed as appropriate depending on the structure of the paper sheet processing apparatus. This example includes two second light emission devices 81B provided to oppose to each other across the light receiving device 81A and emit light from both sides to be incident at angles of 45 degrees. The reason of employment of this configuration is as follows. In the case where the bill has a scratch, wrinkle, or crease, if the uneven surface is irradiated with light from only either side, the light might be blocked at the uneven part to generate a shadow. For this reason, this example prevents generation of a shadow of the uneven part by emitting light from the both sides to acquire more precise image data than the image data acquired by emitting light from one side. Note that the second light emission device 81B can be a single unit provided on only one side.

The configuration and arrangement of the light emission unit 80 and the light receiving and emission unit 81 are not limited to the present embodiment and can be modified as appropriate.

The barcode sensor (second sensor) 88 is provided on the first conveyance path 4B bent with respect to the first conveyance path 4A, more specifically, between the feed roller pair (16A, 16B) and the feed roller pair (17A, 17B). The barcode sensor 88 is made of a reflective-type photosensor. The barcode sensor 88 is provided above the first conveyance path 4B as illustrated in FIGS. 2 and 3 and emits light from above the bill being conveyed or the barcode of the paper sheet being conveyed.

The barcode sensor (second sensor) 88 has a function to read the barcode on the paper sheet being conveyed when the bill reader (first sensor) 8 cannot read the barcode (or when the paper sheet has been inserted with the printed surface up). The barcode sensor 88 may have a function other than the function to read a barcode. For example, the barcode sensor 8 may have another function to monitor the movement of a bill or a paper sheet with a barcode suspended at an escrow position, which will be described later.

The bill holder 100 for holding bills holds the bills (including paper sheets with a barcode) verified by the bill reader 8 and stacked one by one.

As shown in FIGS. 3 to 6, the body frame 100A of the bill holder 100 has a shape of a substantially rectangular prism. Inside the bill holder 100, biasing components (bias springs) 106 are provided; an end of each biasing component 106 is attached to the inner face of the front wall 102A and the other end is attached to a holder plate 105 for stacking the bills fed through the aforementioned receiving slit 103 one by one. Accordingly, the holder plate 105 is biased toward the later-described presser plate 115 with the biasing components 106.

Inside the body frame 100A, a pressing standby space 108 is provided continuously from the receiving slit 103 to hold a fallen bill without doing anything. On the both sides of the pressing standby space 108, a pair of restriction members 110 is provided to extend vertically toward the holder plate 105. Between the pair of restriction members 110, an opening is formed to allow a presser plate 115 to pass through when bills are stacked one by one onto the holder plate 105.

On the inner faces of the both side walls of the body frame 100A, protrusion walls are provided to stop the holder plate 105 pushed by the biasing components 106. When the holder plate 105 is biased by the biasing components 106, the both sides of the bill on the top of the bills stacked on the holder plate 105 are pressed against these protrusion walls; the protrusion walls serve to stably hold the stacked bills.

Within the body frame 100A, a presser plate 115 is further provided. The presser plate 115 is to press a bill fallen from the receiving slit 103 into the pressing standby space 108 toward the holder plate 105. The presser plate 115 has a size allowed to move back and forth in the opening formed between the pair of restriction members 110. Accordingly, the presser plate 115 is driven back and forth between a position in the opening to press the bill against the holder plate 105 (pressing position) and a position to release the pressing standby space 108 (initial position). With the pushing motion of the presser plate 115, the bill passes through the opening in a slackened manner and is placed on the holder plate 105.

The presser plate 115 is driven back and forth as described above by the presser plate driving mechanism 120 provided inside the body frame 100A. The presser plate driving mechanism 120 includes a pair of link members 115A and 115B. The one end of each link member are pivotally fixed to the presser plate 115 to move the presser plate 115 back and forth in the directions of the arrows A in FIGS. 3 and 5. These link members 115A and 115B are coupled in the shape of a letter X, the other end of each link member is pivotally fixed to a movable member 122 provided movable in the vertical directions (the directions of the arrows B). This movable member 122 has a rack, which is meshed with a pinion included in the presser plate driving mechanism 120.

As shown in FIG. 5, this pinion is coupled to a holder-side gear train 124 included in the presser plate driving mechanism 120. In the present embodiment, the apparatus main body 2 includes a driving source (motor 20) and a main body-side gear train 21 that sequentially engage with the motor 20. When the bill holder 100 is attached to the apparatus main body 2, the main body-side gear train 21 is coupled to the holder-side gear train 124. That is to say, the holder-side gear train 124 includes a gear 124B provided coaxially with the pinion, and gears 124C and 124D that sequentially engage with the gear 124B; when the bill holder 100 is attached to the apparatus main body frame 2A, the gear 124D engages the final gear 21A of the main body-side gear train 21, and when the bill holder 100 is removed from the apparatus main body frame 2A, the gear 124D is disengaged from the final gear 21A of the main body-side gear train 21.

Because of this configuration, rotating the motor 20 in the apparatus main body 2 drives the presser plate 115 back and forth in the directions of the arrows A through the main body-side gear train 21 and the presser plate driving mechanism 120 (the holder-side gear train 124, the rack of the movable member 122, and the link members 115A and 115B).

Within the body frame 100A, a conveyor member 150 is provided that can contact a bill delivered through the receiving slit 103. The conveyor member 150 serves to contact and guide the bill stably to the proper position in the pressing standby space 108 (the position where the bill can be stably pressed by the presser plate 115 without lateral displacement). In the present embodiment, this conveyor member is a belt-like member (hereinafter, referred to as belt 150) led to the pressing standby space 108.

The belt 150 is provided to extend along the direction of delivery of a bill and winded around a pair of pulleys 150A and 150B which are rotatably supported at the ends in the delivery direction. The belt 150 is in contact with the feed roller 150C which is rotatably supported in the vicinity of the receiving slit 103 and extends in the axial direction. The belt 150 sandwich the bill delivered to the receiving slit 103 with the feed roller 150C and guide the bill to the pressing standby space 108. In the present embodiment, the belt 150 is paired with another belt 150 and the pair of belts 150 is provided on both sides of the presser plate 115 to contact both sides of a surface of a bill. In addition to winding around the pulleys 150A and 150B at the both ends, the belt 150 may engage a tension pulley provided at the middle not to slack.

The pair of belts 150 is driven by the motor 13 for driving the aforementioned multiple feed rollers provided in the apparatus main body 2. Specifically, as illustrated in FIG. 6, the aforementioned driving belt 13B to be driven by the motor 13 is winded around a pulley 13D for transmitting the driving power. A gear train 13E provided sequentially to this pulley 13D to transmit the power engages a gear train 153 provided at an end of the support shaft of the pulley 150A, which is rotatably supported in the vicinity of the receiving slit 103. That is to say, when the bill holder 100 is attached to the apparatus main body 2, the final gear of the gear train 13E engages the input gear of the gear train 153 and the pair of belts 150 is driven to rotate together with the above-described bill feed rollers 14B 15B, 16B, and 17B.

As described above, when a bill is inserted through the bill slot 5, the bill conveyance mechanism 6 moves the bill along the bill conveyance path 3. As shown in FIG. 3, the bill conveyance path 3 is composed of the first conveyance path 4A and the first conveyance path 4B. The first conveyance path 4A extends from the bill slot 5 toward the back. The first conveyance path 4B extends and slants down at a specific angle from the first conveyance path 4A toward the downstream. The first conveyance path 4B is provided with a shutter member 170 to prevent conveyance of a bill toward the bill slot 5 because of a wrongdoing.

As illustrated in FIG. 7, on the under surface of the apparatus main body 2, a plate 2F with a circuit board 141 is integrally attached. The circuit board 141 includes a magnetic sensor 140 and a reader/writer 142 for writing information to and reading information from a storage unit 104 provided on the top wall 102B of the bill holder 100. This plate 2F is interposed and fixed between the body frame 2A of the apparatus main body and the top face of the stand 2D.

On the top wall 102B of the body frame 100A, a storage unit 104 is attached, as described above. The storage unit 104 is a contactless type and has a function to store information on the amount and a serial number of a bill sent from the apparatus main body 2. The storage unit 104 stores an identification number for managing the bill holder 100 in advance. In the present embodiment, the storage unit 104 is configured with an RFID (radio frequency identification) tag.

The storage unit 104 includes an IC chip 104B mounted on a substrate 104A made of an insulating material and a coil antenna 104C printed on the substrate 104A and connected with the IC chip 104B at the both ends. The storage unit 104 in this example configured with an RFID tag is a passive type that does not have a battery, but may be an active type that has a battery.

The reader/writer for writing information (information on a verified bill, the serial number of the bill, and the identification number of the bill holder) to the storage unit 104 is mounted on the circuit board 141 on the plate 2F attached to the under surface of the apparatus main body 2. The reader/writer wirelessly sends the information on a bill (including the serial number) to the storage unit 104 at predetermined intervals. That is to say, the reader/writer 142 on the circuit board 141 includes a communication controller composed of passive components such as an IC chip and an LCR, an antenna connected with the communication controller to send information on a bill to the coil antenna 104C of the storage unit 104, and a matching circuit to perform matching in consideration of the frequency of the radio wave used in the communication and the input and output impedance. These components such as the communication controller, the antenna, and the matching circuit are mounted on the circuit board 141.

Next, a controller 200 for controlling the driving of the above-described components such as the bill conveyance mechanism 6 and the bill reader 8 is described with reference to the block diagram of FIG. 8.

The method of verifying a bill in the present embodiment first irradiates a bill or a paper sheet with a barcode printed thereon (hereinafter referred to as paper sheet or object to be verified) being conveyed by the bill conveyance mechanism 6 with light (red light) from the second light emission device 81B of the light receiving and emission unit 81 and receives the reflection with the light receiving device (line sensor) 81A to read the paper sheet. This reading is performed in units of pixels each having a predetermined size when the paper sheet is being conveyed. The acquired image data composed of a large number of pixels (a plurality of pixels) is stored in a storage such as a RAM. The image data composed of a plurality of pixels stored at this stage includes information on color including brightness (density value) on each pixel provided by a converter module. As will be described later, the converter module selects a numerical value from 0 to 255 (0: black to 255: white) in accordance with the density value and assigns the numerical value to each pixel in the form of one-byte information.

As described above, the image acquired by the line sensor is converted by the converter module to pixel information including information on color including brightness (density value) to be used for verification of both of a bill and a paper sheet with a barcode. That is to say, the object to be verified can be identified as a bill or a paper sheet with a barcode with the light receiving device and the light emission device. Accordingly, a bill and a paper sheet with a barcode can be verified inexpensively.

Figure 8:
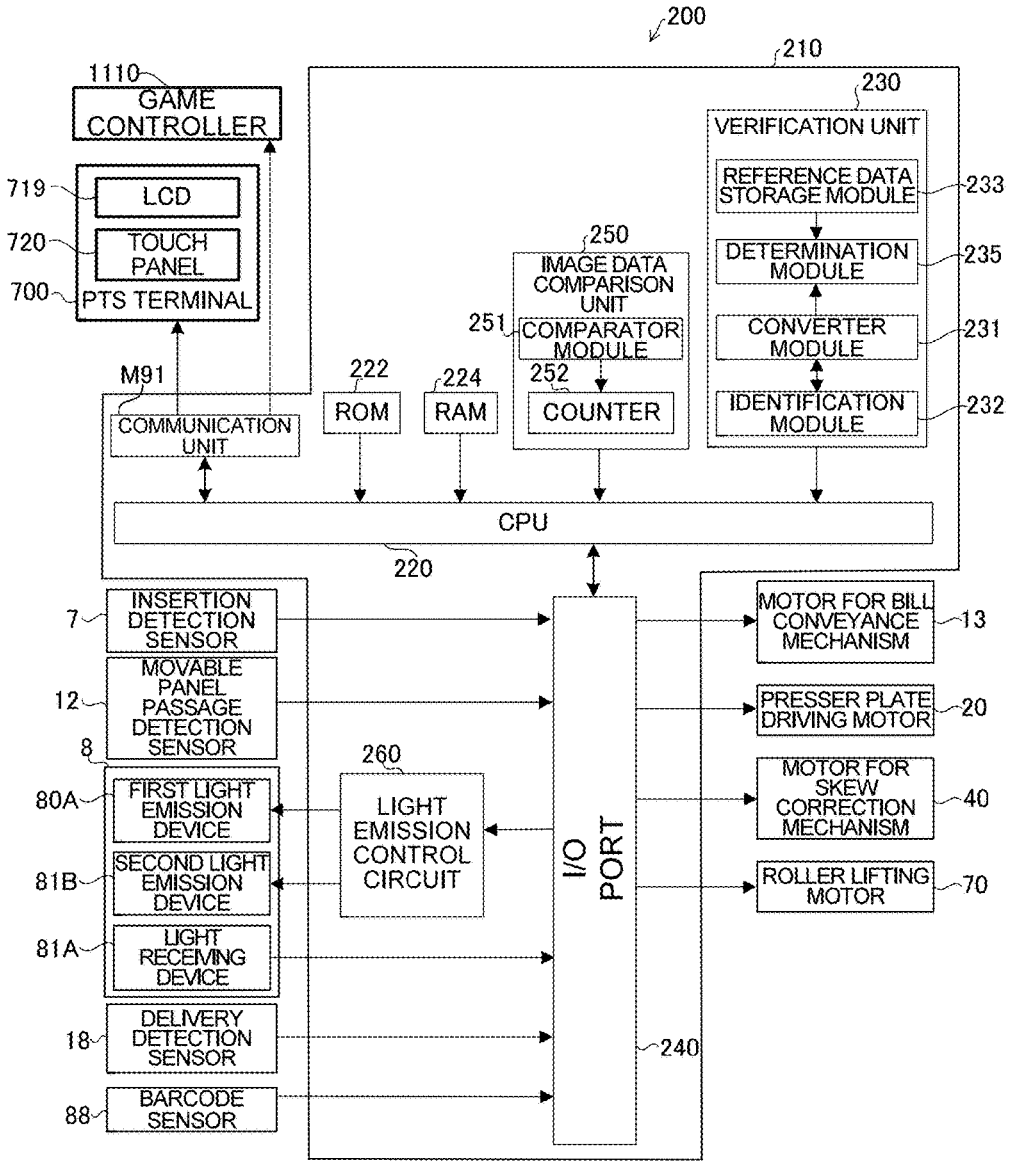
FIG. 8 is a block diagram for illustrating a configuration of a controller for controlling the driving of the components such as a bill conveyance mechanism and a bill reader.

The controller 200 in the block diagram of FIG. 8 includes a control board 210 for controlling the operation of the aforementioned driving devices. This control board 210 includes a CPU (central processing unit) 220 for controlling the driving devices and serving as a bill identification unit, a ROM (read only memory) 222, a RAM (random access memory) 224, a verification unit 230, and an image data comparison unit 250 mounted thereon.

The ROM 222 stores permanent data such as operating programs for the driving devices such as the motor 13 for the bill conveyance mechanism, the presser plate driving motor 20, the motor 40 for the skew correction mechanism, and the roller lifting motor 70, and a verification program for the verification unit 230.

The CPU 220 operates in accordance with the programs stored in the ROM 222 to control the overall operation of the paper sheet processing apparatus by receiving and sending signals with the aforementioned driving devices via I/O ports 270. That is to say, the CPU 220 is connected with the motor 13 for the bill conveyance mechanism, the presser plate driving motor 20, the motor 40 for the skew correction mechanism, and the roller lifting motor 70 via the I/O ports 270. The operation of these driving devices is controlled by control signals sent from the CPU 220 in accordance with the operating programs stored in the ROM 222. The CPU 220 also receives detection signals from the insertion detection sensor 7, the movable panel passage detection sensor 12, the delivery detection sensor 18, and the barcode sensor 88 via the I/O ports 270. The CPU 220 performs driving control of the aforementioned driving devices based on these detection signals. The barcode sensor 88 has another function to verify a barcode when a paper sheet with the barcode is conveyed in a state where the barcode faces up.

The CPU 220 further receives detection signals based on the light transmitted through and reflected off the object to be verified from the light receiving device 81A of the bill reader 8 via the I/O ports 270.

The RAM 224 has functions to temporarily store data and programs to be used to operate the CPU 220 and temporarily store acquired received-light data (image data composed of a plurality of pixels) on an object to be verified, such as a bill or a paper sheet with a barcode.

The verification unit 230 includes a converter module 231, an identification module 232, a reference data storage module 233, and a determination module 235. The converter module 231 converts received-light data on the object to be verified stored in the RAM 224 to pixel information including information on color including brightness (density value) on each pixel. The identification module 232 identifies the conveyed object to be verified as a bill or a paper sheet with a barcode based on the pixel information acquired by the conversion at the conversion module 231. The reference data storage module 233 stores reference data on bills and paper sheets. The determination module 235 compares the pixel data including density values of the converter module 231 with reference data stored in the reference data storage module 233 to determine whether the object is genuine.

In the present embodiment, the reference data is stored in the dedicated reference data storage module 233; however, the reference data can be stored in the ROM 222. The reference data to be compared with can be stored in the reference data storage module 233 in advance. The reference data may be acquired and stored by actually conveying genuine paper sheets through the bill conveyance mechanism 6 and acquiring received-light data.

The image data comparison unit 250 includes a comparator module 251 and a counter 252. The comparator module 251 compares image data determined to be counterfeit in verification that compares the image data with data prepared (stored in the storage) to identify a genuine paper sheet or determine whether a barcode including information on credits is true, with the image data of the paper sheet inserted immediately before the current determination or the last-inserted paper sheet before the current determination. The counter 252 counts the number of comparison results indicating that the image data determined to be counterfeit is identical to the image data of the last-inserted paper sheet. The counter 252 can be a counter memory or configured so that an independent counter will store a counted value to a predetermined area in the RAM 224. It should be noted that the image data to be used to the comparison by the image data comparison unit 250 is not limited to the last image data before the current verification. Image data of inserted paper sheets can be successively stored and the image data of these paper sheets can be used in the comparison. This configuration enables handling of a case where genuine paper sheets and counterfeit paper sheets are mixed and inserted.

The CPU 220 is further connected with the aforementioned first light emission device 80A and second light emission device 81B in the bill reader 8 via the I/O ports 240. The turning on and off and the intervals between lighting of these first light emission device 80A and second light emission device 81B are controlled by the light emission control circuit 260 based on the control signal sent from the CPU 220 in accordance with the aforementioned operating program stored in the ROM 222. That is to say, turning on and off and the manner of lighting of the first light emission device 80A and second light emission device 81B are controlled by a light emission controller configured with the CPU 220, the ROM 222, and the light emission control circuit 260.

Specifically, the light emission controller controls the first light emission device 80A and second light emission device 81B to irradiate the object to be verified on the conveyance path with light at predetermined intervals (first lighting intervals). If the identification module 232 identifies the object as a bill, the light emission controller continues the lighting of the first light emission device 80A and the second light emission device 81B without change. If the identification module 232 identifies the object as a paper sheet with a barcode, the light emission controller controls the light emission so that the first light emission device 80A and the second light emission device 81B will stop emitting infrared light and the second light emission device 81 will keep emitting red light but at shorter intervals (second lighting intervals).

As described above, it is required to discriminate the narrowest line width (approximately 0.508 mm) to read a barcode. Accordingly, higher resolution (shorter lighting intervals of the red light) is required to read a barcode than the resolution to read a bill. In the present embodiment, compared to the resolution required to read a bill (for example, 50 dpi), the resolution is raised to 200 dpi by changing the lighting intervals to ¼ in reading a barcode.

Meanwhile, the barcode sensor 88 performs read processing all the time on every inserted paper sheet.

Processing on Paper Sheet in First Embodiment

Hereinafter, operation of the controller 200 to process a paper sheet in the paper sheet processing apparatus 1 is described with reference to the flowcharts of FIGS. 9 to 15.

When the operator (supplier) inserts a bill or a paper sheet with a barcode (hereinafter, the both of them are referred to as paper sheet) into the bill slot 5, the feed roller pair (14A, 14B) provided in the vicinity of the bill slot 5 are apart from each other in the initial state (see ST18, ST56 described later). The presser plate 115 is at a standby position where the pair of link members 115A and 115B for driving the presser plate 115 is positioned in the pressing standby space 108 and does not allow the paper sheet to slip in the pressing standby space 108 from the receiving slit 103. That is to say, since the presser plate 115 is in the opening formed between a pair of restriction members 110, paper sheets held in the bill holder cannot be drawn out through the opening.

Furthermore, the movable panel pair 10A of the skew correction mechanism provided downstream of the feed roller pair (14A, 14B) is at a minimum width position (for example, the distance between the movable panel pair 10A is 52 mm, see ST17 and ST57 described later) in the initial state not to allow any paper sheet to be drawn out.

In the above-described initial state of the feed roller pair (14A, 14B), the operator can easily insert a paper sheet even if the paper sheet is creased. As soon as the insertion detection sensor 7 detects insertion of a paper sheet (ST01), the controller 200 drives the motor 20 for driving the presser plate 115 to rotate reversely by a predetermined amount (ST02) so that the presser plate 115 is moved to an initial position. That is to say, until the insertion detection sensor 7 detects insertion of a paper sheet, the presser plate 115 is in the opening formed between the restriction member pair 110 and does not allow paper sheets to pass through the opening.

When the presser plate 115 is moved from the standby position to the initial position, the pressing standby space 108 is opened (see FIG. 5) to be ready to put a paper sheet into the bill holder 100. That is to say, reversely rotating the motor 20 by a predetermined amount drives the main body-side gear train 21 and the presser plate driving mechanism 120 (the holder-side gear train 124, the rack provided on the movable member 122, and the link members 115A and 115B) to move the presser plate 115 from the standby position to the initial position.

Furthermore, the controller 200 drives the roller lifting motor 70 so that the upper feed roller 14A is moved to engage the lower feed roller 14B. As a result, the inserted paper sheet is pinched by the feed roller pair (14A, 14B) (ST03).

Figure 12:
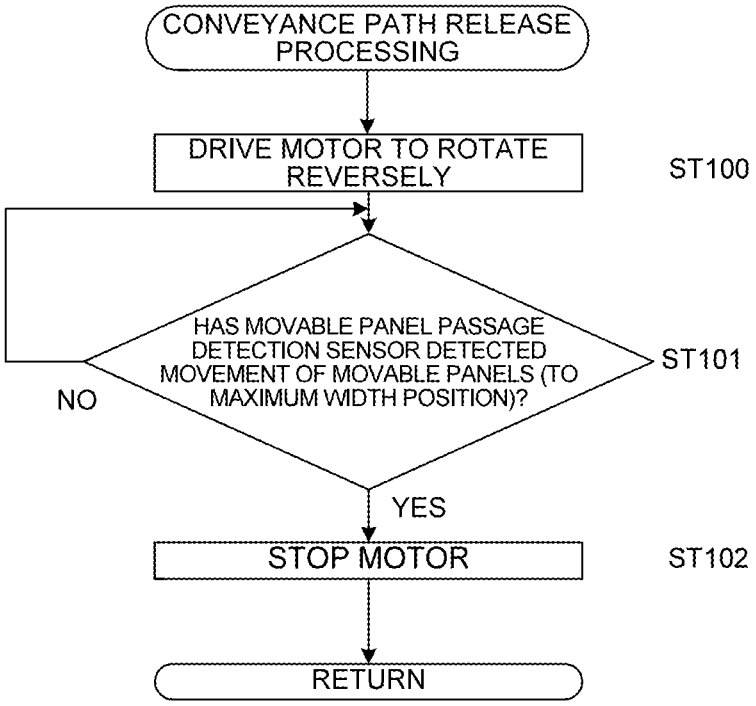
FIG. 12 is a flowchart of conveyance path release processing.

Next, the controller 200 performs bill conveyance path release processing (ST04). This release processing is performed by driving the motor 40 for the skew correction mechanism to rotate reversely so that the pair of movable panels 10A is moved in the directions of getting away from each other, as illustrated in the flowchart of FIG. 12 (ST100). When the movable panel passage detection sensor 12 for detecting the positions of the pair of movable panels 10A detects that the pair of movable panels 10A has moved to the predetermined position (maximum width position) (ST101) during this operation, the controller 200 stops the reverse rotation of the motor 40 (ST102). Through this conveyance path release processing, the paper sheet is ready to move in between the pair of movable panels 10A. Before this step ST04, the bill conveyance path 3 is in a closed state by the conveyance path closure processing (ST17, ST57). Keeping the bill conveyance path 3 closed until insertion of a paper sheet helps to prevent crash of the elements such as the line sensor with a stick-like member maliciously inserted from the bill slot, for example.

Returning to FIG. 9, the controller 200 drives the motor 13 for the bill conveyance mechanism to rotate forward (ST05). The paper sheet is conveyed by the feed roller pairs (14A, 14B) to the inside of the apparatus and the movable panel passage detection sensor 12 provided downstream of the skew correction mechanism 10 detects the leading end of the paper sheet. In response to the detection of the leading end of the paper sheet, the controller 200 stops the motor 13 for the bill conveyance mechanism (ST06, ST07). At this time, the paper sheet is positioned between the pair of movable panels 10A of the skew correction mechanism 10.

The controller 200 drives the roller lifting motor 70 to disengage the feed roller pairs (14A, 14B) pinching the paper sheet from each other (ST08). The paper sheet is freed from the load.

Figure 13:
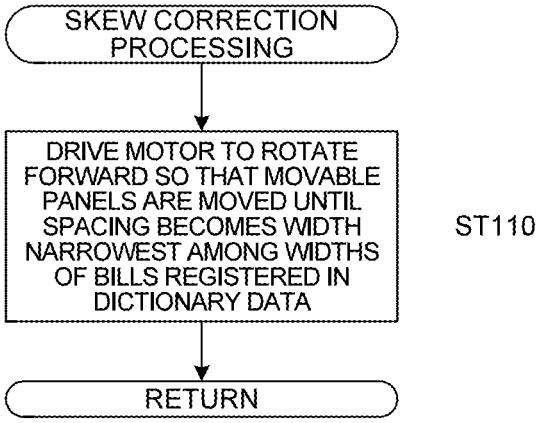
FIG. 13 is a flowchart of skew correction processing.
Figure 14:
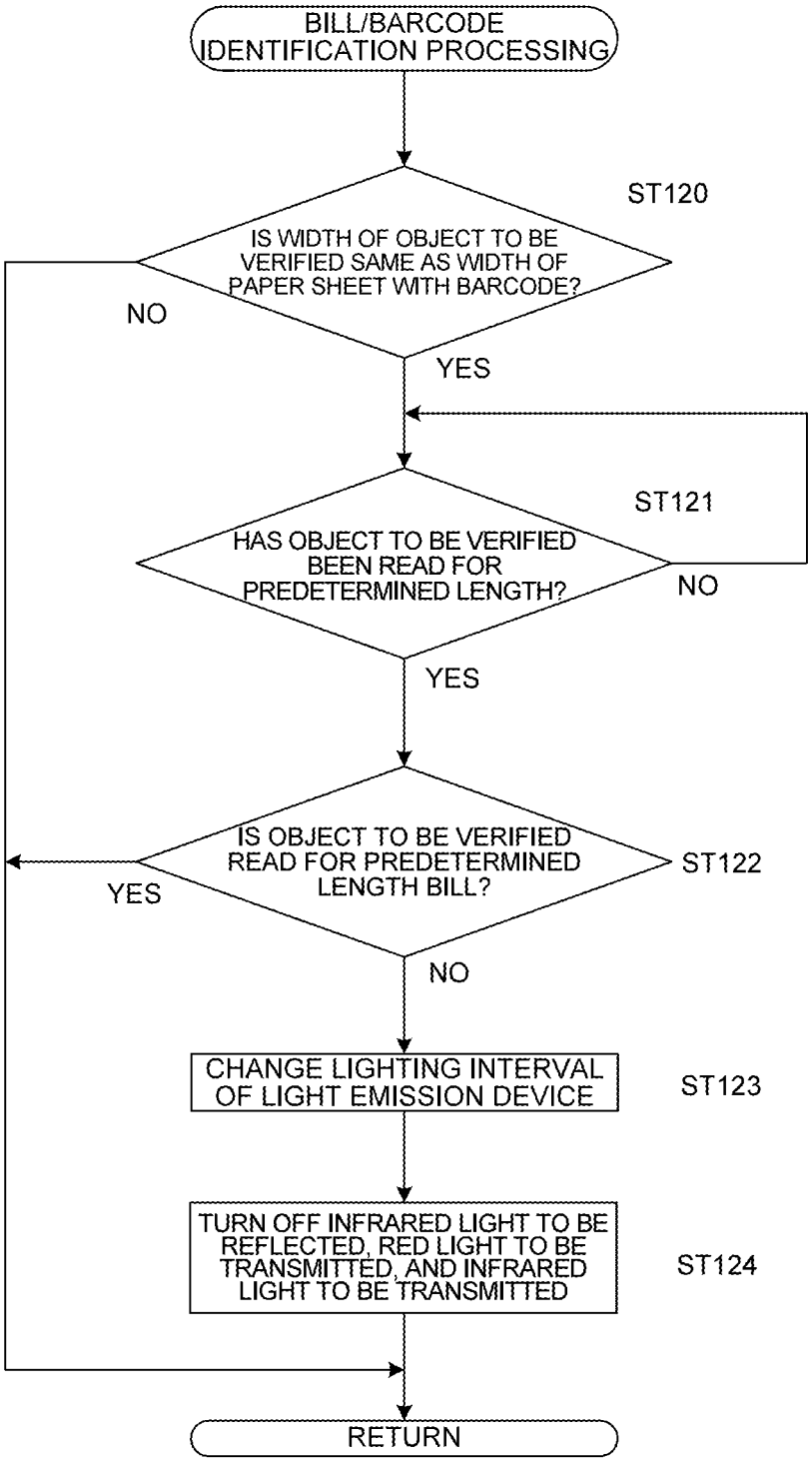
FIG. 14 is a flowchart of bill/barcode identification processing.

The controller 200 then performs skew correction processing (ST09). The skew correction processing is performed by driving the motor 40 for the skew correction mechanism to rotate forward so that the pair of movable panels 10A is moved in the directions of getting closer to each other. That is to say, as illustrated in the flowchart of FIG. 13, the controller 200 drives the motor 40 to rotate forward so that the pair of movable panels 10A are moved in the directions of getting closer to each other (ST110). The movable panels 10A are moved until the spacing between the movable panels 10A becomes the width (for example, 62 mm) narrowest among the widths of the bills registered in the reference data storage module 233 of the controller 200. As a result, the both edges of the paper sheet abut against the movable panels 10A so that the skew of the paper sheet is corrected and properly positioned to the center.

After completion of the skew correction processing, the controller 200 performs conveyance path release processing (ST10). This processing is performed by driving the motor 40 for the skew correction mechanism to rotate reversely so that the pair of movable panels 10A is moved in the directions of getting away from each other (see ST100 to ST102 in FIG. 12).

Figure 10:
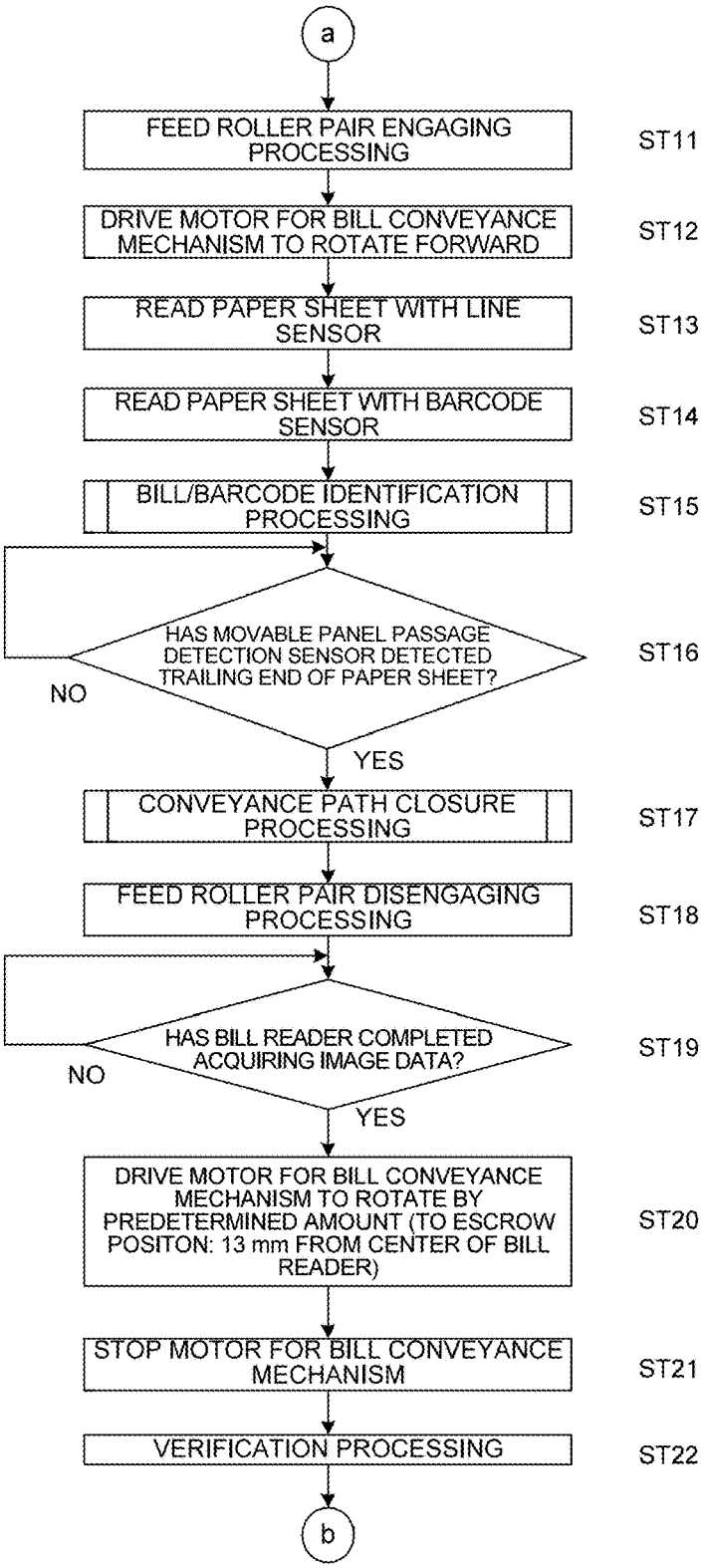
FIG. 10 is a flowchart of processing a paper sheet in the paper sheet processing apparatus in the present embodiment.

Subsequently, as illustrated in FIG. 10, the controller 200 drives the roller lifting motor 70 to move the upper feed roller 14A until the upper feed roller 14A engages the lower feed roller 14B, so that the paper sheet is pinched with the feed roller pair (14A, 14B) (ST11). Thereafter, the controller 200 drives the motor 13 for the bill conveyance mechanism to rotate forward so that the paper sheet is conveyed toward the back of the apparatus (ST12). The controller 200 controls the bill reader 8 to perform paper sheet reading processing when the paper sheet passes through the bill reader 8 (ST13). The controller 200 simultaneously controls the barcode sensor 88 to start reading the paper sheet (ST14). FIG. 4 shows the position of the paper sheet at this event. The paper sheet M is pinched by the feed roller pair (16A, 16B) and conveyed from the first conveyance path 4A to 4B by rotation of the feed roller pair. FIG. 4 illustrates a state where the leading end of the paper sheet M is detected by the barcode sensor 88. It is to be noted that the timing for the bill reader 8 and the barcode sensor 88 to start reading may be different depending on the size, particularly, the length in the direction of conveyance, of the paper sheet or the bill being conveyed.

In the paper sheet reading processing, the controller 200 first performs bill/barcode identification processing (ST15). As illustrated in the flowchart of the bill/barcode identification processing in FIG. 14, the controller 200 first determines whether the object to be verified has the width of the paper sheet with a barcode (ST120). Since the paper sheets to print a barcode thereon are specified to have a width same as the bills of a specific country (the bills to be used); if the width of the paper sheet is not the same as the width of the bills, the controller 200 identifies the paper sheet as a bill of another country and performs verification processing (ST22) to be described later.

Figure 16:
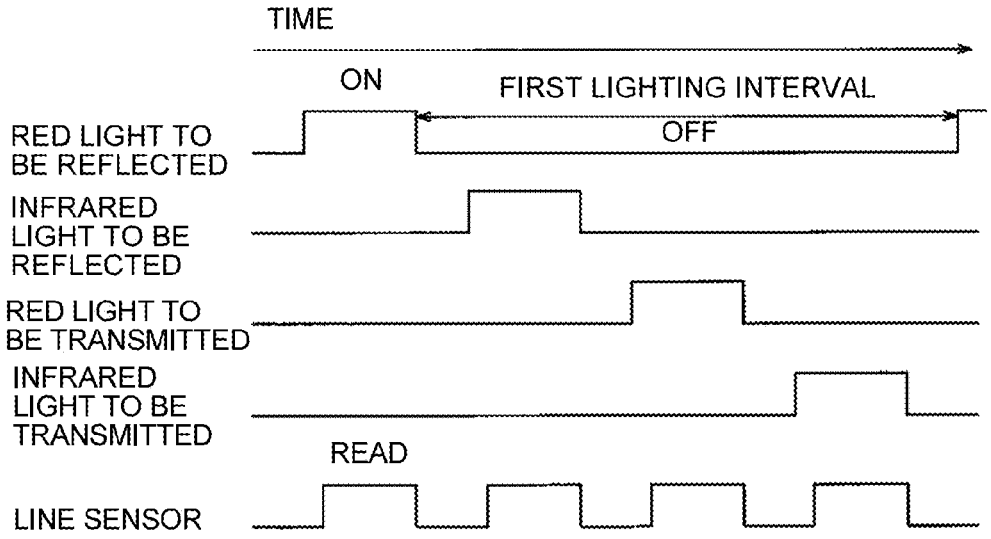
FIG. 16 is a timing chart for illustrating lighting control of light emission devices for a bill reader to read a bill.
Figure 17:
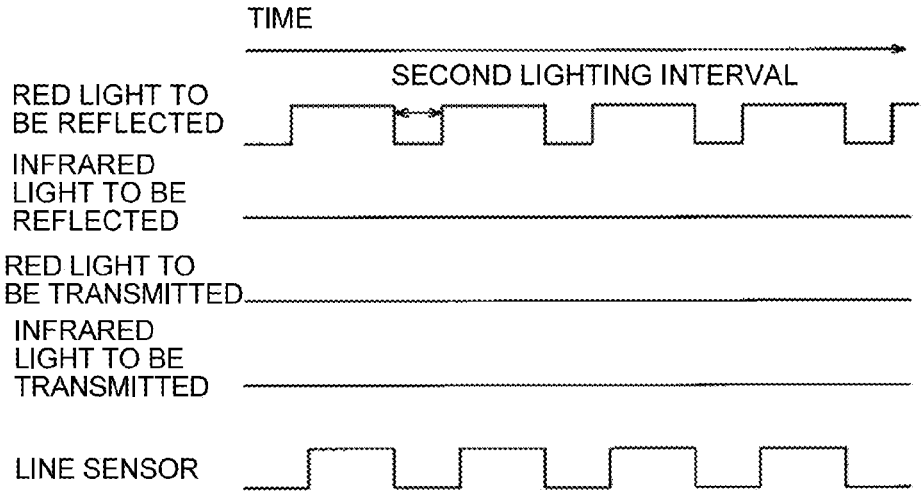
FIG. 17 is a timing chart for illustrating lighting control of the light emission devices for the bill reader to read a paper sheet with a barcode.

Next, the controller 200 controls the bill reader 8 to read the object to be verified being conveyed for a predetermined length (ST121). In reading the object to be verified for a specific length, the controller 200 sets the first light emission device 80A and the second light emission device 81B to the mode to read a bill, as illustrated in the timing chart of FIG. 16. Specifically, the controller 200 controls the light sources in the first light emission device 80A and the second light emission device 81B for four types of light, the red light and infrared light to be transmitted and the red light and infrared light to be reflected, to repeatedly emit each type of light at a specific interval (first lighting interval). In addition, the controller 200 controls the light sources so that the phases of light will not overlap with one another, or two or more types of light sources will not emit light simultaneously. In other words, the controller 200 controls each type of light source not to emit light when one of the other three types emits light. Such control enables a single light receiving device 81A to detect the four types of light at equal intervals and acquire images in density data of red light and infrared light transmitted through and reflected off the printed area of the object to be verified.

Figure 18:
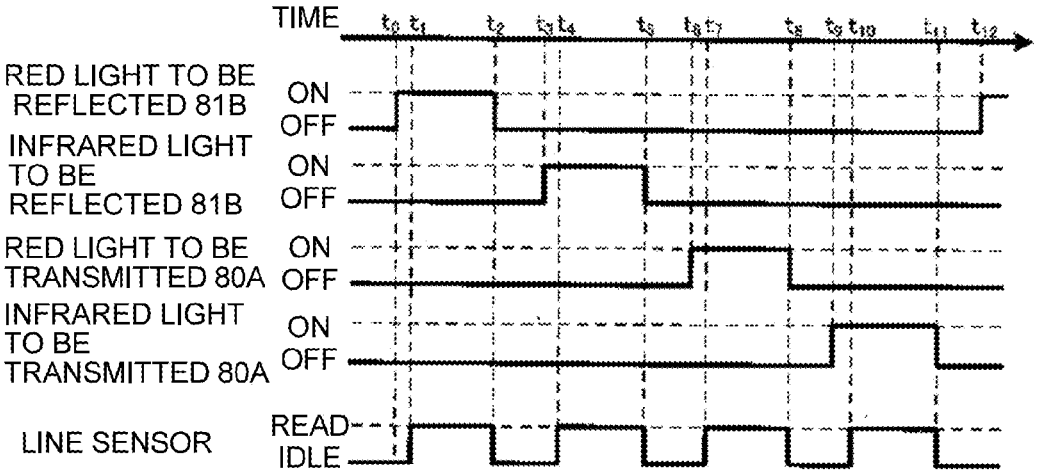
FIG. 18 is a timing chart with times for illustrating lighting control of the light emission devices for the bill reader to read a bill.

The foregoing control is described more specifically with reference to the timing chart of FIG. 18. At time t0, the second light emission device 81B starts emitting red light and after a little time lag, the light receiving device (line sensor) 81A starts reading at time t1. At time t2, the second light emission device 81B stops emitting red light and the line sensor 81A immediately stops reading. Next, at time t3, the second light emission device 81B starts emitting infrared light and after a little time lag, the line sensor 81A starts reading at time t4. At time t5, the second light emission device 81B stops emitting infrared light and the line sensor 81A immediately stops reading. At time t6, the first light emission device 80A starts emitting red light and after a little time lag, the line sensor 81A starts reading at time t7. At time t8, the first light emission device 80A stops emitting red light and the line sensor 81A immediately stops reading. Next, at time t9, the first light emission device 80A starts emitting infrared light and after a little time lag, the line sensor 81A starts reading at time t10. At time t11, the first light emission device 80A stops emitting infrared light and the line sensor 81A immediately stops reading. At time t12 after a first lighting interval (t12–t2), the second light emission device 81B starts emitting red light again. In this manner, each type of light is not emitted simultaneously with any other type of light; the accuracy in reading at the line sensor 81A increases. Meanwhile, since the object to be verified is conveyed during these operations, the read position changes from moment to moment. For this reason, if the lighting interval is long, the spacing between read positions is also large.

Returning to FIG. 14, the identification module 232 identifies the object to be verified read for a predetermined length as a bill or a paper sheet with a barcode (ST122). That is to say, the identification module 232 identifies the conveyed object to be verified as a bill or a paper sheet with a barcode, based on the pixel information (pixel information including a density value at each pixel) converted by the converter module 231 from the predetermined length of acquired image. Specifically, if the object to be verified is a paper sheet S with a barcode, the barcode is provided in the central region of the sheet as shown in the schematic diagram of FIG. 19; accordingly, the identification module 232 obtains the average value of the pixel information acquired from the first approximately 10 mm. The average value should be higher than the value obtained from a bill because this region includes a little (or no) picture or letters and the extent of whitish color is high. For this reason, the object to be verified can be easily identified as a bill or a paper sheet with a barcode by conveying the object to be verified and acquiring the reflection (red light) off the region of the first approximately 10 mm. This identification can also be made by acquiring the transmitted light.

If the object to be verified is identified as a bill, (ST122: YES) the controller 200 keeps the lighting control of the first light emission device 80A and the second light emission device 81B at the first light emission intervals. If the object to be verified is identified as a paper sheet with a barcode (ST122: NO), the controller 200 changes the lighting intervals of the second light emission device 81B to the second lighting intervals (ST123). With the processing of ST123, the controller 200 turns off the first light emission device 80A (the red light and the infrared light to be transmitted) and turns off the infrared light of the second light emission device 81B (ST124).

This is because the types of the light turned off are unnecessary to read a barcode. As a result of this processing, only the red light of the second light emission device 81B is controlled to be emitted at short lighting intervals (compared to the case of a bill, the lighting interval is set to ¼), so that information can be read at high resolution even from a barcode including thin lines.

Figure 15:
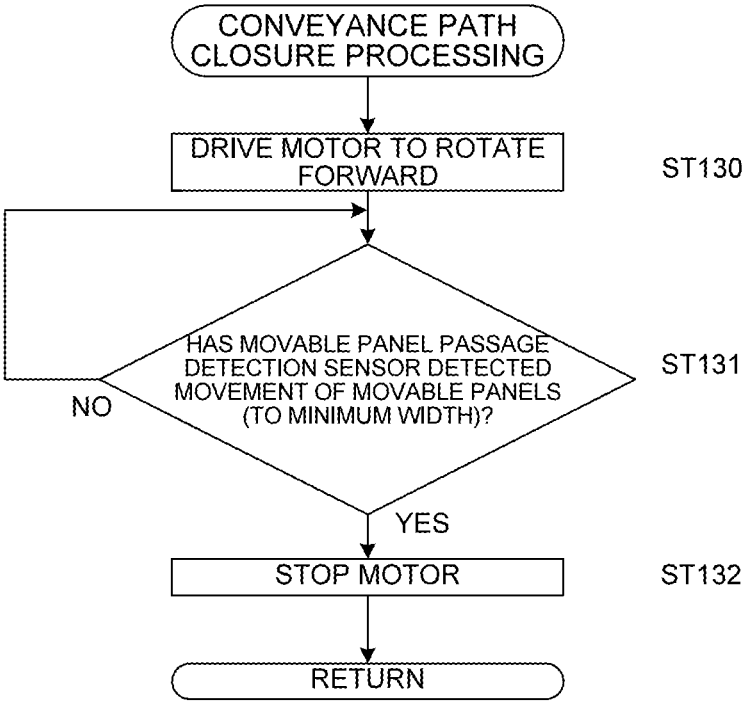
FIG. 15 is a flowchart of conveyance path closure processing.

When the paper sheet being conveyed has passed through the bill reader 8 and the trailing end of the paper sheet is detected by the movable panel passage detection sensor 12 (ST16: YES), the controller 200 performs closure processing of the bill conveyance path 3 (ST17). As illustrated in the flowchart of FIG. 15, after the movable panel passage detection sensor 12 detects the trailing end of the paper sheet, the controller 200 drives the motor 40 to rotate forward to move the pair of movable panels 10A in the directions of getting closer to each other (ST130). When the movable panel detection sensor detects that the pair of movable panels 10A has moved to a predetermined position (the minimum width position for a width of 52 mm, for example) (ST131: YES), the controller 200 stops the forward rotation of the motor 40 (ST132).

Through this conveyance path closure processing, the pair of movable panels 10A is moved to the minimum width position (for a width of 52 mm), which is narrower than the widths of any kinds of bills allowed to be inserted, so that the paper sheet is effectively prevented from being pulled out. That is to say, the conveyance path closure processing narrows the space between the movable panels 10A further than the width of the inserted paper sheet to effectively prevent the operator from maliciously pulling the paper sheet toward the bill slot.

Subsequent to the conveyance path closure processing (ST17), the controller 200 drives the roller lifting motor 70 to perform feed roller pair disengaging processing (ST18) that disengages the pair of feed rollers (14A, 14B) that has been in a state capable of pinching a paper sheet. After this feed roller pair disengaging processing, if the operator erroneously inserts another paper sheet (double insertion), the paper sheet is not forwarded by the feed roller pair (14A, 14B). The paper sheet stops against the front ends of the pair of movable panels 10A moved to be close to each other at ST17, so that double insertion of paper sheets can be unfailingly eliminated.

Verification Processing

When the bill reader 8 has acquired data down to the trailing end of the paper sheet, the controller 200 drives, with the bill conveyance path closure processing, the motor 13 for the bill conveyance mechanism to rotate by a predetermined specific amount and stops the paper sheet at a predetermined position (escrow position: the position where the trailing end of the paper sheet is at 13 mm downstream of the central position of the bill reader 8). Subsequently, in the verification unit 230 of the controller 200, the determination module 235 performs verification processing on the paper sheet with reference to the correct data (dictionary data) prepared from genuine sheets and stored in the reference data storage module 233 (ST19 to ST22). As to this dictionary data, update data may be sent as necessary from a management server of a game system (paper sheet processing system) to be described later via USB or a network and the dictionary data stored in the storage in the paper sheet processing apparatus, such as the ROM for the verification unit 230, is updated.

The escrow position is defined as the position where the barcode sensor 88 completes reading the barcode on the paper sheet inserted with the printed surface up but can detect the paper sheet.

If the paper sheet is determined to be genuine based on the dictionary data in the verification processing at the process step of ST22 (ST23: YES), the controller 200 drives the motor 13 for the bill conveyance mechanism to rotate forward to convey the paper sheet toward the bill holder 100 (ST24).

Before starting the processing of ST24, the barcode sensor 88 has already detected the existence of the object to be verified. If the paper sheet is not detected within the paper sheet conveyance processing (when the paper sheet is moving) (ST25: NO), the controller 200 determines that the paper sheet has been pulled out and aborts the operation of the apparatus (ST32). Regarding the processing of ST24, the time to be taken for a paper sheet to pass through the barcode sensor 88 is determined; accordingly, the barcode sensor 88 monitors the paper sheet for the time period (ST26). If the barcode sensor 88 still detects the verified object when the time has passed (ST26: YES, ST27: YES), the controller 200 determines that the paper sheet is jammed and therefore aborts the operation of the apparatus (ST32).

In conveying the paper sheet in the processing of ST24, the controller 200 drives the motor 13 for the bill conveyance mechanism to rotate forward until the trailing end of the paper sheet is detected by the delivery detection sensor 18 (ST28: YES). After the delivery detection sensor 18 detects the trailing end of the paper sheet, the controller 200 further drives the motor 13 for the bill conveyance mechanism to rotate forward by a predetermined amount (ST29, ST30).

The predetermined amount in this forward rotation of the motor 13 for the bill conveyance mechanism at ST29 and ST30 corresponds to the driving amount with which the paper sheet is forwarded from the delivery slit 3A of the apparatus main body 2 provided downstream of the bill conveyance path 3 to the receiving slit 103 of the bill holder 100 and further, stably guided to the pressing standby space 108 by the pair of belts 150 on both sides. That is to say, further rotating forward the motor 13 for the bill conveyance mechanism by the predetermined amount after the delivery detection sensor 18 detects the trailing end of the paper sheet drives the pair of belts 150 in contact with the paper sheet in the feeding direction to stably guide the paper sheet to the pressing standby space 108.

After stopping the motor 13 for the bill conveyance mechanism, the controller 200 drives the presser plate 115 to place the paper sheet on the holder plate 105 (ST31). After completion of the pressing, the controller 200 moves back the presser plate 115 and stops the presser plate 115 at the standby position.

In the above-described verification processing of ST22, if the inserted paper sheet is not determined to be genuine (ST23: NO), the controller 200 performs image data comparison processing (ST40) and paper sheet return processing (ST50).

Image Data Comparison Processing

Figure 11:
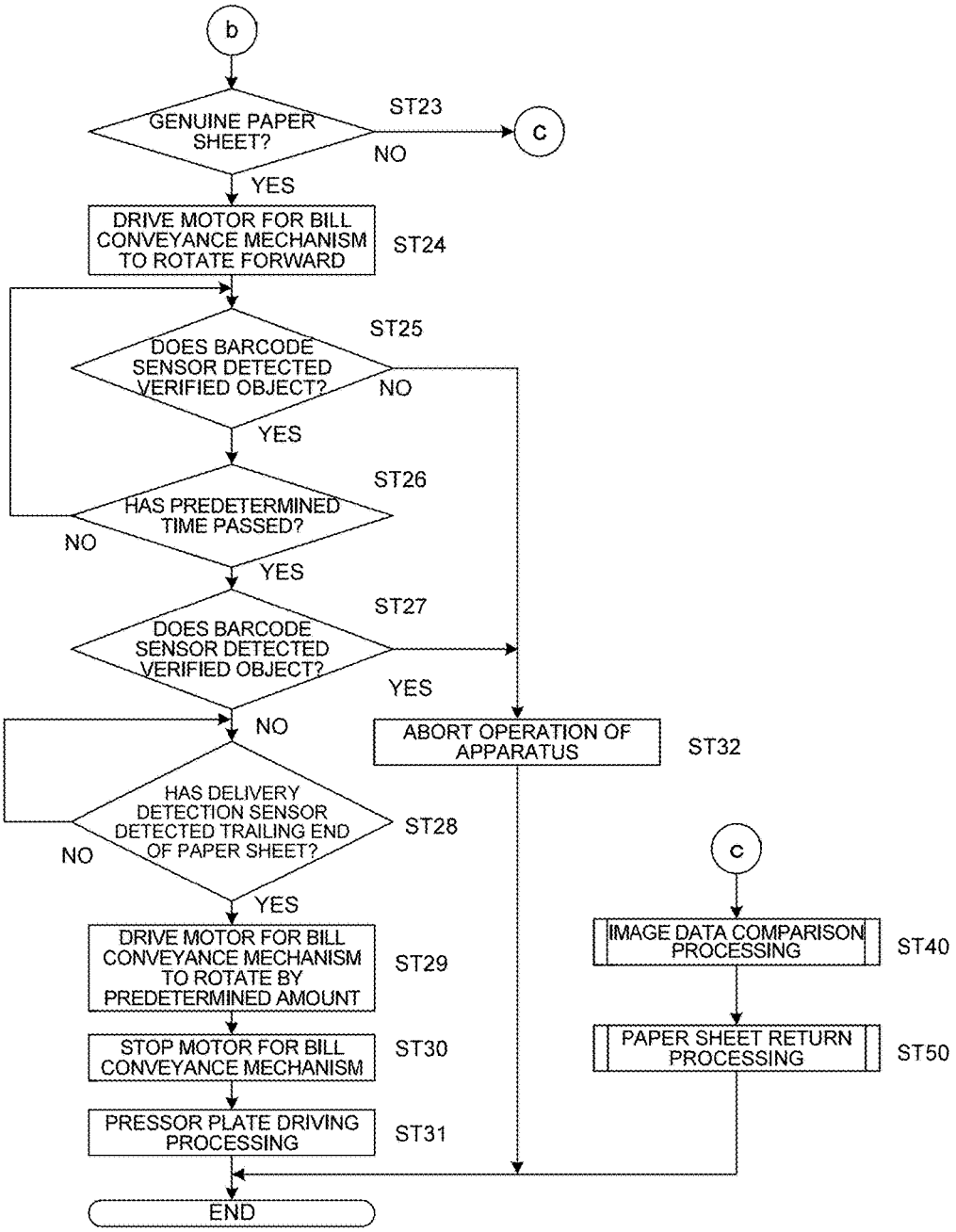
FIG. 11 is a flowchart of processing a paper sheet in the paper sheet processing apparatus in the present embodiment.
Figure 21:
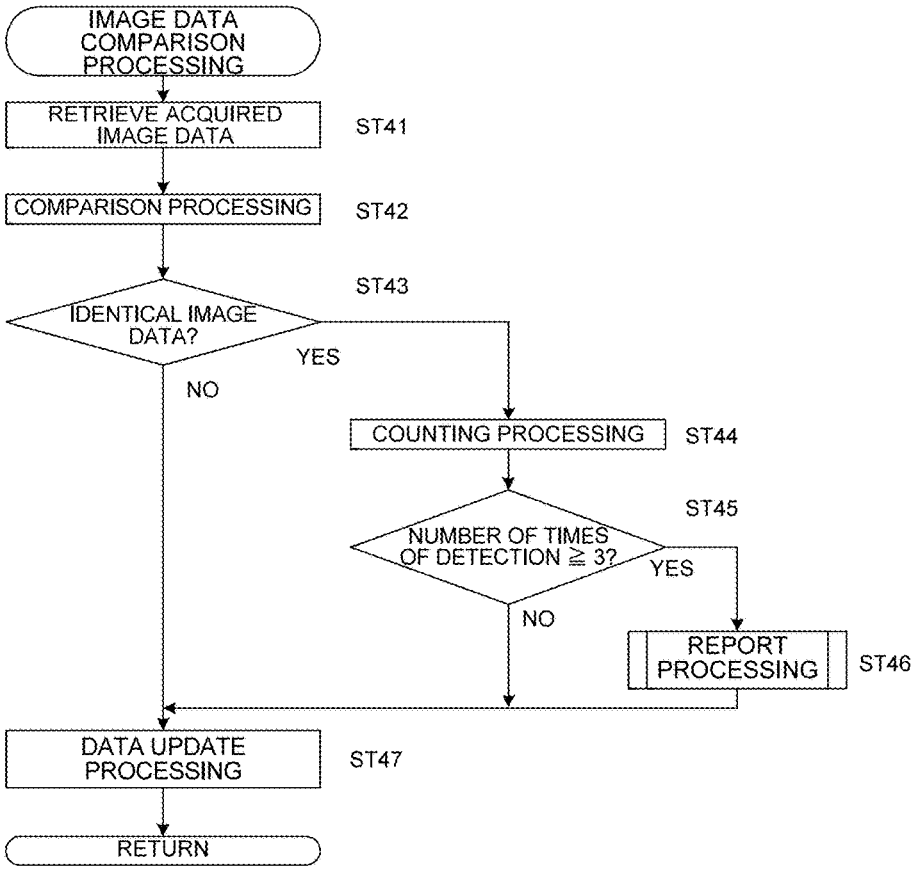
FIG. 21 is a flowchart of image data comparison processing in the paper sheet processing apparatus in the first embodiment.

The image data comparison processing at ST40 in FIG. 11 is performed by the comparator module 251 in the image data comparison unit 250. When the paper sheet is not determined to be genuine at ST23, or the paper sheet is to be subjected to return processing, the comparator module 251 retrieves, as illustrated in FIG. 21, the image data acquired from the paper sheet and the image data of the paper sheet stored in the RAM 224 in the comparison processing immediately before this determination (image data acquired last) and compares them (ST41 to ST43). In this processing, the comparator module 251 may binalize the acquired image data of the paper sheet being processed and then compare the image data by pattern matching with the image data of the last-inserted paper sheet stored in the RAM 224. Alternatively, the comparator module 251 may extract different points of the image data determined to be counterfeit from the reference image data of the genuine paper sheet through pattern matching after each verification and store the differences to the RAM 224 or the ROM 222 as singularities, and determine whether the image data acquired for the next comparison processing includes the stored singularities of the image data. The singularity can be a moire generated in printing a bill, or an offset or a difference of an image extractable and discriminable from the image data in the case where the paper sheet does not include a moire.

If, as a result of the comparison processing (ST42), determining that the image data is identical to the previous image data (ST43: YES), the comparator module 251 determines that the paper sheet being processed is counterfeit because the both paper sheets are identical. When this comparison result is obtained, it is more likely that a wrongdoing is being committed by inserting a counterfeit paper sheet repeatedly. Accordingly, the comparator module 251 sends a detection signal associated with the matched image data to the counter 252.

The counter 252 counts the detection signals sent from the comparator module 251 when a paper sheet is determined to be counterfeit, by signal type (ST44). That is to say, each time the identical image data is found through image data comparison, the number of times of detection of the image data is incremented and stored in a predetermined area of the RAM 224.

Further, the comparator module 251 retrieves the count value of the counter 252 and a pre-specified value (for example, three) from the RAM 224 and compares them (ST45). If the count value is equal to or greater than the specified value (count value≥3) as a result of the comparison (ST45: YES), the comparator module 251 sends a detection signal to invoke report processing (ST46). That is to say, if the count value is equal to or more than three, it is likely that a bill returned from the paper sheet processing apparatus 1 as determined to be counterfeit has been inserted again successively. Accordingly, the comparator module 251 determines that the paper sheet is a counterfeit and sends a detection signal to a host apparatus. The host apparatus can be a management server for managing and controlling a plurality of paper sheet processing apparatuses 1 or an administrative management apparatus connected with the management server in the case where the paper sheet processing apparatus 1 is installed in a hall including a multi-player participation type gaming machine. This processing to send a detection signal to the host apparatus and a system for performing the report processing will be described later.

After sending the detection signal to the host apparatus such as a management apparatus, the comparator module 251 updates the count value of the image data determined to be counterfeit in the verification processing (ST47). That is to say, the number of times of detection is updated to three, for example. If no image data identical to the image data used in the verification is found (ST43: NO), the comparator module 251 counts (stores) a value "1" for new image data to the RAM 224. If the image data is determined to be a match and the detection is the second time, the comparator module 251 stores the value "2" to the RAM 224 to update the count value.

When the registration of the image data determined to be counterfeit has been updated, the controller 200 performs paper sheet return processing (ST50, FIGS. 11, 12, 15, and 22). In the return processing, the controller 200 first performs the conveyance path release processing (ST51 in FIG. 22 and ST100 to ST102 in FIG. 12). Next, the controller 200 engages the feed roller pairs (14A, 14B) and drives the motor 13 for the bill conveyance mechanism to rotate reversely to convey the paper sheet held at the escrow position toward the bill slot 5 (ST52 and ST53 in FIG. 22). When the insertion detection sensor 7 detects the trailing end of the paper sheet being returned toward the bill slot 5, the controller 200 stops the reverse rotation of the motor 13 for the bill conveyance mechanism and drives the roller lifting motor 70 to disengage the feed roller pair (14A, 14B) currently pinching the paper sheet (ST54 to ST56). Thereafter, the controller 200 performs conveyance path closure processing (ST57, ST130 to ST132 in FIG. 15) and drives the presser plate driving motor 20 to rotate forward by a predetermined amount (ST58) to move the presser plate 115 at the initial position to the standby position. The return processing is completed with this operation.

The controller 200 also performs paper sheet return processing (ST50 in FIG. 11, FIG. 22) after updating the registration of the image data in the case where the image data of the inserted paper sheet is not identical to the last image data in the image data comparison processing at the process step ST42 in FIG. 21.

In the paper sheet processing apparatus 1 configured as above, a paper sheet inserted from the bill slot 5 is first identified as a bill or a paper sheet with a barcode printed thereon by the identification module 232. In accordance with the result of the identification, the light emission controller or the light emission control circuit 260 selects the resolution of the line sensor, and then the bill or the paper sheet with a barcode is verified. If the paper sheet is not determined to be genuine in the verification, the image data acquired by the line sensor at the time of the insertion is compared with the image data acquired at the last time of insertion of a paper sheet into the paper sheet processing apparatus 1 by the comparator module 251 to determine whether these images are identical. If the comparator module 251 determines that the images are identical, the counter 252 counts the number of times of matching of this image data, compares the count value with a specified value. If the count value is greater than the specified value, the paper sheet is determined to be counterfeit. That is to say, when a paper sheet not determined to be genuine in verification is inserted repeatedly, it can be determined that the operator is committing a wrongdoing by inserting the counterfeit many times for the purpose of aiming at erroneous verification.

The present embodiment is not limited to the above-described example and discloses examples as follows.

(1) In the above-described example, the controller 200 sends a detection signal to a host apparatus when the number of times of detection of the identical image data becomes three or more at the process step ST45 in FIG. 21 but the threshold is not limited to three. That is to say, the threshold to send a detection signal can be set to a different number as appropriate as far as the number is three or more.

Alternatively, the process steps ST44 and ST45 may be omitted and the report processing at ST46 to send a detection signal may be performed at ST43 if the image data of the inserted paper sheet is identical to the image data of the last-inserted paper sheet.

(2) In the above-described example, the image data comparison unit 250 sends a detection signal sent from the comparator module 251 to the counter 252 after comparing the image data of a paper sheet inserted in the paper sheet processing apparatus 1 with the image data of a last-inserted paper sheet and if the former image data is identical to the latter. However, whether to count the number of times of detection at the counter 252 can be determined depending on when identical image data is detected. That is to say, in the case where identical image data is detected intermittently, the detection is not counted if the time interval is long.

Figure 20:
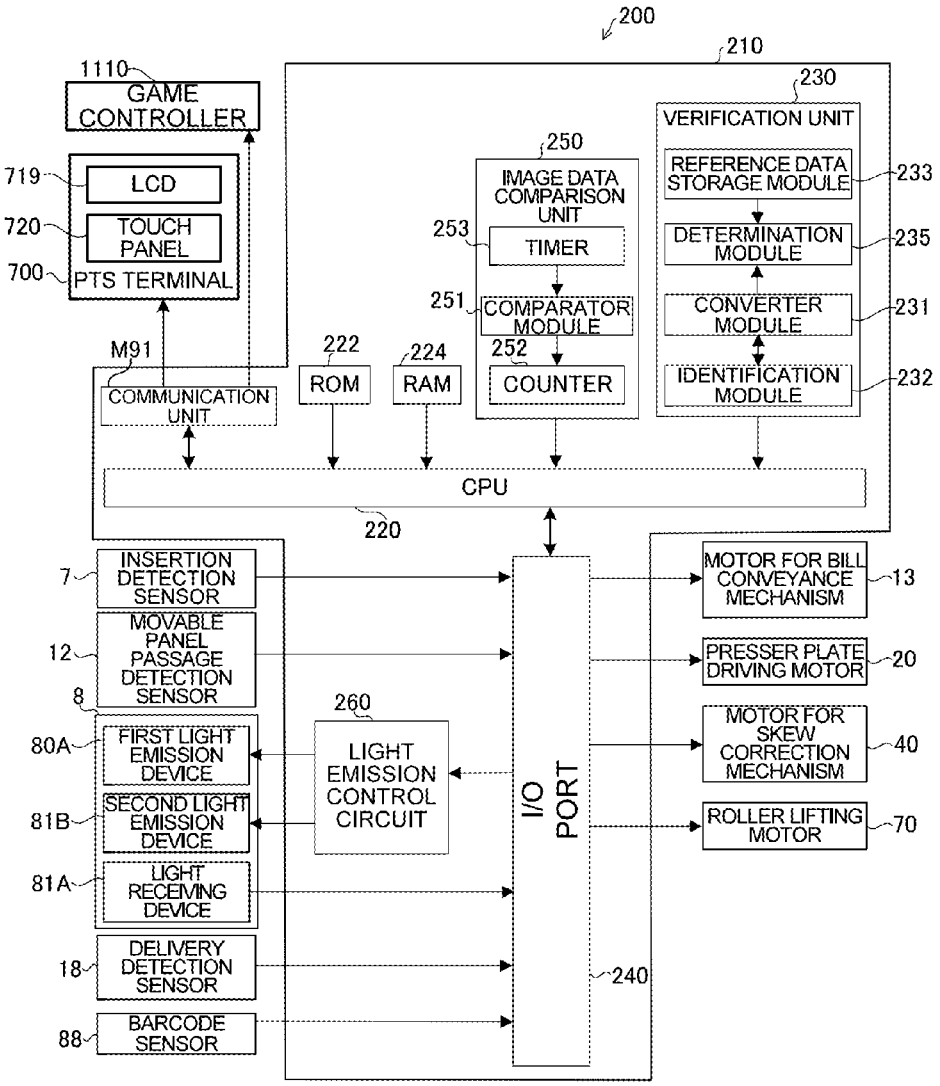
FIG. 20 is a block diagram for illustrating another configuration of a controller for controlling the driving of the components such as a bill conveyance mechanism and a bill reader in the first embodiment.

For example, in the block diagram of FIG. 20 showing a configuration of the controller 200, the image data comparison unit 250 is provided with a timer 253. This timer 253 enables the following processing. Hereinafter, detailed description of the same process steps (ST41 to ST45 in FIG. 21) in the processing of the image data comparison unit 250 is omitted and different process steps will be described in detail.

Figure 23:
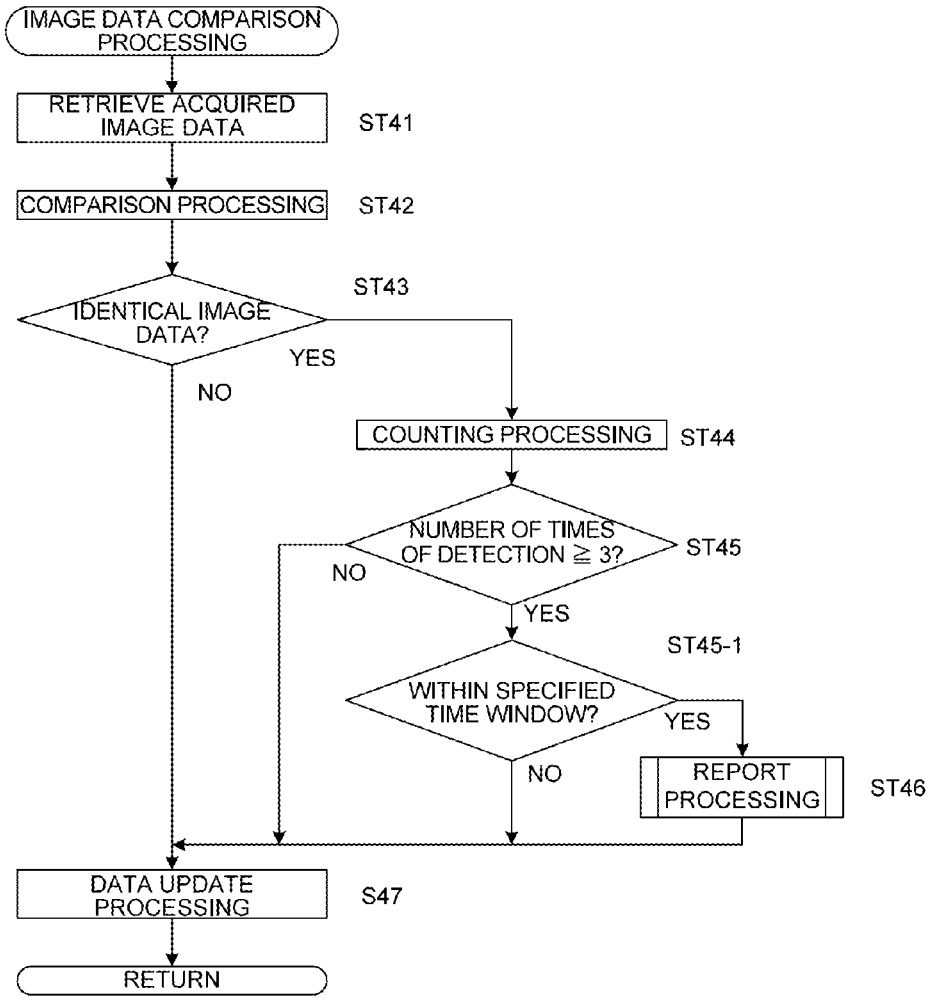
FIG. 23 is a flowchart of image data comparison processing in a paper sheet processing apparatus in a modification of the first embodiment.

As illustrated in FIG. 23, the image data comparison unit 250 performs process steps ST41 to ST45. Subsequent to the comparison processing of the number of times of detection of the identical image data (ST45), if the identical image data is detected within a specified time window counted by the timer 253 (ST45-1: YES), the image data comparison unit 250 fixes the detection signal count value of the counter 252. In the case where the paper sheet processing apparatus 1 ejects a bill determined to be counterfeit in verification processing with a message of "Code 0XX: SYSTEM ERROR", which is not the actual error description of "MULTIPLE TIMES OF READING OF COUNTERFEIT BILL" as shown in FIG. 27, on the display device for the supplier, the supplier is likely to insert the same paper sheet again (for the second time) to check whether the same system error occurs again. The supplier may also try to solve the system error in the third insertion. For example, the supplier may insert the same counterfeit paper sheet three times, or insert another counterfeit paper sheet or a genuine paper sheet at the third insertion and then inserts the counterfeit bill that has caused the system error again (for the third time) into the paper sheet processing apparatus 1. That is to say, it is unlikely that a paper sheet rejected by the paper sheet processing apparatus 1 because of a system error be supplied by the same supplier once again or twice again after passage of a long time (several tens of hours or several days) from the rejection of the paper sheet. Accordingly, the time window until successive or intermittent detection of the same image data can be specified in advance as, for example ten minutes, and the image data comparison unit 250 starts the timer when new image data determined to be counterfeit is registered. If the identical image data is detected for three times when the timer is operating (ST45-1: YES), the image data comparison unit 250 performs report processing to send a detection signal to the host apparatus (ST46). After the report processing, the image data comparison unit 250 updates the number of times of detection (ST47), like the foregoing example.

Alternatively, the comparator module 251 records the time of first detection of image data to the RAM 224 and when the same image data is detected for the third time, the comparator module 251 retrieves the recorded time and the time of the current detection to calculate the difference with the arithmetic operation function of the comparator module 251 or the CPU 220. In specifying the time window, the time windows from the first detection to the second detection and from the second detection to the third detection can be specified separately.

The above-described configuration improves the accuracy in detection of a counterfeit paper sheet that is likely to be inserted successively within a short time by specifying a short time window for detecting identical image data (for example, several ten minutes within one hour) and excluding a long time window of several to several tens of hours.

(3) Next, an overall configuration to send a report signal from the paper sheet processing apparatus 1 in the first embodiment to a host apparatus is described. The present embodiment describes a paper sheet processing system capable of paper sheet processing in a game system including a multiplayer participation type gaming machine configured with a plurality of slot machines each including the paper sheet processing apparatus 1 by way of example.

Overall Configuration of Game System

First of all, a general configuration of a game system 350 including a gaming machine is described.

Figure 24:
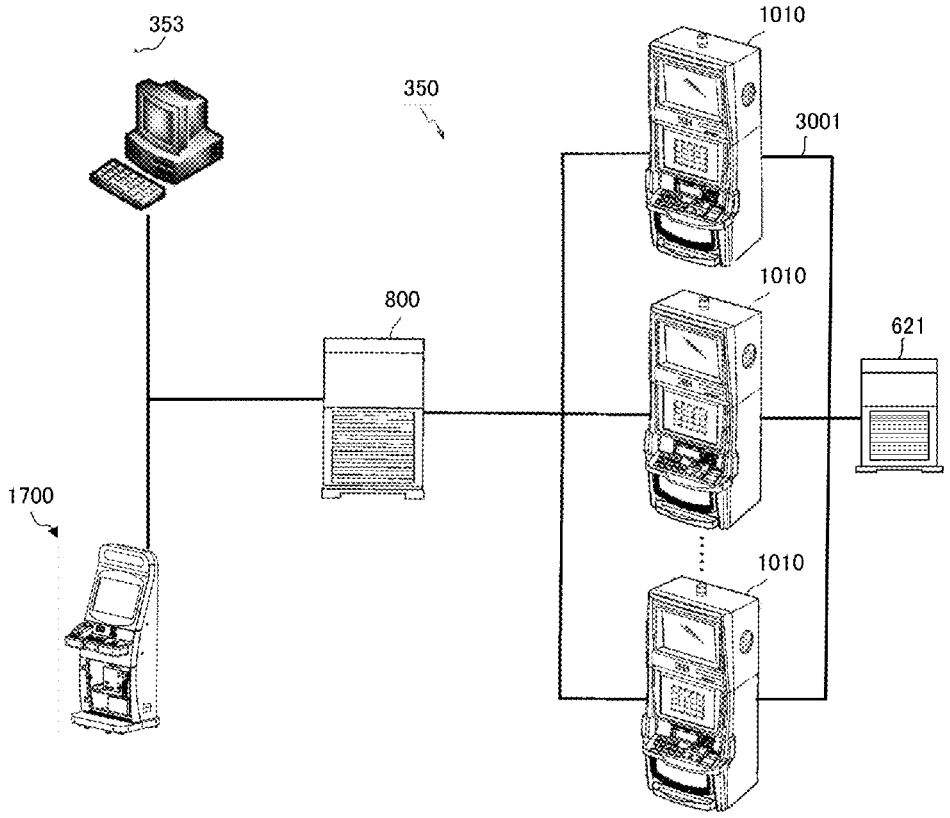
FIG. 24 is a diagram for illustrating an overall game system including a gaming machine.

As illustrated in FIG. 24, the game system 350 includes a plurality of slot machines 1010 and an external control apparatus 621 connected with the slot machines 1010 via a communication line 3001. In a casino hall where the game system is constructed, a kiosk terminal 1700, which is an information display apparatus to be used to announce start of a bonus game to be described later, countdown for the start of the bonus game, a winning ranking of the day, a popular machine ranking, and other information, is connected with a management server 800 (such as a bonus server and a membership management server) of the game system 350 via a network. The specific configurations of the apparatuses in the game system are described later.

Verification Processing

Figure 9:
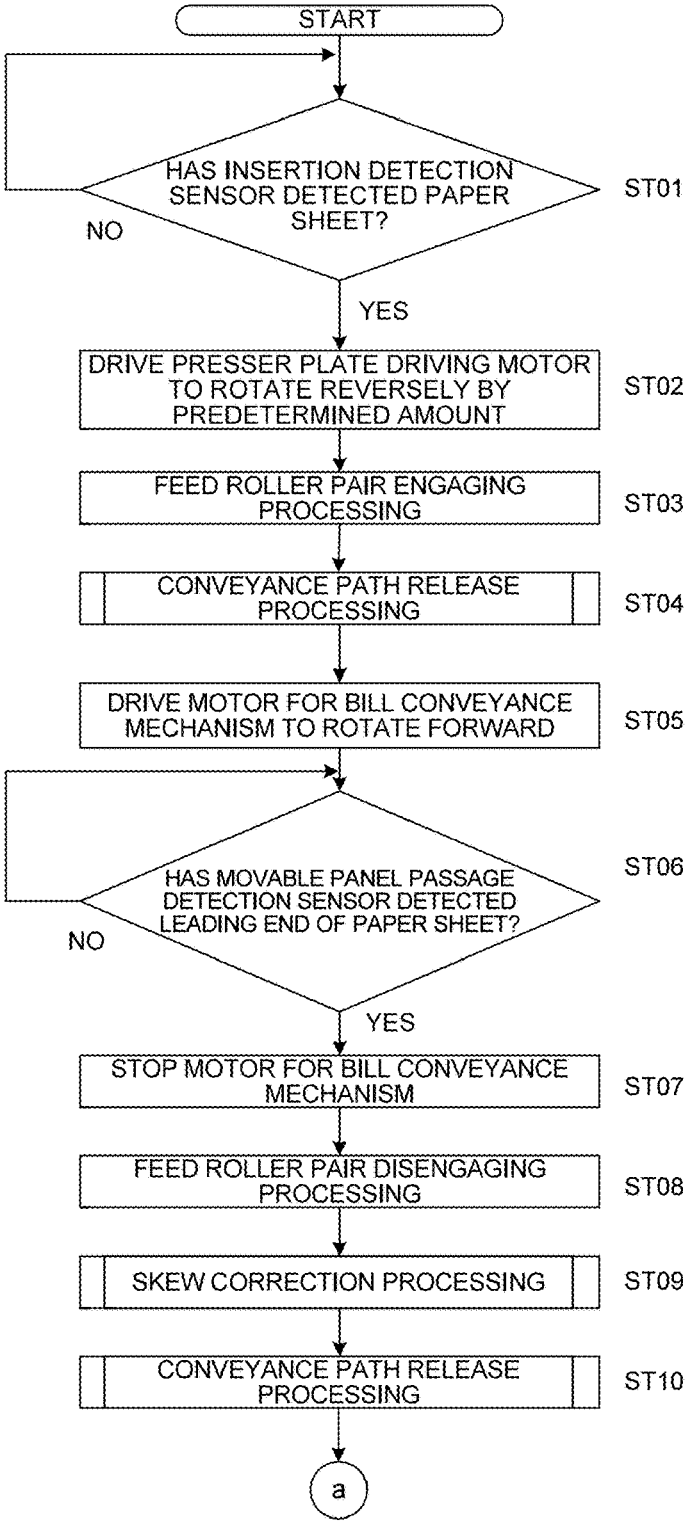
FIG. 9 is a flowchart of processing a paper sheet in the paper sheet processing apparatus in the present embodiment.
Figure 49:
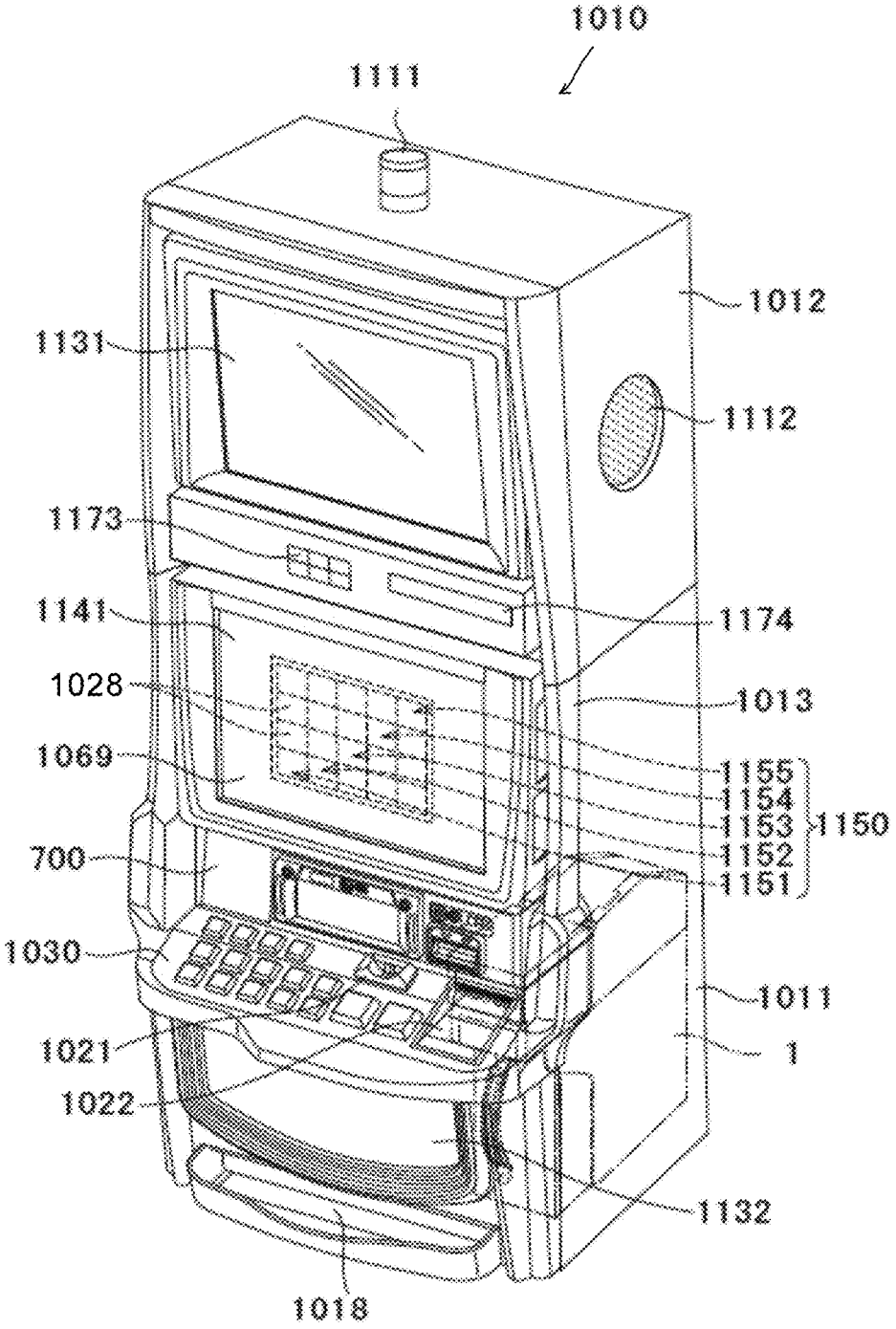
FIG. 49 is a perspective view of a slot machine in the gaming machine.

When a supplier playing slot games with a slot machine 1010 shown in FIG. 49 adds some credits using a bill at process step ST01 in the flowchart of FIG. 9, the supplier puts a bill in a bill entry 1022 and the bill is fed to the paper sheet processing apparatus 1 through a slot 1022A. Since the slot 1022A is connected to the bill slot 5 of the paper sheet processing apparatus 1, the inserted bill is forwarded to the inside of the paper sheet processing apparatus. The paper sheet processing apparatus 1 performs processing including conveyance processing and verification processing from the process steps ST01 to ST23 in FIGS. 9 to 11.

Image Data Comparison Processing

If the bill is determined to be counterfeit in the verification, the image data comparison unit 250 performs processing of the process steps ST40 to ST45 in FIG. 21. That is to say, the image data comparison unit 250 compares the image data acquired from the bill with the image data acquired immediately before the current determination and if the result of the comparison indicates the identical image has been detected three times, the paper sheet processing apparatus 1 sends a detection signal to the management server 800. The threshold for the number of times of detection can be specified by the operator as appropriate.

Report Processing

The management server 800 that has received the detection signal from the paper sheet processing apparatus 1 creates an error display command (signal) in accordance with this detection signal and sends the command to the PTS terminal 700 of the slot machine 1010 that has sent the detection signal and the management apparatus 353. In this event, the management server 800 creates an error display command A for the PTS terminal 700 and an error display command B for the management apparatus 353 differently. That is to say, the management server 800 sends an error display command of an error different from the detected error to the PTS terminal 700. The management server 800 may send another different error display command to the kiosk terminal 1700 so that the staff can become aware of the error through the kiosk terminal 1700. The PTS terminal 700 corresponds to a management apparatus for storing the information on the bill read by the bill reader 8 and the image data of the supplier's face and sending them to the management server 800.

The management server 800 compares the image data sent together with the detection signal through the PTS terminal 700 and the game controller 1100 with the image data registered in the dictionary data of a plurality of kinds of circulating counterfeit bills stored in the ROM of the management server 800. If the dictionary data includes image data identical to the received image data, the management server 800 creates different error display commands A and B including the registration code and sends the commands to the apparatuses.

The PTS terminal 700, the management apparatus 353, and the kiosk terminal 1700 store an error display table to display a message on the display device upon receipt of an error display command, in a storage device such as the ROM. As shown in FIG. 27, the error display table may include codes, messages for the PTS terminal, and messages for the management apparatus. The code may be a numerical value or a combination of an alphabet and a numerical value.

The code is identical to the counterfeit bill code registered in the dictionary data on counterfeit bills in the management server 800.

Since the messages for the PTS terminal are displayed on an LCD 719 of the PTS terminal 700 to notify the supplier of the error at bill insertion, the messages for the PTS terminal are changed to common messages such as "SYSTEM ERROR" and "PAPER JAM" which are different from the detected error so as to prevent the supplier from becoming aware that the message is about detection of a counterfeit bill and running away. Since the present embodiment is about the case where a counterfeit bill has been inserted to the paper sheet processing apparatus 1 for a plurality of times, the PTS terminal 700 selects the code 0XX in FIG. 27 and displays this code 0XX and the description "SYSTEM ERROR" shown in FIG. 27 on the LCD 719. The LCD 719 is a touch panel and the LCD 719 also displays a CALL button 739 on the lower right thereof for the supplier to page a staff member.

As shown in FIG. 27, the messages for the management apparatus listed in the error display table specifically indicate use of a counterfeit bill so that the administrator of the casino hall can recognize it. For example, the display device of the management apparatus 353 shows the kind of the counterfeit bill in circulation, such as "COUNTERFEIT BILL A" or "COUNTERFEIT BILL B", or a description "NEW KIND" in the case where an unregistered new counterfeit bill is detected as described above. Furthermore, when a counterfeit bill is inserted for a plurality of times, the display device shows "MULTIPLE TIMES OF READING OF COUNTERFEIT BILL".

Upon receipt of an error display command B from the management server 800, the management apparatus 353 displays an alert indicating an occurrence of an error on the display device. The error display command B may be sent in the form of an e-mail by the management server 800. In response to this event, the administrator can display a floor map 1800 of the entire casino hall registered in the management server 800 on the display device (see FIG. 62) by accessing the management server 800 through operation of the management apparatus 353. Furthermore, as shown in FIG. 63, the administrator can zoom up the place where the error occurs to check the specific place by operating the floor map 1800 of the entire casino hall on the screen.

For example, the enlarged floor map 1810 shows a plurality of islands each including a plurality of (twelve) slot machines 1010. The hatched blocks 1812 represent operative slot machines 1010 and white blocks 1811 represent inoperative slot machines 1010. Further, the black block 1813 represents the slot machine 1010 where the error occurs. The manner of indication of the statuses of operative, inoperative, and error is not limited to this example and can be changed to indication in different colors or indication including a code, a symbol, and/or a text.

It should be noted that the kiosk terminal 1700 is also configured to display the floor map 1800 to show the place of error occurrence.

Further, the management server 800 can be configured to update a database stored in a storage device in response to receipt of an error detection signal so that the administrator can check the details of the error on the management apparatus 353. For example, the management server 800 holds a database including fields of the date, the time, the code, the kind of the counterfeit bill, the terminal, the place, the machine model, and remarks, regarding the occurrence of the error. The management apparatus 353 can display such detailed information on the display device in the format shown in FIG. 29 by accessing the management server 800.

After the management server 800 sends a report signal to the host apparatuses such as the PTS terminal 700, the management apparatus 353, and the kiosk terminal 1700, the paper sheet processing apparatus 1 updates the count value of the image data determined in the verification processing to be counterfeit (ST47). That is to say, the number of times of detection is updated to three. If no image data identical to the image data used in the verification is found, the paper sheet processing apparatus 1 newly registers the image data and stores the count value "1" to the RAM 224. If the image data is determined to be a match and the detection is the second time, the paper sheet processing apparatus 1 stores the value "2 to the RAM 224 to update the count value.

Figure 22:
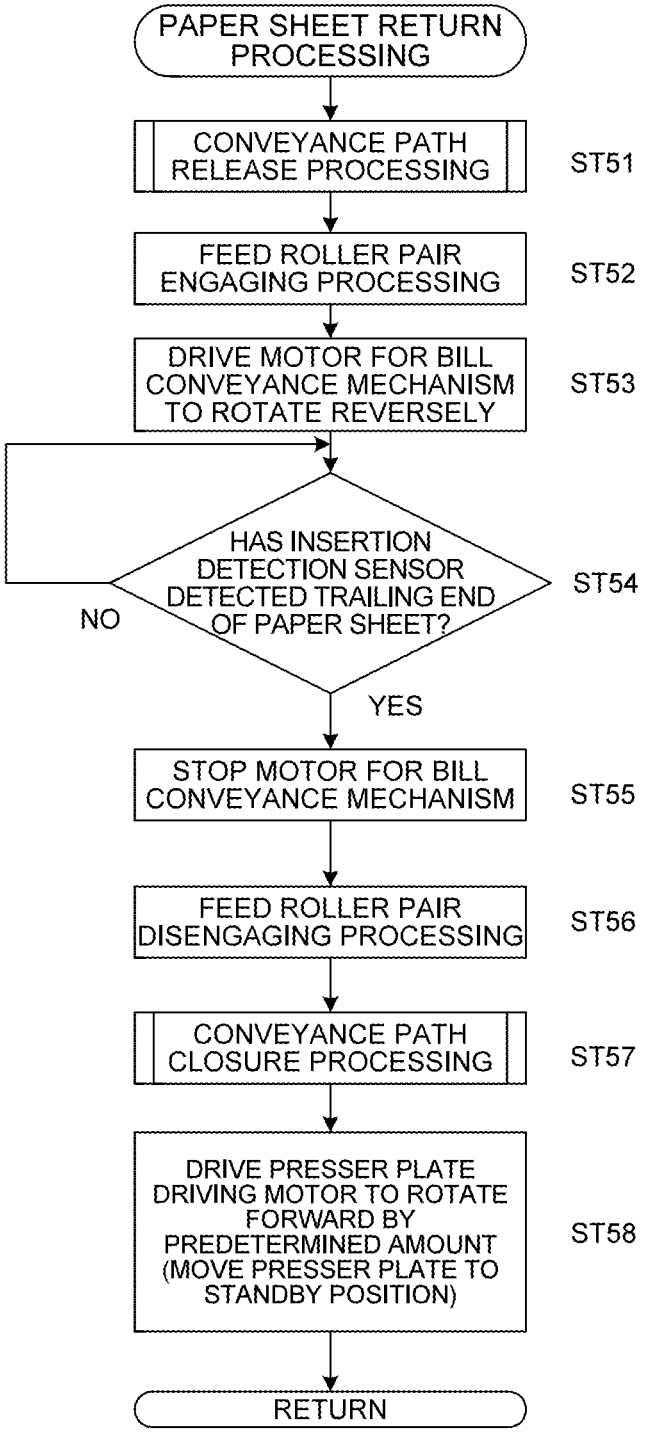
FIG. 22 is a flowchart of paper sheet return processing.

When the registration of the image data determined to be counterfeit has been updated, the paper sheet processing apparatus 1 performs paper sheet return processing (ST50 in FIG. 11, FIG. 22). In the paper sheet return processing, the paper sheet processing apparatus 1 performs the conveyance path release processing (ST100 to ST102 in FIG. 12), engages the feed roller pairs (14A, 14B), and drives the motor 13 for the bill conveyance mechanism to rotate reversely to convey the bill held at the escrow position toward the bill slot 5 (ST52, ST53). When the insertion detection sensor 7 detects the trailing end of the bill being returned toward the bill slot 5, the paper sheet processing apparatus 1 stops the reverse rotation of the motor 13 for the bill conveyance mechanism and drives the roller lifting motor 70 to disengage the feed roller pair (14A, 14B) currently pinching the bill (ST54 to ST56). Thereafter, the paper sheet processing apparatus 1 performs conveyance path closure processing (ST57, ST130 to ST132 in FIG. 15) and drives the presser plate driving motor 20 to rotate forward by a predetermined amount (ST58) to move the presser plate 115 at the initial position to the standby position to complete a series of processing.

The paper sheet processing apparatus 1 also updates the registration of the image data (ST47) and performs paper sheet return processing (ST50 in FIG. 11, FIG. 22) in the case where the last image data is not identical to the image data of the inserted bill in the image data comparison processing shown in FIGS. 21 and 23 (ST43: NO).

In the above-described configuration of the present embodiment, when the image data comparison unit 250 detects the identical image data for three times or more in image data comparison processing, an error display command is sent from the management server 800 to the host apparatuses such as the PTS terminal 700 included in the slot machine 1010 that has issued the detection signal, and the management apparatus 353 and the kiosk terminal 1700 externally connected with the slot machine 1010 via the management server 800. However, the error display command for the PTS terminal 700 is an error display command A different from the commands for the management apparatus 353 and the kiosk terminal 1700. That is to say, the error message displayed on the LCD 719 of the PTS terminal 700 is associated with a common error which is irrelevant to counterfeit bills; accordingly, the supplier who sees the error message touches the CALL button displayed on the LCD 719 of the PTS terminal 700 and pages the administrator to remove the error without any doubt that the administrator might be aware that the supplier has used a counterfeit bill, although the administrator actually is. Accordingly, the administrator can directly check the bill and the supplier at the site where the counterfeit bill or the paper sheet suspicious to be a counterfeit bill has been used.

The present embodiment is not limited to the above-described example and discloses another example as follows.

The paper sheet processing apparatus 1 can be configured to send information for identifying the supplier of a counterfeit bill to the management server 800 together with a detection signal in accordance with determination in verification that the inserted bill is counterfeit.

Figure 30:
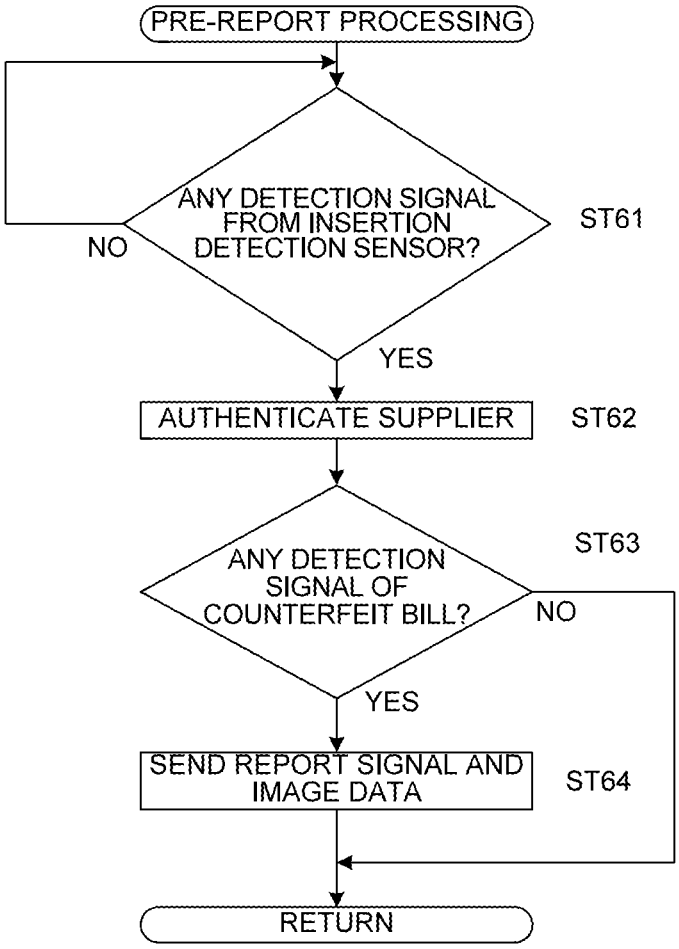
FIG. 30 is a flowchart of pre-report processing in a series of report processing in image data comparison processing in a modification of the first embodiment.
Figure 31:
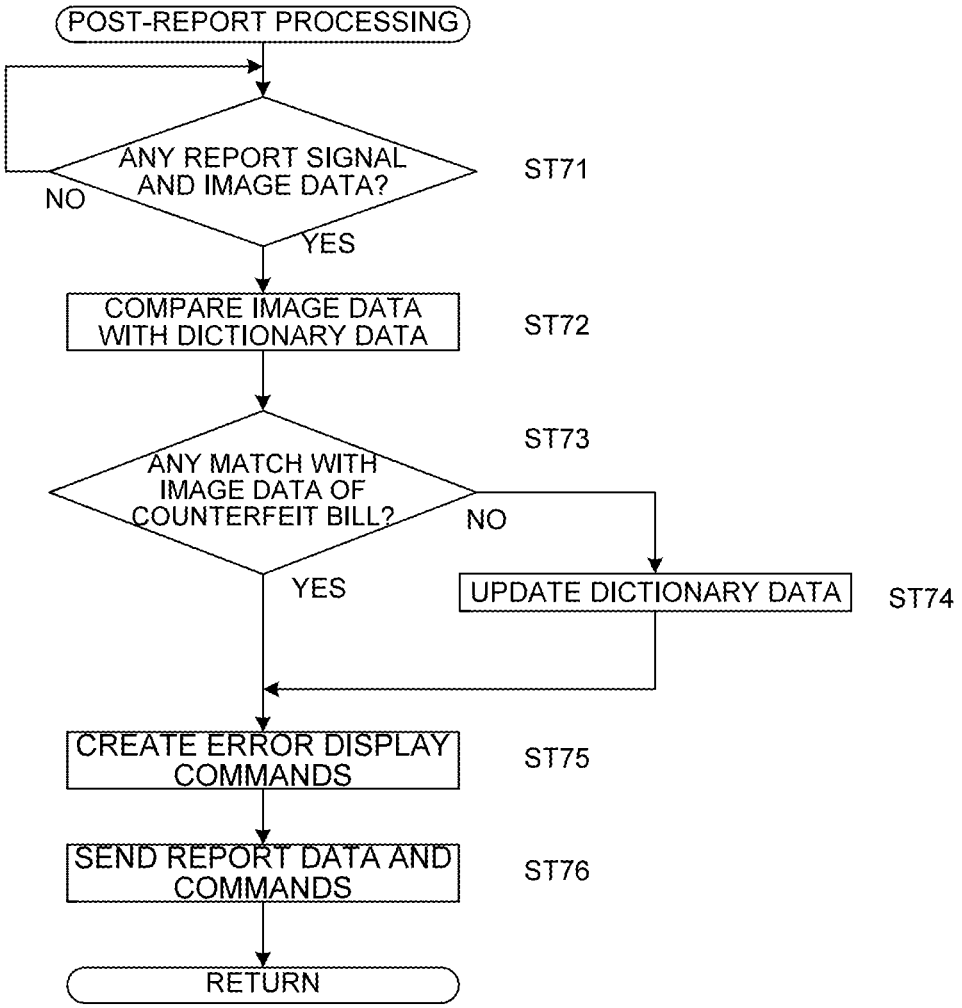
FIG. 31 is a flowchart of post-report processing in a series of report processing in image data comparison processing in the modification of the first embodiment.
Figure 32:
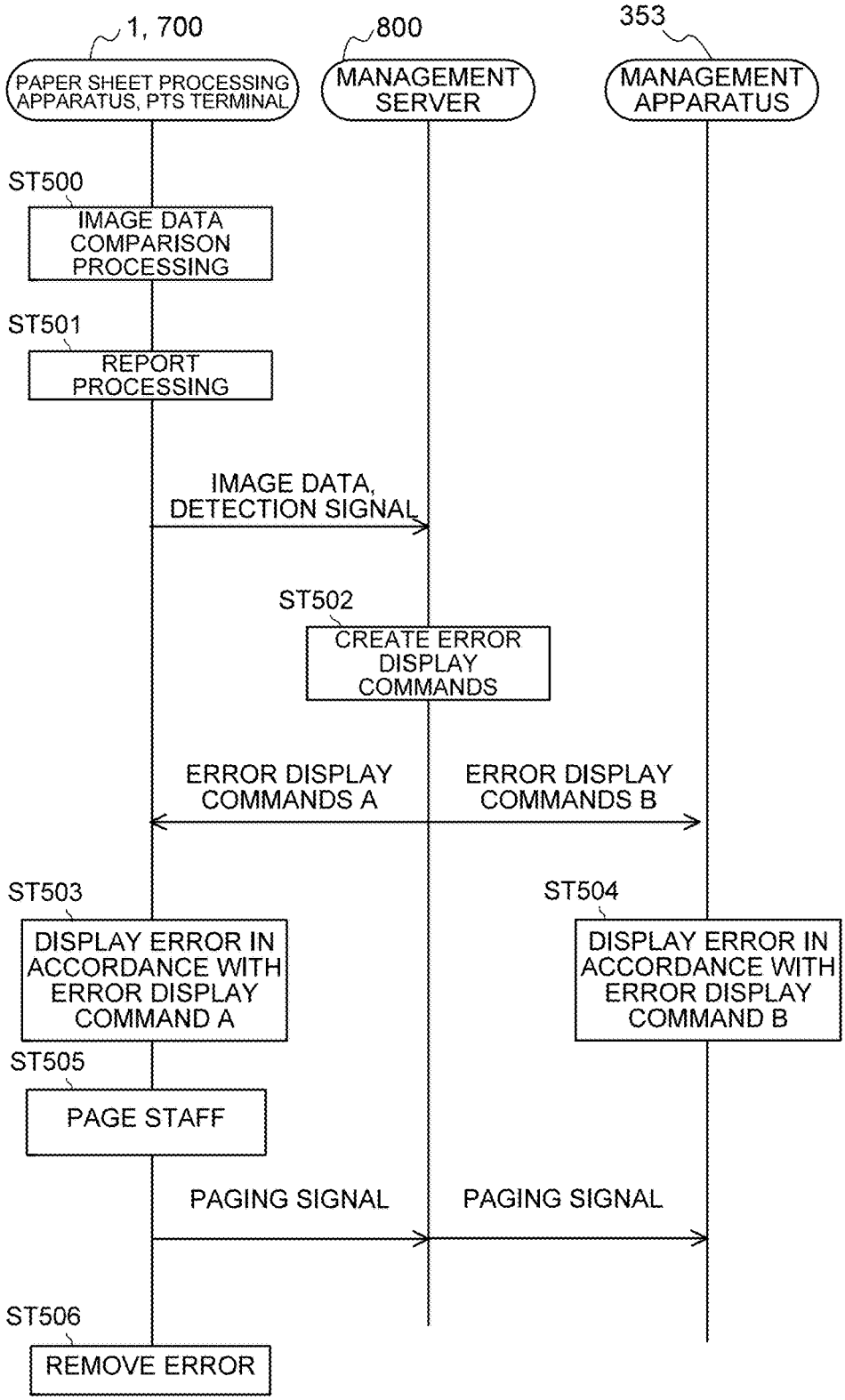
FIG. 32 is a schematic diagram for illustrating flows of the signals issued in the processing from bill insertion processing until the report processing in a game system.

The processing in this configuration is described in detail along the flowcharts of FIGS. 9 to 11, 30, and 31, and the flows of signals illustrated in FIG. 32. The process flow in the paper sheet processing apparatus 1 is different in the process step ST01 in FIG. 9 and the report processing in the subroutine C. Accordingly, description of the same process steps (ST02 to ST32) is omitted and the different process steps are described in detail. FIG. 30 is a flowchart of pre-report processing to be performed in the paper sheet processing apparatus in the present example; FIG. 31 is a flowchart of post-report processing to be performed in the management server; and FIG. 32 is a schematic diagram for illustrating flows of signals issued in the processing from the bill insertion processing until the report processing in the game system.

Image Data Comparison Processing

First, image data comparison processing (ST500) in FIG. 32 is performed. The specific image data comparison processing corresponds to process steps ST01 to ST23 in FIG. 9. When a supplier playing slot games is going to add some credits by a bill, the bill is put in a bill entry 1022 and the bill is fed to the paper sheet processing apparatus 1 through a slot 1022A. Since the slot 1022A is connected to the bill slot 5 of the paper sheet processing apparatus 1, the inserted paper sheet is detected by the insertion detection sensor 7 when the bill is passing through the bill slot 5 (ST01). Thereafter, the paper sheet processing apparatus 1 performs process steps ST02 to ST23. During this processing, the scan data (image data) acquired by scanning the bill with the line sensor in the bill reader 8 and the detection signal from the insertion detection sensor 7 are sent to the PTS terminal 700.

Report Processing

Next, report processing (ST501) in FIG. 32 is performed. This report processing consists of pre-report processing and post-report processing described hereinafter.

Pre-Report Processing

The report processing (ST501) in FIG. 32, particularly the pre-report processing performed in the PTS terminal 700, is described with reference to the flowchart of FIG. 30. The PTS terminal 700 monitors whether a detection signal issued in response to detection of insertion of a bill at the insertion detection sensor 7 has been received (ST61: NO). As soon as the PTS terminal 700 receives a detection signal from the paper sheet processing apparatus 1 (ST61: YES), the CPU 731 of the PTS terminal 700 sends an activation command to a human detection camera controller 722. The human detection camera controller 722 that has received the activation command activates and controls human detection cameras 712 and 713 to take images of the supplier in such a manner that supplier's face is included satisfactorily to identify the supplier (ST62). The captured identification image is temporarily stored in a predetermined area of a RAM 732.

After acquiring the identification image, the PTS terminal 700 stands by until receiving the next detection signal. That is to say, if the PTS terminal 700 does not receive the detection signal issued based on the determination that the inserted bill is counterfeit obtained in the verification processing and the image data comparison processing in the paper sheet processing apparatus 1 (ST63: NO), the PTS terminal 700 terminates the processing. If the PTS terminal 700 receives the detection signal sent as a result of determination on counterfeit bill (ST63: YES), the PTS terminal 700 forwards the detection signal and image data to the management server 800. The image data to be sent at this process step includes the image data acquired by scanning the bill and the identification image data of the supplier. The series of processing in the PTS terminal 700 is completed with this operation.

Post-Report Processing

Next, the post-report processing in the management server 800 that has received the detection signal and image data sent from the PTS terminal 700 is described in detail with reference to the flowchart of FIG. 31. The management server 800 corresponds to the control unit of the present invention for counting the number of matches of image data, counting the time window for detecting identical image data, and making determination on a counterfeit bill.

The management server 800 monitors whether the management server 800 has received a detection signal and image data (scan data of a bill and identification image data) from the PTS terminal 700 (ST71: NO). If the management server 800 has received a detection signal and image data (ST71: YES), the management server 800 performs comparison processing on the received image data of a bill with the registered image data in the dictionary data of counterfeit bills stored in a storage such as a ROM (ST72). This dictionary data includes image data of a plurality of kinds of counterfeit bills in circulation.

If identical image data is found as a result of the comparison processing of the image data of the bill and the registered image data (ST73: YES), the management server 800 creates a plurality of error display commands A and B including the registration code of the counterfeit bill in the dictionary data (ST75, ST502 in FIG. 32) and sends the commands to the PTS terminal 700 and the management apparatus 353 (ST76). The management server 800 may send the identification image data together with the error display command B to the management apparatus 353. In the present example, the management server 800 sends an error display command C to the kiosk terminal 1700; however, this is optional and the management server 800 can employ a configuration not to send an error display command to the kiosk terminal 1700.

If no identical image data is found as a result of the comparison processing of the image data of the bill and the registered image data (ST73: NO), the management server 800 updates the dictionary data (ST74). This update processing automatically records predetermined items provided in the database of the dictionary data, such as the code, the date and time of detection, and the image data. Since the counterfeit bill is of a new kind, the record may be altered by the administrator as appropriate, for example, by adding a code name.

Upon completion of updating the registration of the dictionary data, the management server 800 creates error display commands A and B (ST75, ST502 in FIG. 32) and sends the commands to the PTS terminal 700 and the management apparatus 353. Like the processing described above, the management server 800 may send the identification image data together with the error display command B to the management apparatus 353. The management server 800 can employ a configuration not to send an error display command C to the kiosk terminal 1700.

The PTS terminal 700 that has received the error display command A and the kiosk terminal 1700 that has received the error display command C display the above-described error messages on their display devices (ST503 in FIG. 32).

Figure 33:
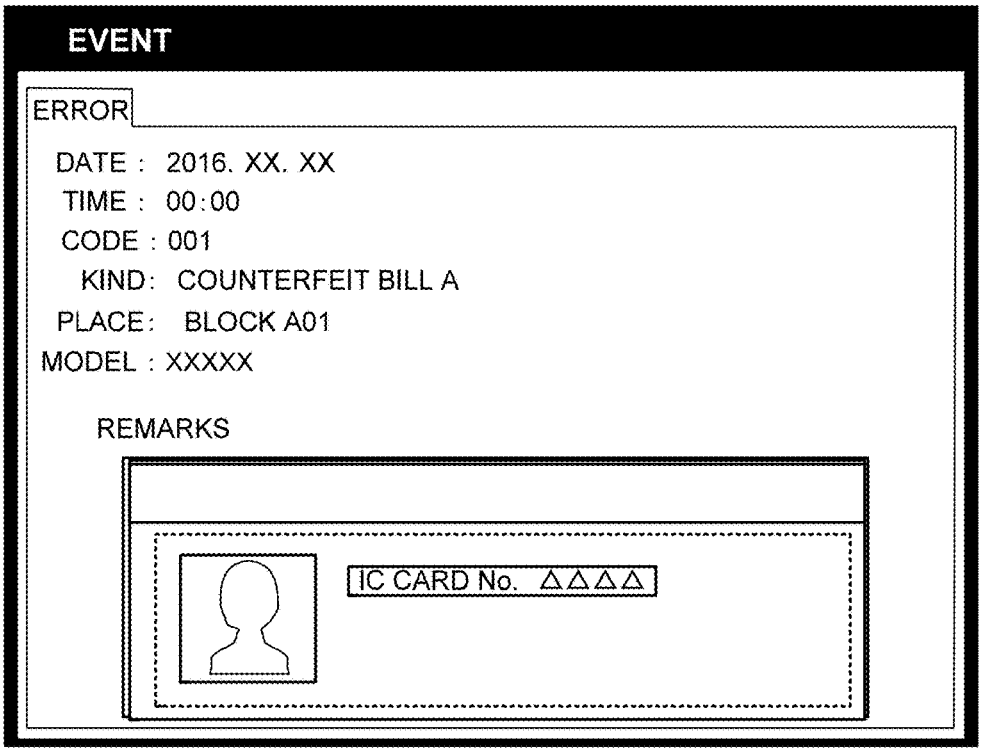
FIG. 33 is a diagram of an error message with an identification image displayed on a display device of a management apparatus in a modified example.

Like the foregoing apparatuses, the management apparatus 353 also displays information on the counterfeit bill in the window shown in FIG. 29 on its display device (ST504 in FIG. 32). In the case where the identification image data is sent from the management server 800, the management apparatus 353 may include the identification image of the supplier's face in the field of remarks and display the information as shown in FIG. 33. A series of report processing is completed with this operation. Since an error is displayed on the PTS terminal 700, the player pages a staff member and has the staff member remove the error (ST506 in FIG. 32).

In this configuration, when a new kind of counterfeit bill or a bill suspected to be a counterfeit bill not registered in the dictionary data of counterfeit bills is detected, the identification image data of the supplier is sent from the PTS terminal 700 to the management apparatus 353 via the management server 800 together with a detection signal. The administrator can identify the person who inserted the counterfeit bill or the paper sheet suspected to be a counterfeit bill through the error display screen displayed on the management apparatus 353 based on the error display command sent from the management server 800. Furthermore, the dictionary data of counterfeit bills stored in the management server 800 is updated in response to detection of a new kind of counterfeit bill; accordingly, the new kind of counterfeit bill can be detected thereafter, which helps to prevent the new kind of counterfeit bill not yet in circulation from being used.

Next, report processing when a bill fed to the paper sheet processing apparatus 1 in one of the slot machines 1010 included in the above-described game system is determined to be counterfeit is described with reference to FIGS. 9 to 11 and FIG. 23. The paper sheet processing apparatus 1 included in the slot machine 1010 has the same configuration as the paper sheet processing apparatus 1 described in the above-described embodiment; accordingly, description of the same process steps (ST1 to ST32) is omitted and the different process steps are described in detail. That is to say, the process flow c continuing from the process flow b in FIG. 11 is mainly described in detail with reference to the flowchart of FIG. 23 and FIG. 32.

Second Embodiment

The present embodiment is configured to hold an inserted bill within the paper sheet processing apparatus 1 after the bill is determined to be counterfeit in the verification in the above-described embodiment.

The present embodiment is the same as the above-described embodiment in the process steps ST01 to ST22 in FIGS. 9 and 10; accordingly, description of the same process steps is omitted as appropriate and the different process steps are described.

Figure 34:
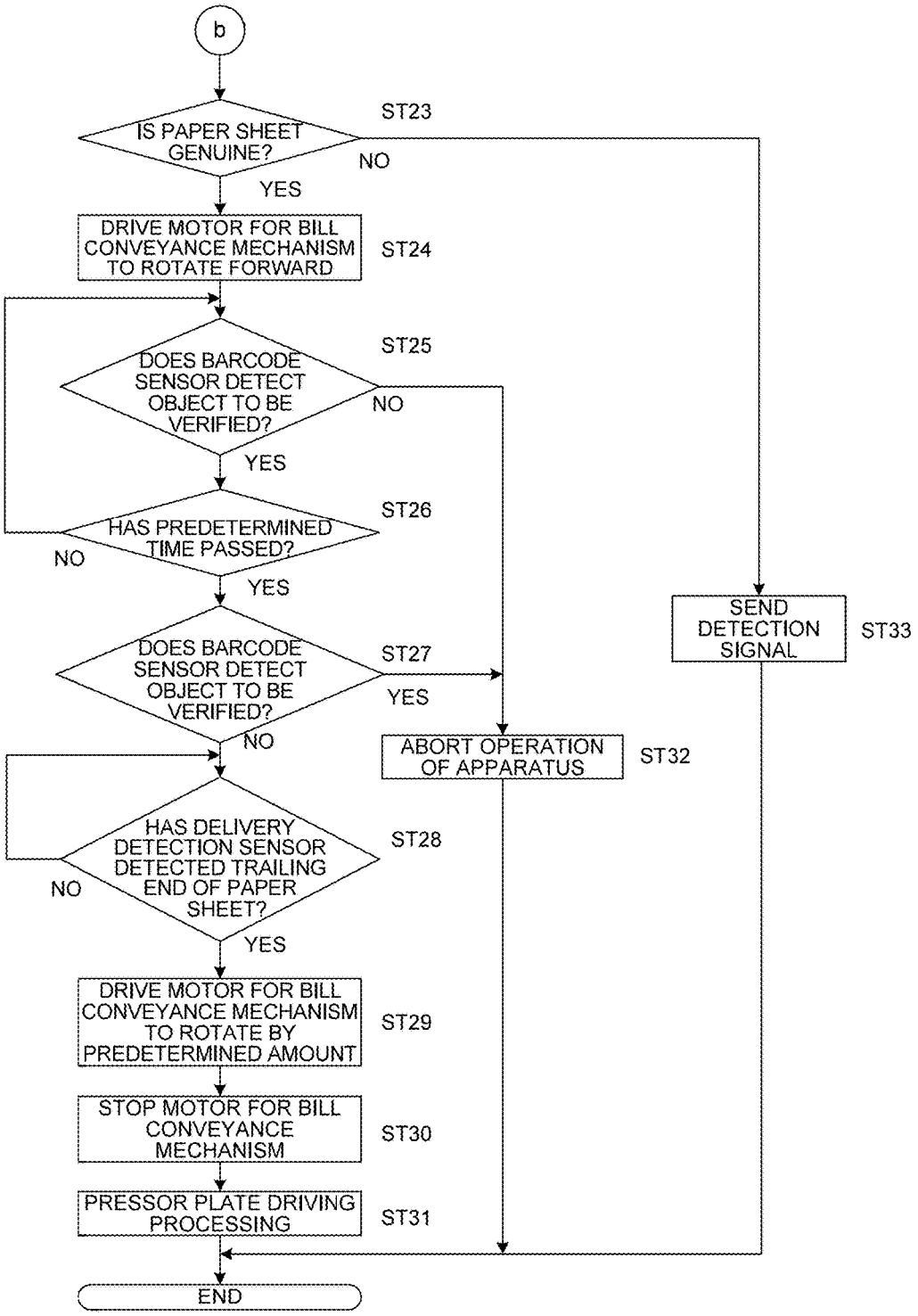
FIG. 34 is a flowchart of processing to hold a counterfeit bill inside the paper sheet processing apparatus in the second embodiment.

At process step ST21 in FIG. 10, the controller 200 temporarily stops conveying the bill and subsequently performs verification processing at process step ST22. If the bill is determined to be counterfeit in the verification (ST23 in FIG. 34: NO), the controller 200 sends a detection signal indicating the determination of a counterfeit from the PTS terminal 700 to the management server 800 (ST33 in FIG. 34) while suspending (holding) the bill on the conveyance path 3.

Upon receipt of the detection signal, the management server 800 sends an error display command to the PTS terminal 700 of the paper sheet processing apparatus 1 that has sent the detection signal. This error display command is to display an error different from the result of the verification, for example a system error, on the LCD 719 of the PTS terminal 700.

Figure 28:
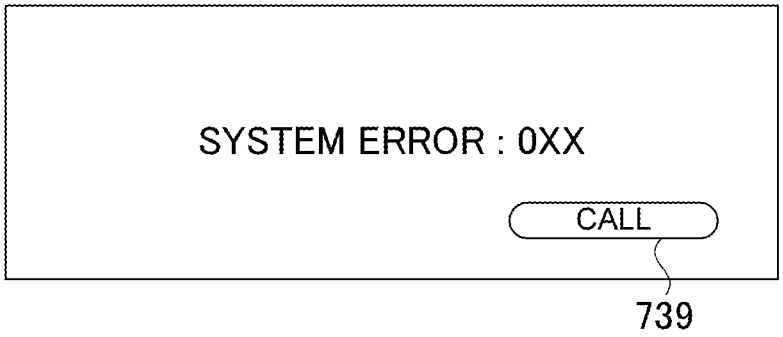
FIG. 28 is a diagram showing an error displayed on an LCD of a PTS terminal.

The LCD 719 of the PTS terminal 700 that has received the error display command displays a system error, while the use of the slot machine 1010 is suspended. The player touches the CALL button 739 displayed on the screen of the LCD 719 shown in FIG. 28 to page a staff member to have the system error removed. The system error is removed by the staff member through collecting the bill held in the paper sheet processing apparatus 1.

This configuration enables the staff member (administrator) to examine the bill determined to be counterfeit in detail by providing a genuine bill to the supplier before collecting the bill held in the paper sheet processing apparatus 1 in view of the work time to take out the bill from the paper sheet processing apparatus 1.

In this configuration, the PTS terminal 700 may send the image data of the bill determined to be counterfeit to the management server 800 to perform comparison processing with the image data of a plurality of kinds of bills stored in the storage of the management server 800. The image data stored in the storage is image data of the bills supplied prior to the bill determined to be counterfeit. If identical image is found in the comparison processing, the management server 800 may send an error display command to show an error different from the result of comparison to the PTS terminal 700 of the sender of the detection signal to display a system error different from the result of comparison on the LCD 719 and make the paper sheet processing apparatus 1 keep the bill inside (the conveyance path 3) thereof.

The second embodiment may be configured to put the bill determined in the verification processing (ST22) to be counterfeit in the bill holder 100 of the paper sheet processing apparatus 1 before the staff member collects the bill from the bill holder 100. For example, the controller 200 performs the processing as follows.

Figure 35:
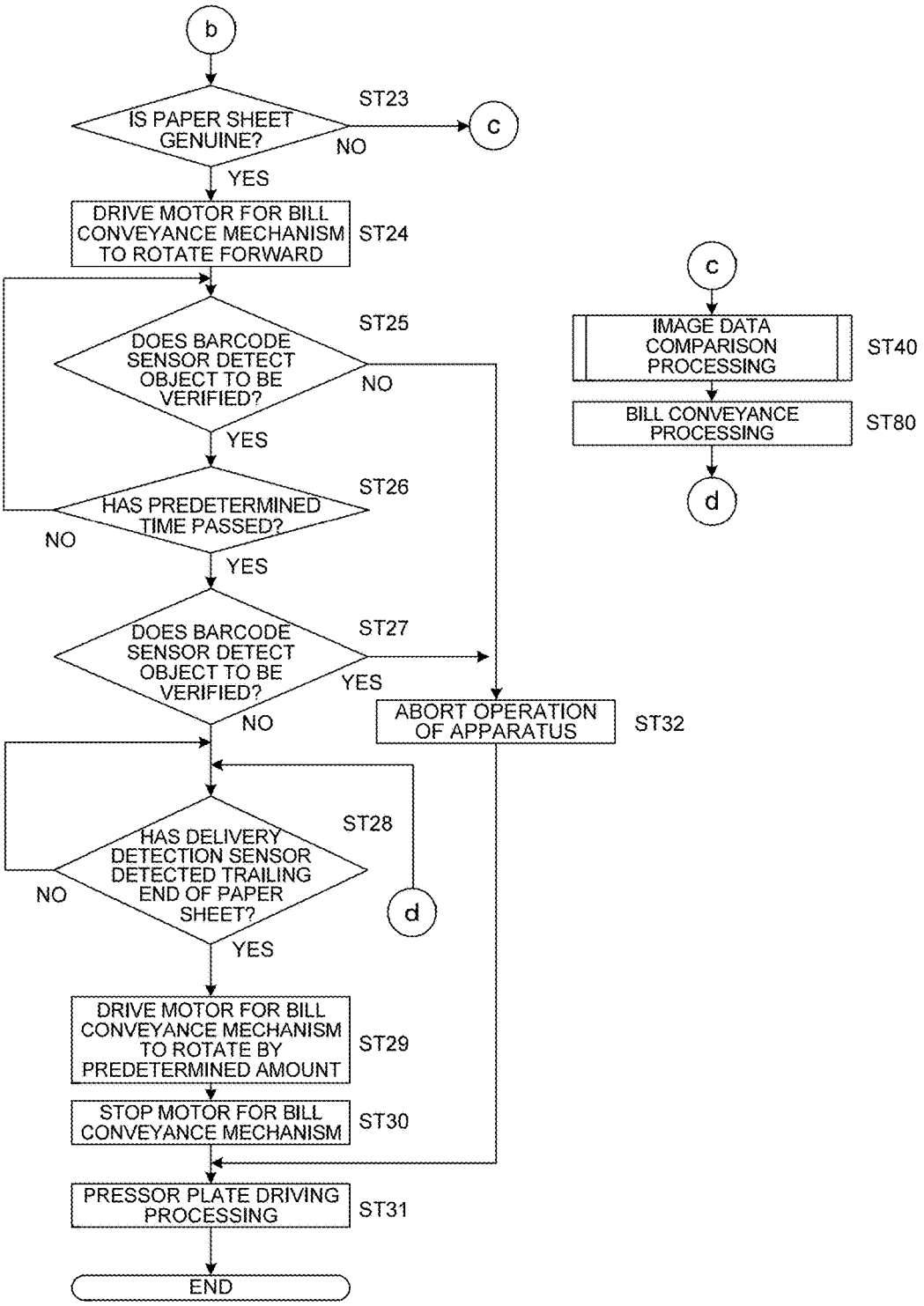
FIG. 35 is a flowchart of processing to hold a counterfeit bill inside the paper sheet processing apparatus in a modification of the second embodiment.

This example is the same as the above-described example in the processing from the insertion of a bill until the image data comparison processing shown in FIGS. 9 to 11, and FIG. 21 or FIG. 23; accordingly, different process steps are described in detail. As illustrated in FIG. 35, this example performs bill conveyance processing (ST80) after the image data comparison processing (ST40).

If the image data of the inserted bill is determined to be identical to the previous image data in the image data comparison processing and further, if this detection is the third time, the controller 200 executes the report processing (ST46 in FIG. 21) and the data update processing (ST47), and then, executes bill conveyance processing to convey the bill to the bill holder 100 (ST80 in FIG. 35). At process step ST80, the controller 200 deactivates the sensors, performs the processing of process steps ST25 to ST27 for conveying a genuine bill, and proceeds to process step ST28. That is to say, when the motor for the bill conveyance mechanism is being driven to rotate forward to convey the bill to the inside, the barcode sensor 88 is turned OFF.

After entering the process step ST28, the controller 200 drives the motor 13 for the bill conveyance mechanism to rotate forward until the delivery detection sensor 18 detects the trailing end of the bill. The controller 200 further drives the motor 13 for the bill conveyance mechanism to rotate forward by a predetermined amount after the delivery detection sensor 18 detects the trailing end of the bill (ST29, ST30).

The predetermined amount in this forward rotation of the motor 13 for the bill conveyance mechanism at ST29 and ST30 corresponds to the driving amount with which the bill is forwarded from the delivery slit 3A provided downstream of the bill conveyance path 3 in the apparatus main body 2 to the receiving slit 103 of the bill holder 100 and further, stably guided to the pressing standby space 108 by the pair of belts 150 on both sides. That is to say, further rotating forward the motor 13 for the bill conveyance mechanism by the predetermined amount after the delivery detection sensor 18 detects the trailing end of the bill drives the pair of belts 150 in contact with the bill in the feeding direction to stably guide the bill to the pressing standby space 108.

After stopping the motor 13 for the bill conveyance mechanism, the controller 200 drives the presser plate 115 to place the bill on the holder plate 105 (ST31). After completion of the pressing, the controller 200 moves back the presser plate 115 and stops the presser plate 115 at the standby position. That is to say, the counterfeit bill or the bill suspected to be a counterfeit bill is collected to the bill holder 100.

It should be noted that, when the motor 13 for the bill conveyance mechanism is rotating forward and the delivery detection sensor 18 detects the trailing end of a bill, a detection signal of the delivery detection sensor 18 is sent to the RAM 224 and the number of times of detection is counted, even if a detection signal of identical image data is not sent. That is to say, the number of bills put in the bill holder 100 is counted. This count value is sent to the management server 800 through the PTS terminal 700 and the game controller; the management server 800 monitors whether the bills collected to the bill holder 100 need to be processed (whether the bill holder 100 is full).

When the management server 800 receives this count value subsequent to a detection signal sent from the paper sheet processing apparatus 1 when the image data comparison processing on a bill results in the third time of detection of the identical image data, the management server 800 sets a flag to ON. That is to say, the counterfeit bill can be located among the bills collected in the bill holder 100.

With this operation, a series of processing to keep (collect) a counterfeit bill or a bill suspicious to be a counterfeit bill in the paper sheet processing apparatus 1 is completed. Although this example is configured to collect the counterfeit bill to the bill holder 100; the bill can be collected by a staff member paged by the supplier through a touch operation on the CALL button 739 in the case where an error message is displayed on the LCD 719 of the PTS terminal 700. For the staff member to collect the bill, the paper sheet processing apparatus 1 needs to be taken out from the slot machine 1010. In view of the circumstances such as taking a long time, the staff member may provide a replacement genuine bill to the supplier and thereafter, collect the bill from the paper sheet processing apparatus 1.

In this configuration, when a bill is determined to be counterfeit in verification processing but no identical bill image data is found, the bill is suspected to be a new kind of counterfeit bill; accordingly, the bill is kept within the paper sheet processing apparatus 1. That is to say, this configuration encourages the administrator to provide a replacement genuine bill to the supplier and collect the bill suspicious to be a new kind of counterfeit bill from the paper sheet processing apparatus 1, so that the bill can be examined in detail.

If the collected bill is a new kind of wrong paper sheet (counterfeit bill), image data to be reference data is created based on discriminable points to identify this new kind of wrong paper sheet. This reference data is newly registered in the dictionary data stored in the storage device of the management server 800 and the ROM 222 of the paper sheet processing apparatus 1 to improve the accuracy in determination of the wrong paper sheet after the update.

Third Embodiment

The present embodiment describes an example of a paper sheet processing system that is capable of locating, about every bill collected to the bill holders 100 of all slot machines in a hall, the place of collection of the bill based on a serial number printed on the bill and further, capable of tracking to serial number. The bill holder 100 corresponds to the holder unit for holding paper sheets in the present invention. The serial number in the present invention is, in the case of a bill, the serial number uniquely assigned to the bill among the bills of the same kind and, in the case of a paper sheet with a barcode including information having a monetary value, the serial number uniquely assigned and included in the barcode at the issuance of the barcode. The present embodiment describes the case where the present invention has been applied to bills.

After a bill is inserted through the bill slot of the paper sheet processing apparatus 1, the bill reader 8 acquires image data of the bill before the bill is put in the bill holder 100. When the bill is determined to be genuine by the verification unit 230 through verification using the image data, the verification unit 230 acquires information on the bill, such as the kind of the bill and the serial number, from the image data. This information on the bill is stored to the storage unit 104 by the reader/writer 142 in the paper sheet processing apparatus 1. Further, the information on the bill stored in the storage unit 104 is sent from the paper sheet processing apparatus 1 to the management server 800 together with an administrative identification number (hereinafter, also referred to as ID) registered uniquely to the bill holder 100.

The management server 800 stores the ID of the bill holder 100 and the information on the bill to the storage such as a RAM or a hard disk.

Figure 62:
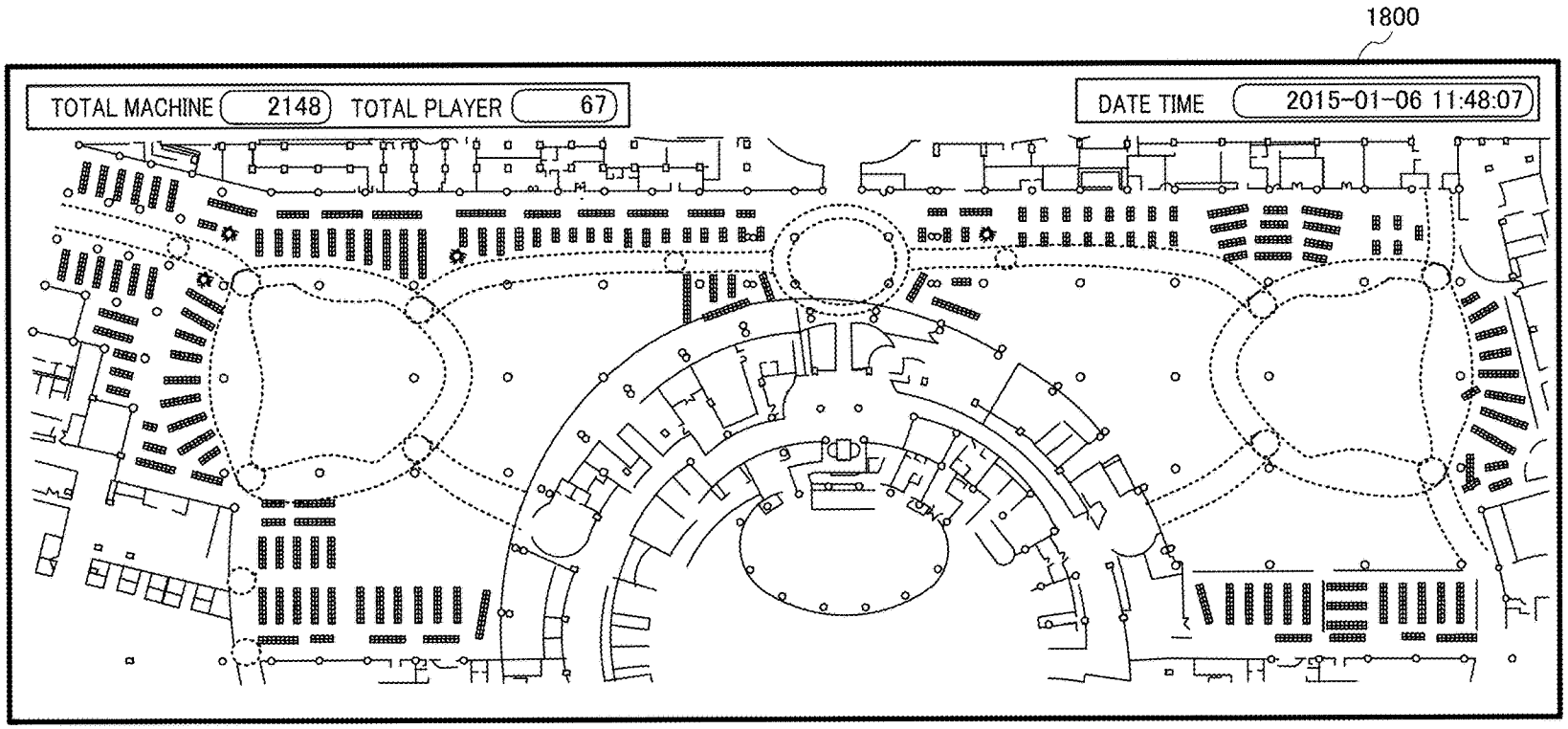
FIG. 62 is a diagram showing a state where an entire floor map of a casino hall is displayed on a display device.
Figure 63:
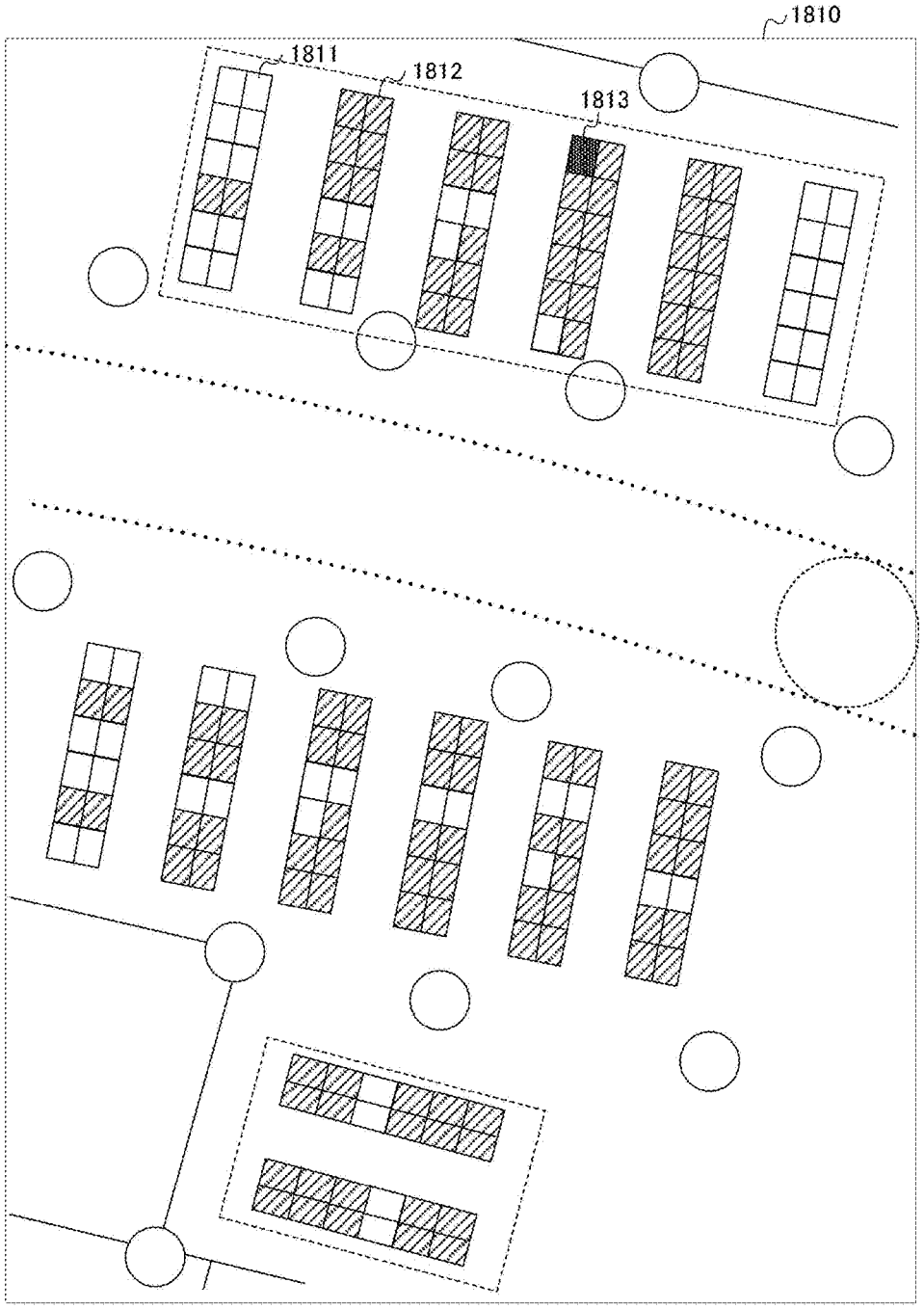
FIG. 63 is a diagram showing a state where a part of the floor map is enlarged.

The management server 800 has map data of the floor map 1800 of the entire casino hall shown in FIG. 62 in the storage. In the map data, the IDs of the bill holders 100 included in the slot machines 1010 are associated with the layout of the slot machines 1010 in the hall. That is to say, the administrator can check the positions of the slot machines 1010 and the IDs of the bill holders 100 on the floor map 1800. The floor map is configured to show a selected part of the floor in an enlarged manner on the display device as shown in FIG. 63. Since the map data includes the IDs of the bill holders 100 in the slot machines 1010 associated with the positions the slot machines 1010, the management server 800 associates these IDs in the map data with the IDs included in the database in the storage.

As described above, each paper sheet processing apparatus 1 sends information on a bill including a serial number together with the administrative identification number assigned to the bill holder 100 to the management server 800 and the management server 800 stores the information to its storage with the administrative identification number; as a result of this processing, the place of collecting a bill to a bill holder 100 can be located on the floor map data, based on the serial number of the bill.

In the case where the paper sheet processing system in the present embodiment is applied to a casino, the person having a possibility to commit a wrongdoing is the player or the staff member. Bill holders 100 are usually placed near the dealers at casino tables and collected by collectors as appropriate; accordingly, which bill holder 100 installed at which place on the floor has collected the bill is important information to find a wrongdoer.

Meanwhile, there is a possibility that a genuine bill is replaced with a counterfeit bill. Such a case can be addressed by monitoring the storage units 104 to detect that a bill supposed to be in a bill holder 100 is not in the bill holder 100 and locating the place where the bill holder 100 holding the replaced bill had been installed. Tracing the movement of the bill holder 100 with the record of surveillance cameras may contribute to identifying the wrongdoer or the site of the wrongdoing.

The database is created by recording information such as the date and time of insertion, the kind of the bill, the serial number, and the ID each time the management server 800 receives information on a bill. Accordingly, the administrator can display and check the information in the database on the display device of the management apparatus 353 as shown in FIG. 61 by accessing the database from the management apparatus 353.

Accordingly, the above-described configuration enables a bill put in a slot machine 1010 to be located through its serial number associated with the ID of a bill holder 100 by displaying the floor map or the database stored in the management server 800 on the display device of a host apparatus, or the management apparatus 353. In other words, since the management server 800 manages all the bills held in a plurality of bill holders 100 by serial number, replacement of a genuine bill with a counterfeit bill after the genuine bill is put in the bill holder 100 can be detected. This cannot be detected by managing the bills only by the kind of bill. When a wrongdoing is committed such that a genuine bill in a bill holder 100 is replaced with a counterfeit bill of the same kind, the existing apparatus or system might let the bill go into circulation after bills in the bill holder are collected. However, the present embodiment can prevent the counterfeit bill from going into circulation. Specifically, the serial numbers of the bills held in the bill holder 100 are read again in aggregation in the management server 800. If a wrongdoing is committed such that a genuine bill inserted from the bill slot into the bill holder 100 has been replaced with a counterfeit bill, the management server 800 detects discrepancy between the serial number at the time of insertion and the serial number at the time of aggregation. Accordingly, the management server 800 can determine that the bill having the serial number which does not exist at the time of insertion is likely to be a counterfeit bill.

The third embodiment is not limited to the above-described example but discloses examples as follows.

(1) The present embodiment is a configuration capable of detecting that a wrongdoer uses a bill acquired through a wrongdoing in playing games on a slot machine 1010 in a hall. Specifically, the above-described third embodiment can be arranged to be able to determine whether identical serial numbers exist.

Figure 38:
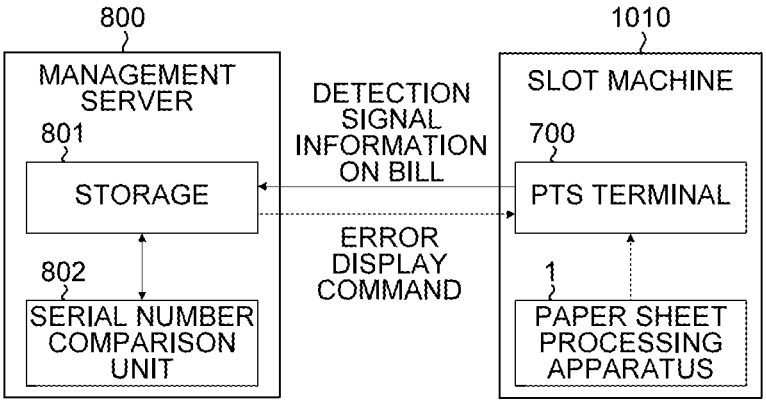
FIG. 38 is a block diagram for illustrating a configuration of a modification of the third embodiment.

For example, the management server 800 includes a storage 801 and a serial number comparison unit 802 as illustrated in FIG. 38. The configurations of these units are described in detail in the description of the processing of the paper sheet processing system. The serial number comparison unit 802 corresponds to the comparison unit for comparing serial numbers in the present invention. The storage 801 corresponds to the storage unit for storing serial numbers together with facial images of the suppliers in the present invention. The management server 800 corresponds to the control unit in the present invention.

The management server 800 stores information on each bill sent from the slot machines 1010 to the storage 801. This information on a bill includes the ID of the bill holder 100, the date and time of insertion of the bill, the kind of the bill, and the serial number. Each time the management server 800 receives and stores information on a bill, the management server 800 retrieves the serial numbers stored in the storage 801 to the serial number comparison unit 802 and compares the received serial number with them. If the identical serial number is detected as a result of the comparison, the management server 800 determines that the received bill is a wrong one.

This configuration enables determination that a bill held in a bill holder 100 is a bill maliciously taken out from a bill holder 100 of another slot machine because a bill having a serial number identical to the serial number of a bill stored in the other bill holder 100 is found from this bill holder 100. Furthermore, the management server 800 compares the serial numbers of the bills held in the other bill holder 100 with the serial numbers stored in the storage in collecting the bills and if a discrepancy is found, the administrator keeps the bill suspicious to be a counterfeit separately to prevent circulation of the bill.

(2) The present example describes a case where the management server 800 issues a report that a wrong bill has been detected in the above-described comparison in the foregoing example (1).

The management server 800 compares each serial number included in the information on bills sent from each slot machine 1010 with the serial numbers stored in the storage of the management server 800. If, as a result of the comparison, the management server 800 finds an identical serial number in the storage thereof, the management server 800 determines that the bill is a wrong bill and updates the database for managing detection of wrongdoings. For example, the database records the date and time of insertion, the kind of the bill, and the serial number as shown in FIG. 61 and can be accessed and seen from the management apparatus 353. The management server 800 creates map data for a floor map 1800 in which the slot machine 1010 where the wrong bill was used is marked as shown in FIG. 63. This map data can be HTML data, for example, and only the administrator is allowed to see the map image via the network. In the case where wrong use of bills having different serial numbers is found at a plurality of slot machines 1010, the map data may be created in such a manner that the bills are distinguishable, for example by using different marking colors depending on the serial number or by indicating the kinds of the bills.

Thereafter, the management server 800 sends a message reporting the wrong use of a bill to the management apparatus 353 in the form of an e-mail. The administrator or a staff member checks the message of the report and consult the database stored in the management server 800 through operating the management apparatus 353. The administrator can display a floor map on the display device through the URL included in the field of remarks in the database.

This configuration enables identification of the time and the place of use of a wrong bill. If bills having the same serial number are used on a plurality of machines, the management server 800 can apply the positional information and temporal information to the map data and connect the positions of the slot machines 1010 in time series to analyze the behavioral pattern.

(3) The present example describes a configuration of a paper sheet processing system that is capable of detecting a counterfeit bill that has been replaced by a wrongdoer with a bill held in a bill holder 100 of the paper sheet processing apparatus 1 mounted on a slot machine 1010.

Processing in Paper Sheet Processing System

Figure 37:
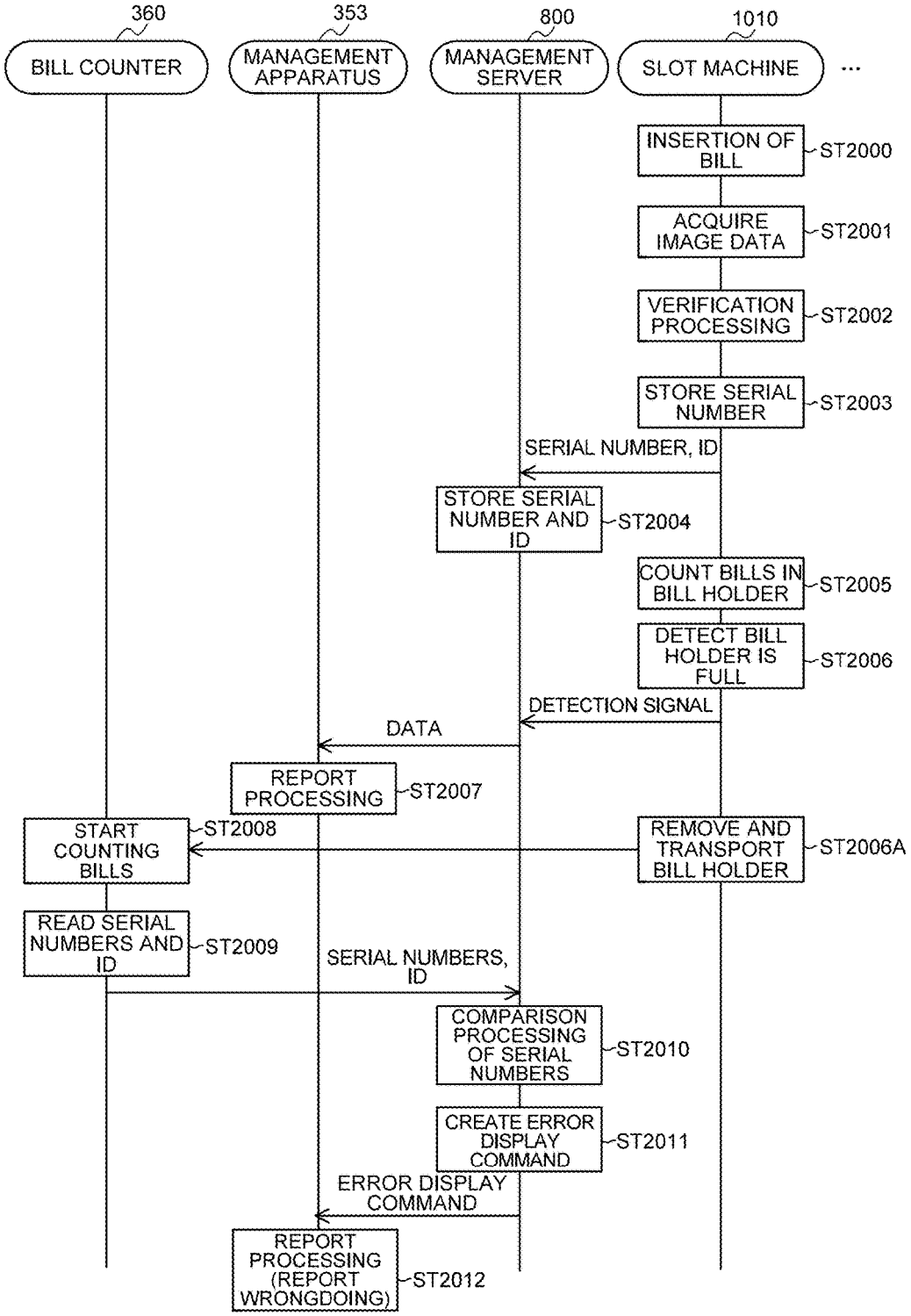
FIG. 37 is a flowchart for illustrating flows of processing and signals among apparatuses in a modification of the third embodiment.

Now, a paper sheet processing system is described in detail. FIG. 37 illustrates a process flow to detect, collect, and manage a counterfeit bill. In the following, description of the process steps same as those in the foregoing embodiments is omitted and the different points are described. Specifically, the data acquired by the paper sheet processing apparatus 1 and the processing in the management server 800 are different; accordingly, the flows of the signals and the data transmitted among the apparatuses are described in detail.

When a bill is inserted into the paper sheet processing apparatus 1 (ST2000), image data of the bill is acquired by the bill reader 8 (ST2001) before being put in the bill holder 100. If the bill is determined to be genuine through verification by the verification unit 230 (ST2002), information on the bill, such as the kind of the bill and the serial number, is acquired from the image data. This information on the bill is stored by the reader/writer 142 to the storage unit 104 (ST2003). The paper sheet processing apparatus 1 sends the information on the bill stored in the storage unit 104 to the management server 800 together with the administrative identification number (hereinafter, also referred to as ID) registered uniquely to the bill holder 100.

The management server 800 stores all the serial numbers associated with the ID of the bill holder 100 to the storage such as a RAM or a hard disk (ST2004).

Meanwhile, the paper sheet processing apparatus 1 counts the number of bills each time a bill is put in the bill holder 100 (ST2005). The paper sheet processing apparatus 1 compares the count value with a predetermined value specified as the capacity of the bill holder 100 and when the count value reaches the specified value (ST2006), the paper sheet processing apparatus 1 sends a detection signal to the management server 800. The management apparatus 353 displays relevant information on the display device based on the data in the management server 800.

The management apparatus 353 displays a message on the display device to urge the administrator to collect the paper sheet processing apparatus 1 filled with bills (ST2007). For example, the message may include positional information to locate the slot machine 1010 including the paper sheet processing apparatus 1, such as a floor map of the casino hall as shown in FIGS. 62 and 63.

Figure 36:
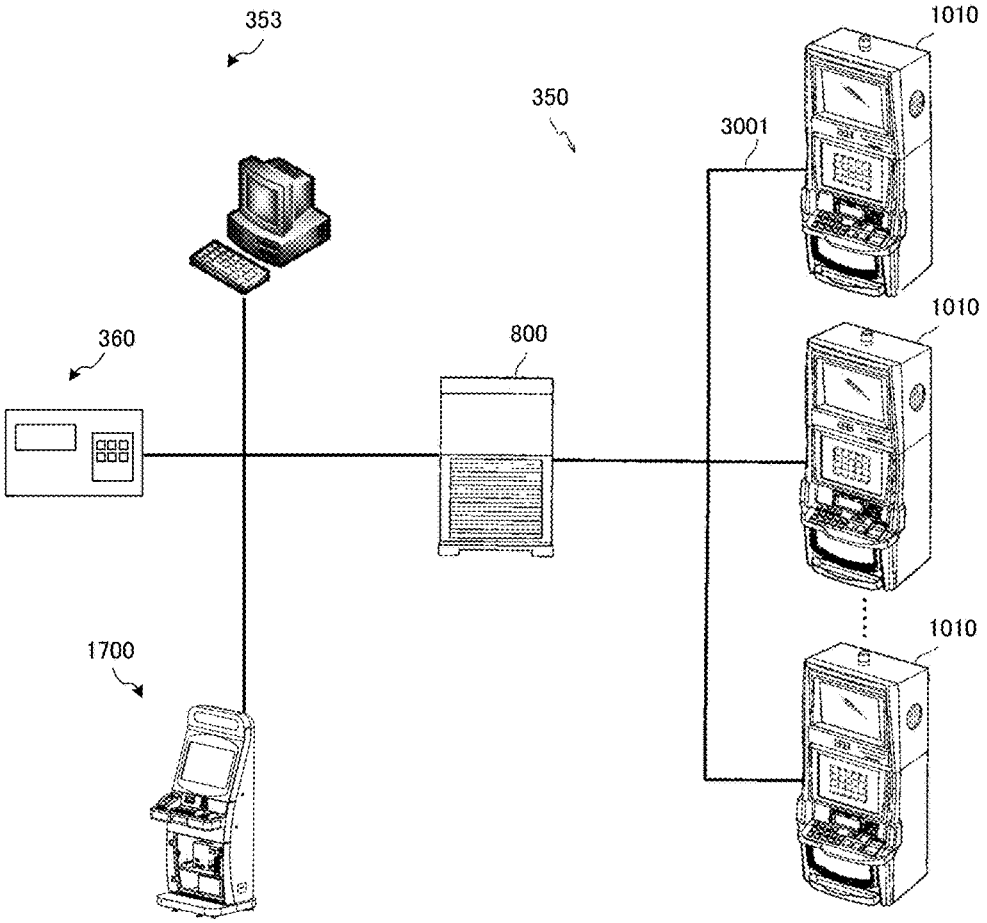
FIG. 36 is a diagram for illustrating an overall game system including a gaming machine.

A staff member who has accessed the notification message on the management apparatus 353 goes to the specified slot machine 1010 and collects the bill holder 100 (ST2008). The staff member makes a not-shown reader/writer in a bill counter 360 (see FIG. 36) read the ID of the storage unit 104, transfers the bills in the bill holder 100 to the bill counter 360, and makes the bill counter 360 count the bills. When the bills are being counted, the serial numbers of all the bills are read by the line sensor included in the bill counter 360 (ST2009). All the acquired serial numbers are associated with the acquired ID and sent to the management server 800.

The management server 800 retrieves the serial numbers associated with the ID identical to the ID sent from the bill counter 360 from the storage and compares the serial numbers (ST2010). If no discrepancy is detected as a result of the comparison, the management server 800 terminates the processing. If a discrepancy is detected or if an unidentifiable paper sheet other than a bill is detected, the management server 800 creates an error display command and sends it to the management apparatus 353 (ST2011). In sending the error display command, the management server 800 sends serial number checklist data of the result of the comparison together.

The management apparatus 353 that has received the error display command displays information indicating that the collected bills include a wrong bill on the display device (ST2012). The displayed information is an alert message or an alert message with the checklist including the serial numbers. The administrator or the staff member collects the discrepant wrong bill with reference to the checklist sent together with the alert message. With this operation, a series of processing is completed.

This configuration compares the serial numbers of the bills actually held in the bill holder 100 with the serial numbers stored in the storage unit 104 of the bill holder 100 when the bills are collected to the bill counter 360. If some discrepancy is found, the administrator collects and keeps the bill suspicious to be a counterfeit bill to prevent circulation of the bill.

(4) Like the foregoing second embodiment, this example may be configured to control the human detection cameras 712 and 713 mounted on the PTS terminal 700 to take an image in such a manner that the face of the supplier will be included in the image to satisfactorily identify the supplier in response to detection of insertion of a bill at the insertion detection sensor 7, and the acquired identification image may be associated and stored with the serial number of the bill.

This configuration associates the serial number of a wrong bill with identification image of the supplier who inserted the wrong bill to a paper sheet processing apparatus and stores them to the storage; accordingly, the person who committed a wrongdoing can be identified.

(5) The present example provides a configuration capable of detecting a new kind of counterfeit bill or a new kind of bill suspicious to be a counterfeit bill in the slot machines 1010 in a hall providing the above-described game system if once the same kind of bill is detected in one slot machine 1010 in the hall. Since the paper sheet processing apparatus 1 mounted on each slot machine 1010 has the same configuration as the paper sheet processing apparatuses 1 in the foregoing embodiments, description of the process steps same as those in the foregoing embodiments (ST01 to ST31, ST40, and ST50 in FIGS. 9 to 11) is omitted and the different process steps are described in detail. Specifically, the processing in the management server 800 is different; accordingly, detailed description is provided along the process flow including report processing in the management server 800 illustrated in FIG. 40 and the flow of signals and data transmitted between apparatuses illustrated in FIG. 39.

Figure 39:
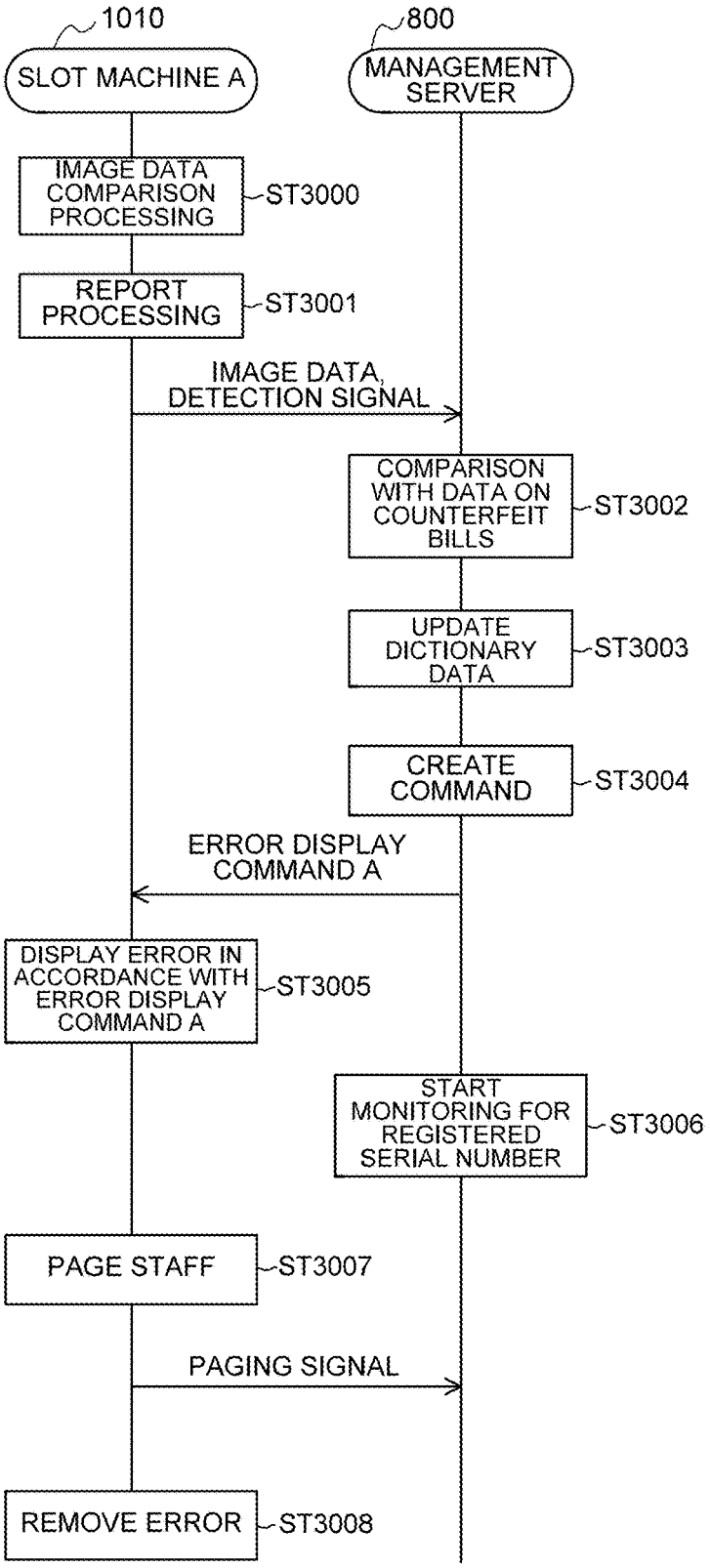
FIG. 39 is a flowchart for illustrating flows of processing and signals among apparatuses in a modification of the third embodiment.

As illustrated in FIG. 39, when identical image data of a bill is detected for three times or more in image data comparison processing, (ST3000), the PTS terminal 700 performs pre-report processing and thereafter, sends the image data of the bill and a detection signal to the management server 800 (ST3001).

Figure 40:
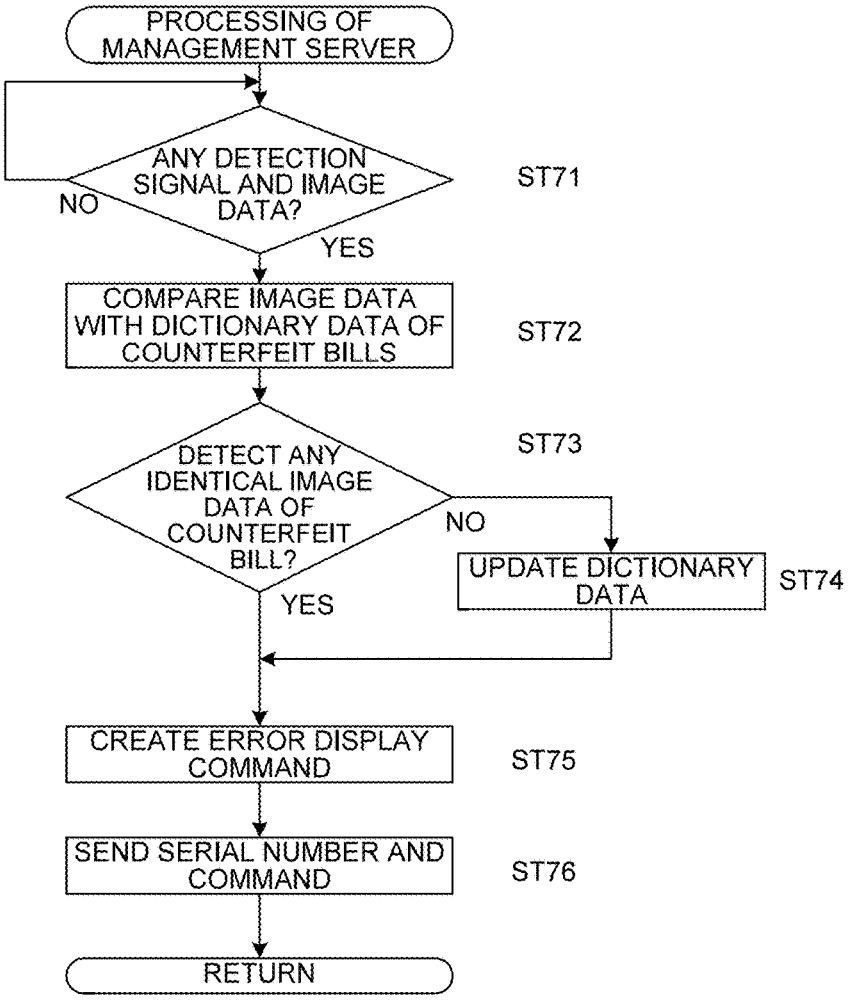
FIG. 40 is a flowchart of processing of a management server in a modification of the third embodiment.

As shown in FIGS. 39 and 40, the management server 800 monitors whether a detection signal and image data has been received from the PTS terminal 700 (ST71: NO). If the management server 800 has received a detection signal and image data (ST71: YES), the management server 800 performs comparison processing on the image data with the image data registered in the dictionary data of counterfeit bills in the storage such as a ROM (ST3002, ST72). This dictionary data includes image data of a plurality of kinds of counterfeit bills in circulation.

If identical image data is found as a result of the comparison processing of the image data of the bill and the registered image data (ST73: YES), the management server 800 creates an error display command A for displaying an error which is different from the error indicating detection of a counterfeit bill (ST3004, ST75) and sends this error command A to the PTS terminal 700 that has sent the detection signal (ST76). The management server 800 may further send an error display command B or an alert message in the form of e-mail to the management apparatus 353 so that the administrator can access the management server 800 to check the error from the management apparatus 353.

If no identical image data is found as a result of the comparison processing of the image data of the bill and the registered image data, or if the image data is new image data (ST73: NO), the management server 800 updates the dictionary data of counterfeit bills stored in the storage of the management server 800 (ST3003, ST74). This update processing automatically records the items provided in the database of dictionary data, or predetermined items such as the code, the date of detection, the time of detection, and the serial number. Since the bill is a new kind of counterfeit bill, some items such as the code name can be entered or changed as appropriate by the administrator.

Upon completion of the update of the registration of dictionary data, the management server 800 creates an error display command A to display an error which is different from the error indicating detection of a counterfeit bill (ST3004, ST75). Upon completion of the creation of error display command A, the management server 800 sends the error display command A (ST76). The management server 800 sends the error display command A to the slot machine 1010 including the PTS terminal 700 that has sent the detection signal. With this operation, a series of post-report processing in the management server 800 is completed.

The management server 800 that has updated the dictionary data can start monitoring whether any bill having the serial number identical to the registered serial number is inserted based on the image data sent from all the slot machines 1010 (ST3006).

On the LCD 719 of the PTS terminal 700 in the slot machine 1010 that has sent the image data and the detection signal, an error in accordance with the error display command A is displayed (ST3005). In response to the error message, the player pages a staff member (ST3007). A staff member provides a genuine bill to the player as a replacement for the bill kept in the slot machine and removes the error (ST3008).

This configuration acquires a serial number printed on a counterfeit bill or a bill suspicious to be a counterfeit bill not registered in the dictionary data of counterfeit bills when the counterfeit is detected in one of the slot machines 1010 installed in a hall. The serial number is associated with image data and the dictionary data in the management server 800 is updated. Accordingly, after the update of the dictionary data, the management server 800 can immediately stop the use of the new kind of counterfeit bill by monitoring whether any bill having this newly registered serial number is found in the verification performed in the slot machines 1010.

Fourth Embodiment

The present embodiment is configured to report exchange of bills suspicious to be counterfeit bills (so-called money laundering) to the administrator in the above-described game system. This report is issued when a player requests cashout under the conditions that the player has put many large bills (for example, U.S. 100-dollar bills) in one slot machine, that the bills have been determined to be genuine in verification, and that the player has played only several games with an inappropriately small amount of bet compared to the input amount. In the present embodiment, the management server 800 corresponds to the determination unit in the present invention.

Figure 41:
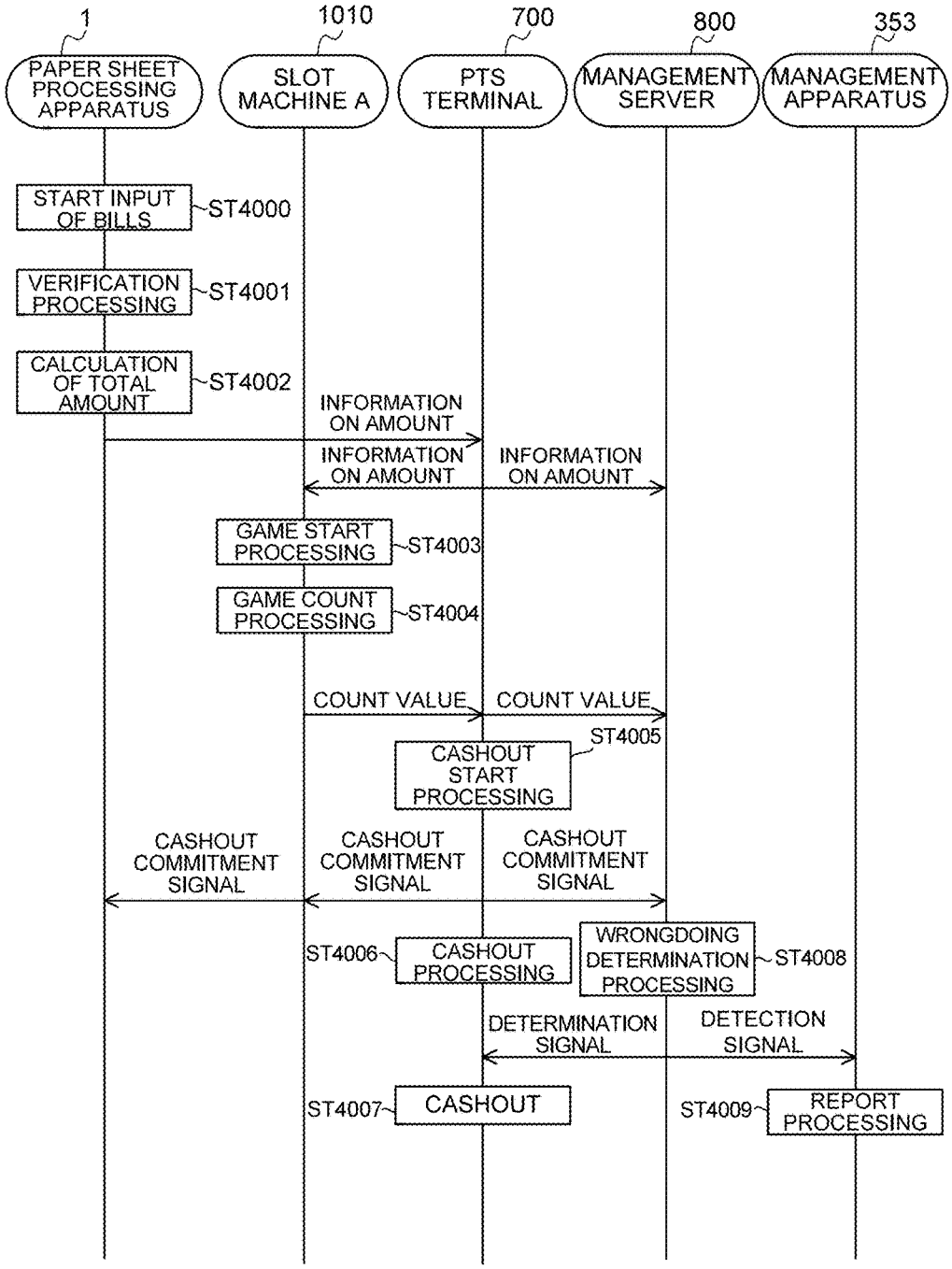
FIG. 41 is a schematic diagram for illustrating flows of signals among apparatuses in money laundering determination processing in a game system in the fourth embodiment.
Figure 42:
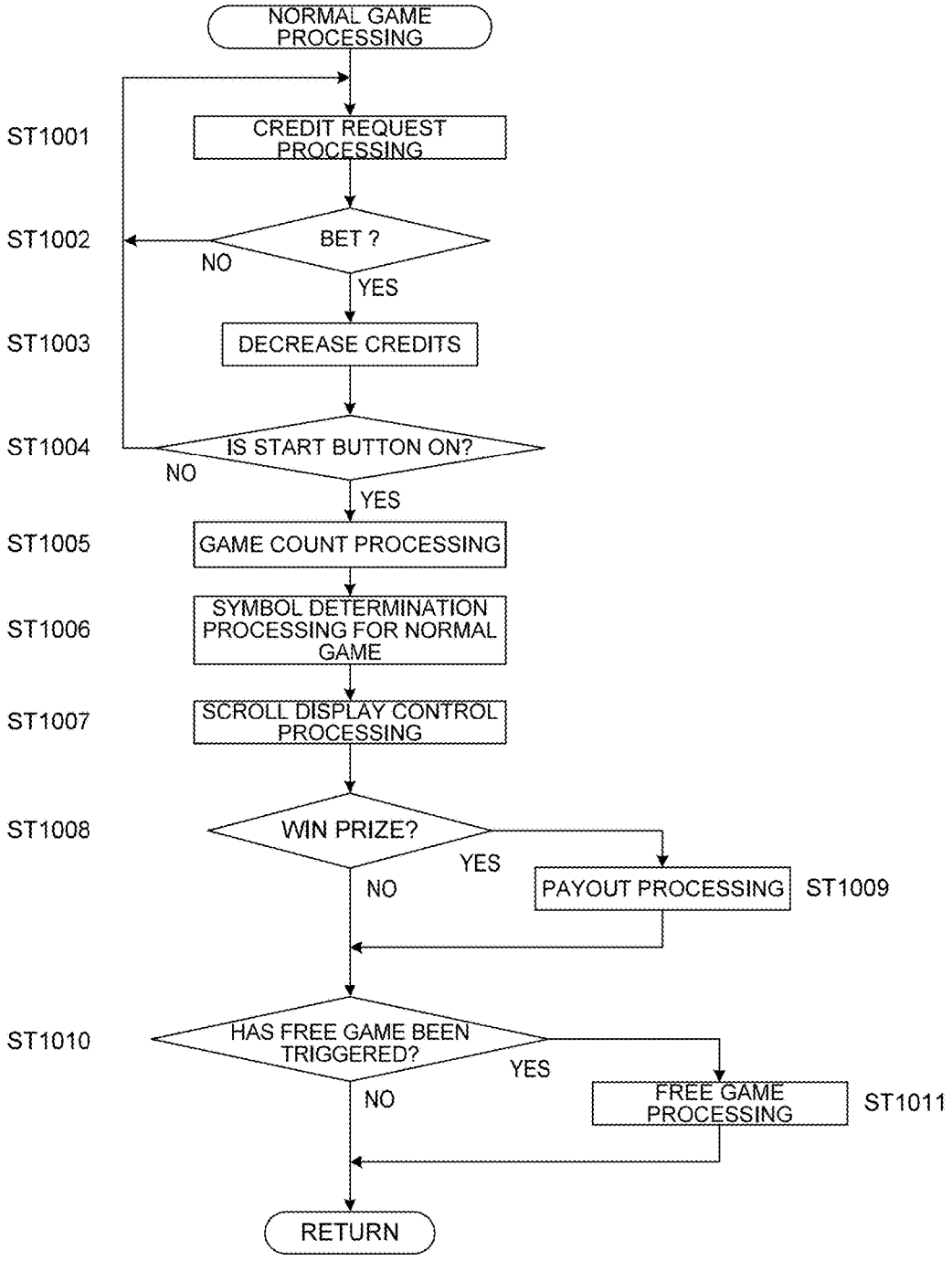
FIG. 42 is a flowchart of normal game processing in a slot machine.
Figure 43:
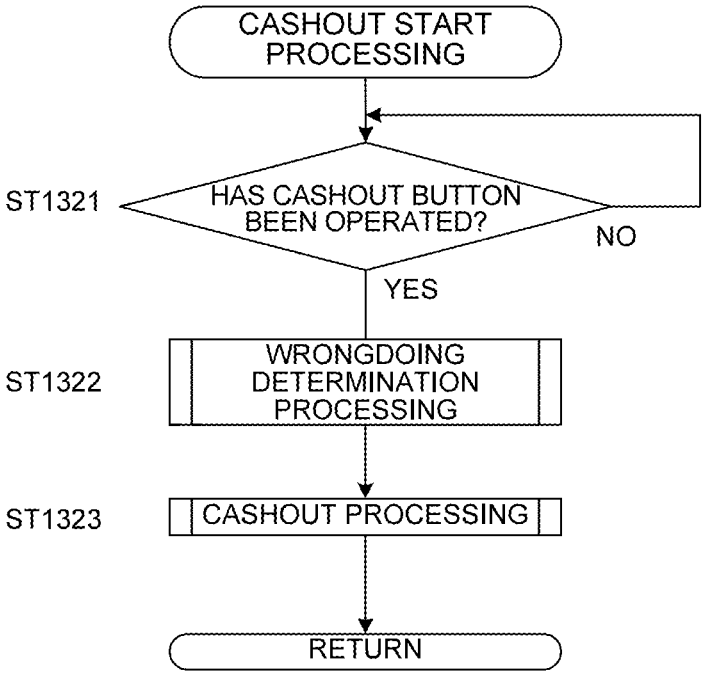
FIG. 43 is a flowchart of cashout start processing.
Figure 44:
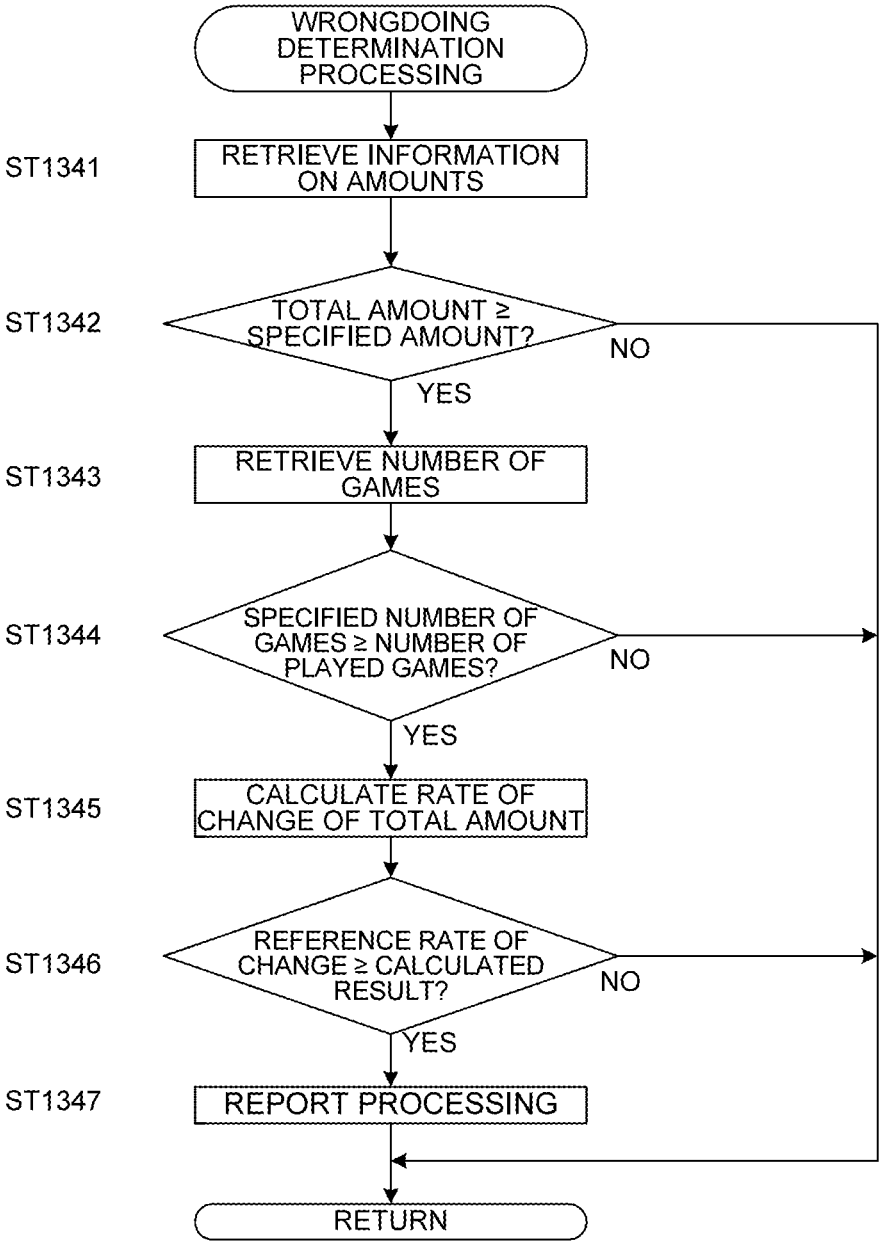
FIG. 44 is a flowchart of wrongdoing determination processing.
Figure 45:
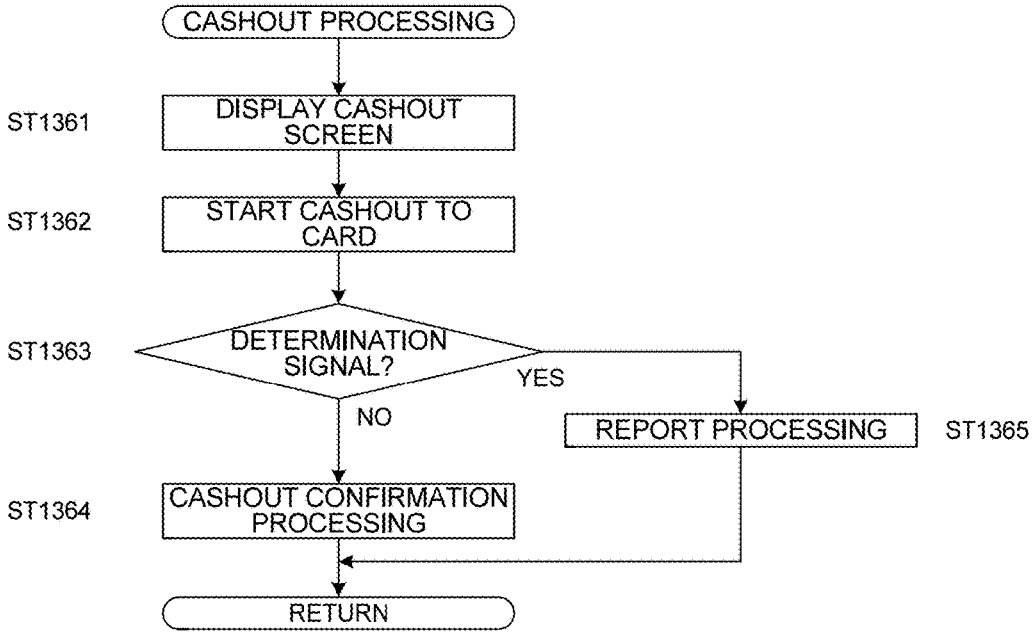
FIG. 45 is a flowchart of cashout processing.

This configuration is described along the flowchart of FIGS. 9 to 11 and the flowcharts of FIGS. 41 to 45. FIG. 41 is a schematic diagram for illustrating flows of signals among the apparatuses in the game system. FIG. 42 is a flowchart of normal game processing in a slot machine. FIG. 43 is a flowchart of cashout start processing. FIG. 44 is a flowchart of wrongdoing determination processing. FIG. 45 is a flowchart of cashout processing.

After start of inputting bills to the paper sheet processing apparatus 1 through the bill entry 22 (ST4000) as shown in FIGS. 9 and 41, the bills are determined to be genuine in verification at process steps ST22 and ST23 (ST4001) and information on the summed amount is successively sent to the PTS terminal 700 (ST4002). The information on the amount is sent from the PTS terminal 700 to the slot machine 1010 and further, sent to the management server 800 via the game controller.

Upon completion of inputting bills, the player starts playing games (ST4003). For example, normal game processing shown in FIG. 42 is started. That is to say, the slot machine 1010 allows start of a game in response to input of a bill in the amount equivalent to the number of credits required to play a unit game. Hereinbelow, an example is described where the started game is a normal game.

Normal Game Processing

Operation of a slot machine 1010 is described. Described hereinbelow is an example of processing performed by the main CPU 1071 in the slot machine 1010 in a normal game. In the slot machine 1010, preparatory processing such as loading a game program and initialization is performed in advance.

First, the main CPU 1071 performs credit request processing (ST1001). The main CPU 1071 determines whether credits are input with a bill or a ticket with the number of credits printed thereon. If detecting input, the main CPU 1071 increments the credit counter by the number of input credits. The main CPU 1071 determines whether the credit counter indicates the value of 0. If not determining that the credit counter indicates 0, the main CPU 1071 controls the BET buttons to be operable (to allow bet operation) in accordance with the value of the credit counter and proceeds to ST1002.

The main CPU 1071 determines whether bet operation is performed (ST1002). In this processing, the main CPU 1071 determines whether the main CPU 1071 has received an input signal output from a BET switch when the corresponding BET button is operated. If not determining that any BET button is operated (ST1002: NO), the main CPU 1071 returns to ST1001. If determining that some BET button is operated (ST1002: YES), the main CPU 1071 proceeds to ST1003.

If determining some BET button is operated, the main CPU 1071 updates the value stored in the bet count storage area provided in the RAM 1073 in accordance with the bet operation (by incrementing the bet counter and decrementing the credit counter) and controls the START button 1046 to be operable (to allow start operation) and proceeds to ST1004.

Next, the main CPU 1071 determines whether the START button 1046 is ON (ST1003). In this processing, the main CPU 1071 determines whether the main CPU 1071 has received an input signal output from the START switch 1046S in response to press of the START button 1046. If not determining that the START button 1046 is ON (ST1003: NO), the main CPU 1071 returns to ST1001. If the START button 1046 is not pressed (for example, in the case where an instruction to end the play is entered without enabling the START button 1046), the main CPU 1071 cancels the decrement at ST1003.

If the START button 1046 is ON (ST1004: YES), an operation signal issued in response to the operation of the START button 1046 is counted by a counter 252 (ST4004), and the incremented count value on the games is forwarded to the RAM 1073 (ST1005). The forwarded count value is stored in a predetermined memory area in the RAM 1073 and further, sent to the PTS terminal 700 and the management server 800.

Subsequently, the main CPU 1071 performs symbol determination processing for a normal game (ST1006). In the symbol determination processing for a normal game, the main CPU 1071 determines code numbers of the symbols to be shown when the symbols are stopped. For example, the main CPU 1071 determines the code numbers of the symbols when the symbol arrays are stopped, based on acquired random values.

Next, the main CPU 1071 performs scroll display control processing (ST1007). This processing is to control the display in such a manner that the symbols are scrolled and subsequently rearranged to show the symbols determined at ST1006.

Next, the main CPU 1071 determines whether rearranged symbols determined at ST1006 wins any prize (ST1008).

If determining that a prize is won (ST1008: YES), the main CPU 1071 performs payout processing (ST1009). In this processing, the main CPU 1071 determines the multiplier for the payout based on the number of symbols rearranged on each enabled line with reference to odds data stored in the RAM 1073. The odds data indicates the relation between the number of symbols rearranged on an enabled line and the multiplier for the payout. In the case where a double wild symbol is included in the rearranged symbols and a prize with this symbol is won, the payout is doubled.

If not determining that any prize is won (ST1008: NO), or after performing the payout processing (ST1009), the main CPU 1071 determines whether a free game has been triggered (ST1010). If a free game has been triggered (ST1010: YES), the main CPU 1071 starts free game processing (ST1011). If a free game has not been triggered (ST1010:

NO) or after completion of the free game processing (ST1011), the main CPU 1071 exits this routine.

Cashout Start Processing (ST4005)

When the player ends playing games, the main CPU 1071 determines whether the CASHOUT button 1032 has been operated. If a cashout commitment signal is issued in response to press of the CASHOUT button 1032 (ST1321: YES), the main CPU 1071 performs wrongdoing determination processing (ST1322). The main CPU 1071 performs cashout processing (ST1323) subsequent to the wrongdoing determination processing. The CASHOUT button 1032 and the management server 800 function as the detector for detecting cashout in the present invention.

Wrongdoing Determination Processing

As shown in FIG. 44, the management server 800 that has received a cashout commitment signal sent from the PTS terminal 700 retrieves the total amount sent from the paper sheet processing apparatus 1 via the PTS terminal 700 and stored in the RAM when bills are input and the specified amount stored in advance in the ROM (ST1341). The specified amount is set to a large amount, for example 10 million dollars in the case of U.S. dollar, which is larger than a normal amount input at one time by a common supplier.

The CPU of the management server 800 compares the total amount retrieved from the RAM with the specified amount. If the result of the comparison indicates that the total amount is less than the specified amount (ST1342: NO), the CPU exits this routine. If the total amount is equal to or more than the specified amount (ST1342: YES), the CPU proceeds to ST1343.

At ST1343, the CPU retrieves the number of played games counted until the cashout start processing from the RAM and reads the specified number of games stored in the ROM in advance.

The CPU compares the retrieved number of played games with the specified number of games. If the number of played games is greater than the specified number of games (ST1344: NO), the management server 800 sends a determination signal indicating OK to the PTS terminal 700 and exits this routine. If the number of played games is equal to or smaller than the specified number of games (ST1344: YES), the CPU proceeds to ST1345.

At ST1345, the CPU calculates the rate of change of the total amount from the total amount before starting the games and the remaining amount at the end of the games. For example, the rate of change can be obtained by: the rate of change={(the remaining amount at the end of the games)−(the total input amount before starting the games)/(the total input amount before starting the games)}×100. It should be noted that the present invention is not limited to this formula to calculate the rate of change and any formula can be applicable as far as the rate of change can be expressed numerically. After calculating the rate of change, the CPU compares the calculated result with the reference rate of change, which could be minus several percent, stored in the ROM in advance. If the calculated result is higher than the reference rate of change (ST1346: NO), the management server 800 sends a determination signal of OK to the PTS terminal 700 and exits this routine. If the calculated result is equal to or lower than the reference rate of change (ST1346: YES), the management server 800 sends a detection signal to the host apparatuses such as the management apparatus 353 and the kiosk terminal 1700, and completes this routine (ST1347).

Cashout Processing (ST4006)

Figure 46:
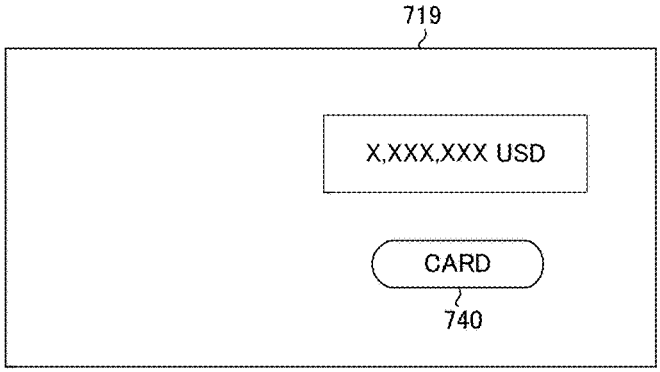
FIG. 46 is a diagram showing a screen displayed on a PTS terminal.

FIG. 45 is a flowchart of cashout processing. As shown in FIG. 46, the cashout screen on the PTS terminal 700 includes a CARD button 740. The PTS terminal 700 accepts a request to input data with this CARD button 740 (ST1361). In response to press of the CARD button 740, the PTS terminal 700 starts cashout to the card (ST1362). That is to say, paying back to the IC card (ST4007) is started. Meanwhile, the PTS terminal 700 monitors whether a determination signal of wrongdoing determination processing (ST4008) shown in FIG. 41 is received from the management server 800 (ST1363). If the PTS terminal 700 does not receive the determination signal within a predetermined time period (ST1363: NO), the cashout processing is admitted and the PTS terminal 700 sends the amount to the management server 800 and the IC card (ST1364). With this operation, this routine is completed.

If the result of the wrongdoing determination (ST4008) indicates a wrongdoing (ST1363: YES), the management server 800 sends a detection signal to the management apparatus 353. The management apparatus 353 refers to the result of determination by the management server 800 in response to receipt of the detection signal (ST4009 in FIG. 41, ST1365 in FIG. 45). With this operation, this routine is completed. Like the foregoing embodiments, the PTS terminal 700 may take images of the face of the supplier inserting the bills with the human detection cameras 712, 713 and send the acquired identification image data to the management server 800. The management server 800 may send the identification image data together with the detection signal to the management apparatus 353. The LCD 719 of the PTS terminal 700 may display an error irrelevant to the determination result, such as "system error".

The above-described configuration of the present example determines so-called money laundering which is committed by exchanging wrong bills into an IC card 500 or a medium having a value equivalent to genuine bills and taking out the IC card 500, when cashout to an IC card 500 is requested by a player who has put many bills in the amount highly exceeding a usual input amount for a slot machine 1010 into the paper sheet processing apparatus 1 and played only several slot games. As a result, improper cashout to an IC card 500 or taking out the IC card 500 is prevented, and further, the administrator can check the person who committed the wrongdoing.

Configuration of Game System

Next, specific configurations of the apparatuses included in the game system shown in FIG. 24 are described in detail.

The external control apparatus 621 is to control the plurality of slot machines 10. In the present embodiment, the external control apparatus 621 is a so-called hall server installed in a game hall having the plurality of slot machines 1010. Each of the slot machines 1010 is assigned a unique identification number; the external control apparatus 621 identifies a slot machine 1010 that sends data to the external control apparatus 621 with the identification number. Furthermore, the external control apparatus 621 uses the identification number to designate a destination in sending data to a slot machine 1010.

The game system 350 may be constructed within a single game hall where various games can be conducted like a casino, or may be constructed among a plurality of game halls. In the case where the game system 350 is constructed in a single game hall, the game system 350 may be constructed on each floor or in each section of the game hall. The communication line 3001 may be wired or wireless, and can adopt a dedicated line, an exchange line, or the like.

Figure 25:
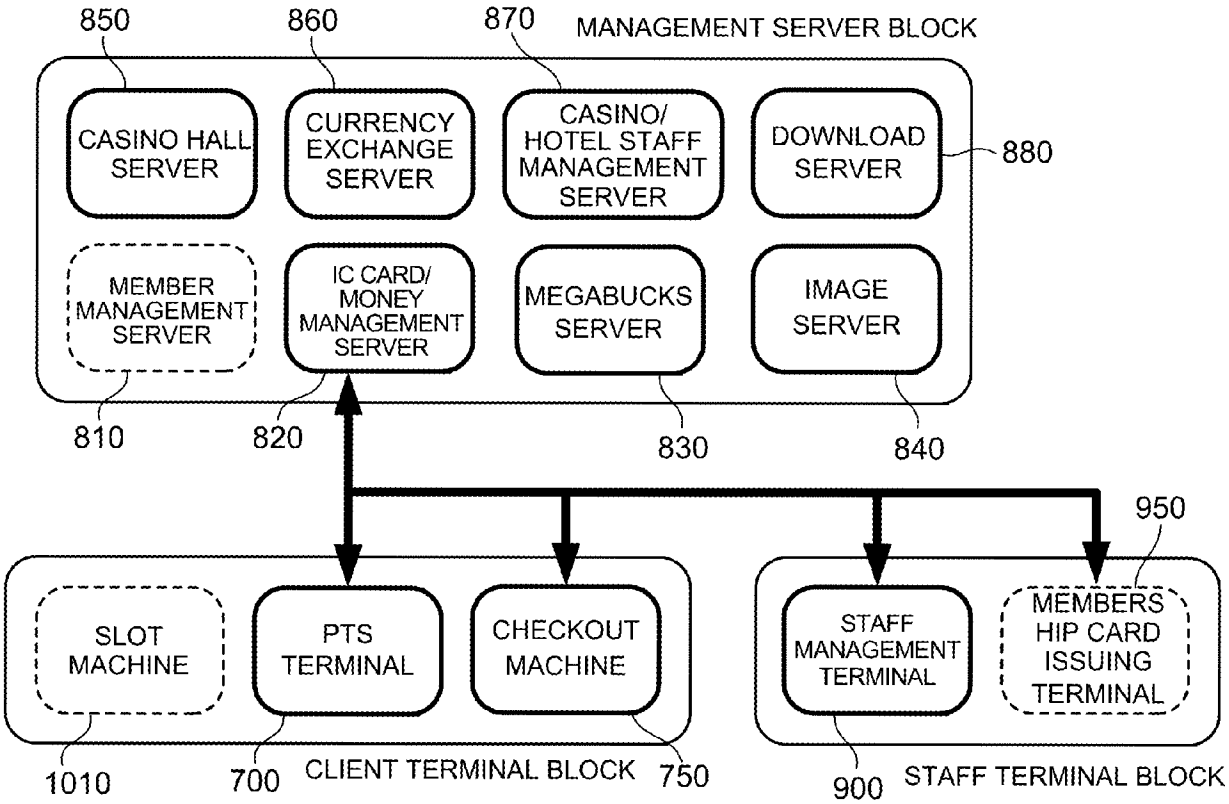
FIG. 25 is a block diagram of a game system.

As illustrated in FIG. 25, the game system is generally grouped into the following three blocks: a management server block, a client terminal block, and a staff terminal block. The management server block includes a casino hall server 850, a currency exchange server 860, a casino/hotel staff management server 870 and a download server 880.

The casino hall server 850 is a server for managing the entire casino hall where the slot machines 1010 are installed. The currency exchange server 860 is a server for generating exchange rate data based on currency exchange information. The casino/hotel staff management server 870 is a server for managing the staff working in the casino hall and/or a hotel associated with the casino hall. The download server 880 is a server for downloading latest information such as information on the games and news and for notifying the players of the information through the PTS terminals 700 of the slot machines 1010.

The management server block further include a member management server 810, an IC card/money management server 820, a megabucks server 830, and an image server 840.

The member management server 810 is a server for managing membership information on the players of the slot machines 1010. The IC card/money management server 820 is a server for managing IC cards 500 to be used in the slot machines 1010. Specifically, the IC card/money management server 820 stores data on fractional amount of cash in association with an identification code and outputs the data on fractional amount of cash to a PTS terminal 700. The IC card/money management server 820 further generates and manages denomination rate data. The megabucks server 830 is a server for managing a megabucks, which is a kind of game that provides the total amount of bet of a plurality of slot machines 1010 installed in a plurality of casino halls for an award. The image server 840 is a server for downloading latest images about the games and news and for notifying the players of the images through the PTS terminals 700 of the slot machines 1010.

The client terminal block includes slot machines 1010, PTS terminals 700, and a checkout machine 750. The PTS terminals 700 are attachable to the slot machines 1010 and can interactively communicate with the management server 800. The checkout machine 750 is a machine for a player to checkout by converting the monetary data stored in the player's IC card 500 into cash or to store monetary data of the amount of coins or bills T in the IC card 500.

The staff terminal block includes a staff management terminal 900 and a membership card issuing terminal 950. The staff management terminal 900 is a terminal for the staff of the casino hall to manage the slot machines 1010. Particularly in the present embodiment, the staff of the casino hall manages whether the PTS terminals 700 hold too many IC cards 500 or are in short of IC cards 500. The membership card issuing terminal 950 is a terminal to be used to issue a membership card for a game player in the casino hall.

Figure 26:
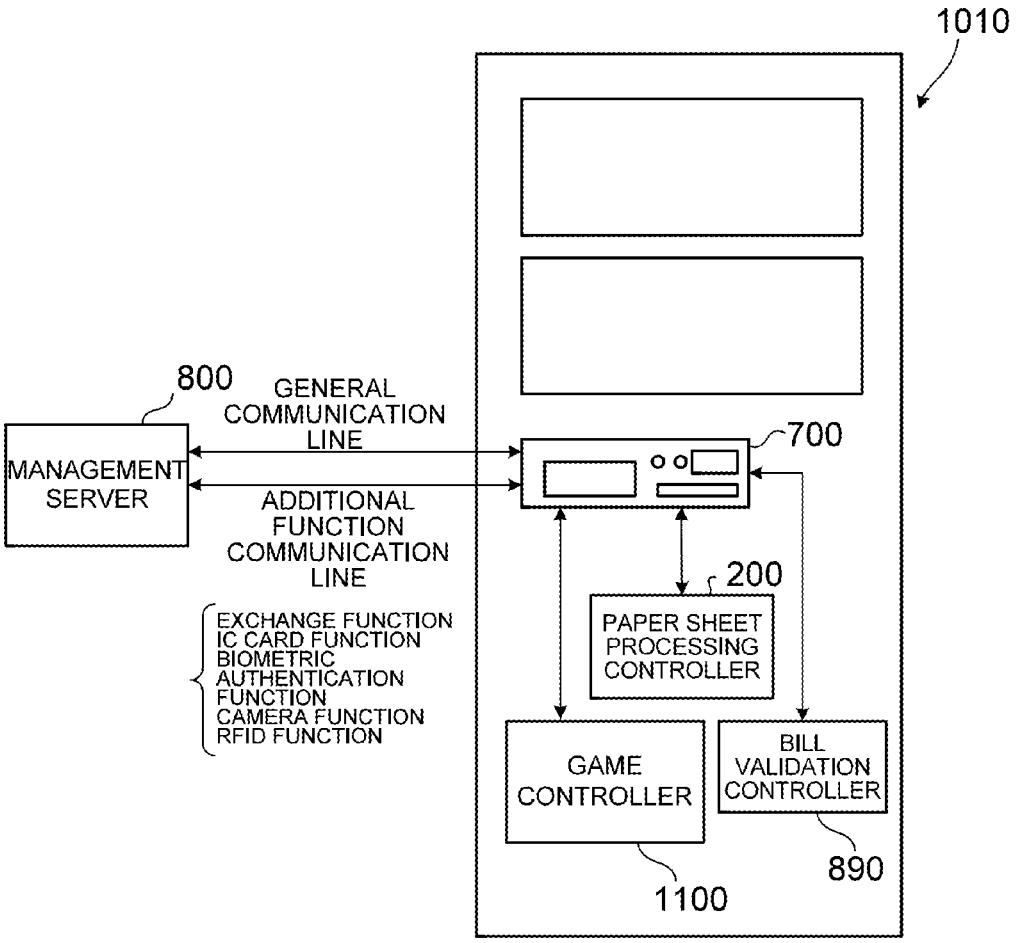
FIG. 26 is a block diagram of a PTS system.

The PTS terminals 700 are included in a PTS system as illustrated in FIG. 26. A PTS terminal 700 attached to a slot machine 1010 is connected with the game controller 1100, the bill validation controller 890, and the paper sheet processing controller M200 of the slot machine 1010 to be able to communicate with each other.

The PTS terminal 700 coordinates game effects of sound and images and updates credit data through communications with the game controller 1100. The PTS terminal 700 sends credit data required for cashout through communications with the bill validation controller 890.

The PTS terminal 700 is also connected with the management server 800 to be able to communicate with each other. The PTS terminal 700 communicates with the management server 800 using two communication lines: a general communication line and an additional function communication line.

The PTS terminal 700 uses the general communication line to communicate data such as monetary data, identification code data, and player's membership information. The PTS terminal 700 uses the additional function communication line for communications related to newly added functions. The PTS terminal 700 in the present embodiment uses the additional function communication line for communications related to the exchange function, the IC card function, the biometric authentication function, the camera function, and the RFID (radio frequency identification) function, which is a function for identifying objects using radio wave.

Hereinafter, the configurations of the aforementioned gaming machine, slot machine 1010, PTS terminal 700, and kiosk terminal 1700 and the processing related to these apparatuses are described in detail.

Overview of Gaming Machine

The paper sheet processing apparatus 1 configured as described above is installed in a gaming machine 300. As illustrated in FIGS. 47, 48, and 24 to 26, the gaming machine 300 is configured as a multiplayer participation type, where a plurality of gaming terminals of slot machines 1010 are connected with a center controller 621 (external control apparatus) to be able to communicate data. The gaming machine 300 can be configured to provide normal games in each slot machine 1010 independently and further, to provide common games synchronized among the slot machines 1010. Accordingly, the present embodiment describes an example in which common games are also available. The connection of the slot machines 1010 and the center controller 621 may be wired, wireless, or a combination thereof. The denomination that can be used for a bet may be a national or regional currency such as U.S. dollar, Japanese yen, or Euro, or alternatively, a game point uniquely used in a hall or a market including the gaming machine 300.

More specifically, the gaming machine 300 includes a plurality of slot machines 1010 and a center controller 621. Each slot machine 1010 includes an input device for accepting an input from the external and a terminal controller programmed to perform a variety of processing for independently conducting normal games and providing common games to be conducted among the plurality of slot machines 1010. The center controller 621 is connected with the plurality of slot machines 1010 to be able to communicate and programmed to perform a variety of processing.

Each terminal controller in the gaming machine 300 is configured to be able to perform at least three kinds of processing: the first processing is to conduct a normal game in response to a start operation with the input device; the second processing is to conduct a common game in accordance with a game start instruction from the center controller 621; and the third processing is to determine the game result of the common game based on game result information from the center controller 621.

The center controller 621 in the gaming machine 300 is configured to be able to perform at least three kinds of processing: the first processing is to timely output game start instructions to the slot machines 1010 satisfying a game execution requirement; the second processing is to determine the result of the common game; and the third processing is to output the game result determined in the second processing to the slot machines 1010 as game result information.

The term "game execution requirement" is a requirement for the slot machine 1010 to be entitled to participate in a common game. For example, the requirement can be that the accumulated amount bet on normal games is not less than a minimum amount or that the number of normal games is not smaller than a minimum number of bet operations. The game execution requirement can be satisfied depending on the player's intension before starting the common game. For example, if the game execution requirement is not satisfied because the accumulated amount bet on normal games is less than the minimum amount, the game execution requirement can be satisfied by paying the difference between the minimum amount and the accumulated bet amount or by paying a predetermined amount to satisfy the requirement before the start of a common game. In the case of shortage in the number of normal games, the game execution requirement is satisfied by paying the amount equivalent to the shortage or by paying a predetermined amount to satisfy the requirement.

The time to output a game start instruction is when the common game start requirement is satisfied in one of the slot machines 1010. The common game start requirement can be that the accumulated amount in the bet amount information is higher than a predetermined amount or that the count of normal games is greater than a predetermined number. The present embodiment describes a gaming machine 300 including a center controller 621 separately from the slot machines 1010; however, the gaming machine 300 may be configured so that at least one slot machine 1010 has the functions of the center controller 621 and the slot machines 1010 are connected with one another to be able to communicate data.

The "slot machine 1010" is a kind of game terminal in the gaming machine 300. The present embodiment describes the slot machine 1010 as an example of a game terminal but the game terminal is not limited to this. Any machine including a terminal controller that can independently conduct some type of normal games can be used as game terminal.

The "normal game" in the present embodiment is executed by each slot machine 1010. The normal game is a slot game in which a plurality of symbols 501 are rearranged. The normal game is not limited to a slot game but can be a game that can be independently conducted on a game terminal such as a slot machine 1010.

Rearranging the symbols 501 in a slot game (see FIG. 57) is performed in a symbol display region 614A on a display 614. Slot games are conducted by the following three modes of processing: processing to conduct a normal game by rearranging the symbols 501 to provide a normal payout in accordance with the rearranged symbols 501 under the condition that some gaming medium is bet; processing to conduct a bonus game by rearranging the symbols 501 in a condition of a payout rate higher than the normal game to provide a bonus payout in accordance with the rearranged symbols 501 when the symbols 501 are rearranged into a specific combination in a normal game; and processing to conduct rescue processing when a rescue start condition is satisfied.

Figure 57:
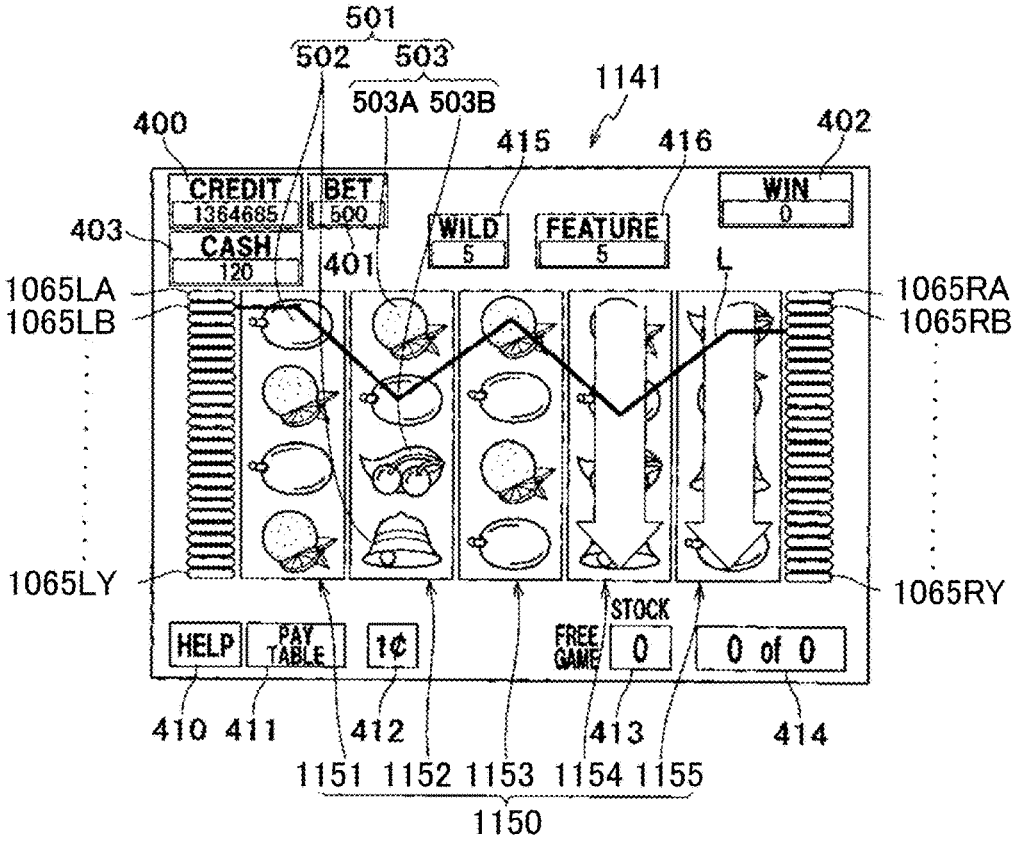
FIG. 57 is an explanatory diagram for illustrating a display on a lower display panel.

The "symbols 501" include special symbols 503 and normal symbols 502. That is to say, the symbol 501 is a generic term of the special symbol 503 and the normal symbol 502. As shown in FIG. 57, the special symbols 503 include wild symbols 503A and trigger symbols 503B. A wild symbol 503A is a symbol that can substitute for another kind of symbol. A trigger symbol 503B is a symbol serving as at least a trigger to start bonus games. That is to say, the trigger symbol 503B works as a trigger to change from normal games to bonus games and to increase the special symbols 503 in the bonus games step by step after elapse of a predetermined time since the start of the bonus games. The trigger symbol 503B can also be a trigger to increase the special symbols 503, or at least either the trigger symbols 503B or the wild symbols 503A, in the bonus games. Alternatively, the trigger symbol 503B can be a trigger to increase the number of bonus games in a series of bonus games.

The "gaming value" includes coins, bills T, and electrically valuable information equivalent to these. The gaming value in the present invention is not limited to a specific one and can be gaming media such as medals, tokens, electric money, and tickets. The tickets are not limited to a specific type and can be tickets with barcodes, for example.

The "bonus game" means a feature game. The bonus game in the present embodiment is described as a free game to be conducted repeatedly. The bonus game, however, can be any kind of game as far as the bonus game is advantageous over a normal game. If the game is advantageous for the player, or if the game is advantageous over a normal game, a plurality of kinds of bonus games may be mixed in a series of bonus games. For example, a bonus game may be conducted in one of the conditions or in combination of the conditions that the player can gain more gaming value, that the player can gain gaming value with higher probability, and that the player can play the game by consuming less gaming value, than a normal game.

The "free game" is a game that can be conducted with a smaller bet of gaming value than a normal game. "A smaller bet of gaming value" includes a case of zero bet. Accordingly, a free game can be conducted without a bet of gaming value and pays gaming value in the amount in accordance with the rearranged symbols 501. In other words, a free game can be defined as a game that can be started without the premise of spending gaming value. In contrast, a normal game is conducted with a bet of gaming value and pays gaming value in the amount in accordance with the rearranged symbols 501. In other words, a normal game is a game to be started on the premise of spending gaming value.

The "rearranging" means an action of arranging symbols 501 again after releasing an arrangement of symbols 501. The "arrangement" means a state in which a set of symbols 501 are visible by the player in the outside.

The "normal payout in accordance with the rearranged symbols 501" means a normal payout for a rearranged winning combination. The "bonus payout in accordance with the rearranged symbols 501" means a bonus payout for a rearranged winning combination. The "winning combination" means completion of a prize.

The "condition of a payout rate higher than the normal game" can include conducting a free game and conducting a game using a symbol table in which wild symbols or trigger symbols are increased or replaced with other symbols, for example.

The gaming machine 300 further includes a common display 701 provided at a place to be seen from all the operating positions of the slot machines 1010. The center controller 621 may show the status until start of a common game on the common display 701. The "operating positions" are the eye levels of the players operating the slot machines 1010. The gaming machine 300 having this configuration enables the players to estimate the waiting time until start of a common game through the common display 701 showing the status until the conditions to start the common game are satisfied.

Functional Flow of Gaming Machine 300: Slot Machine

The gaming machine 300 configured as described above includes slot machines 1010 and an external control apparatus (center controller) 621 connected with the slot machines 1010 to be able to communicate data. The external control apparatus 621 is connected to be able to communicate data with a plurality of slot machines 1010 installed in a hall.

Figure 47:
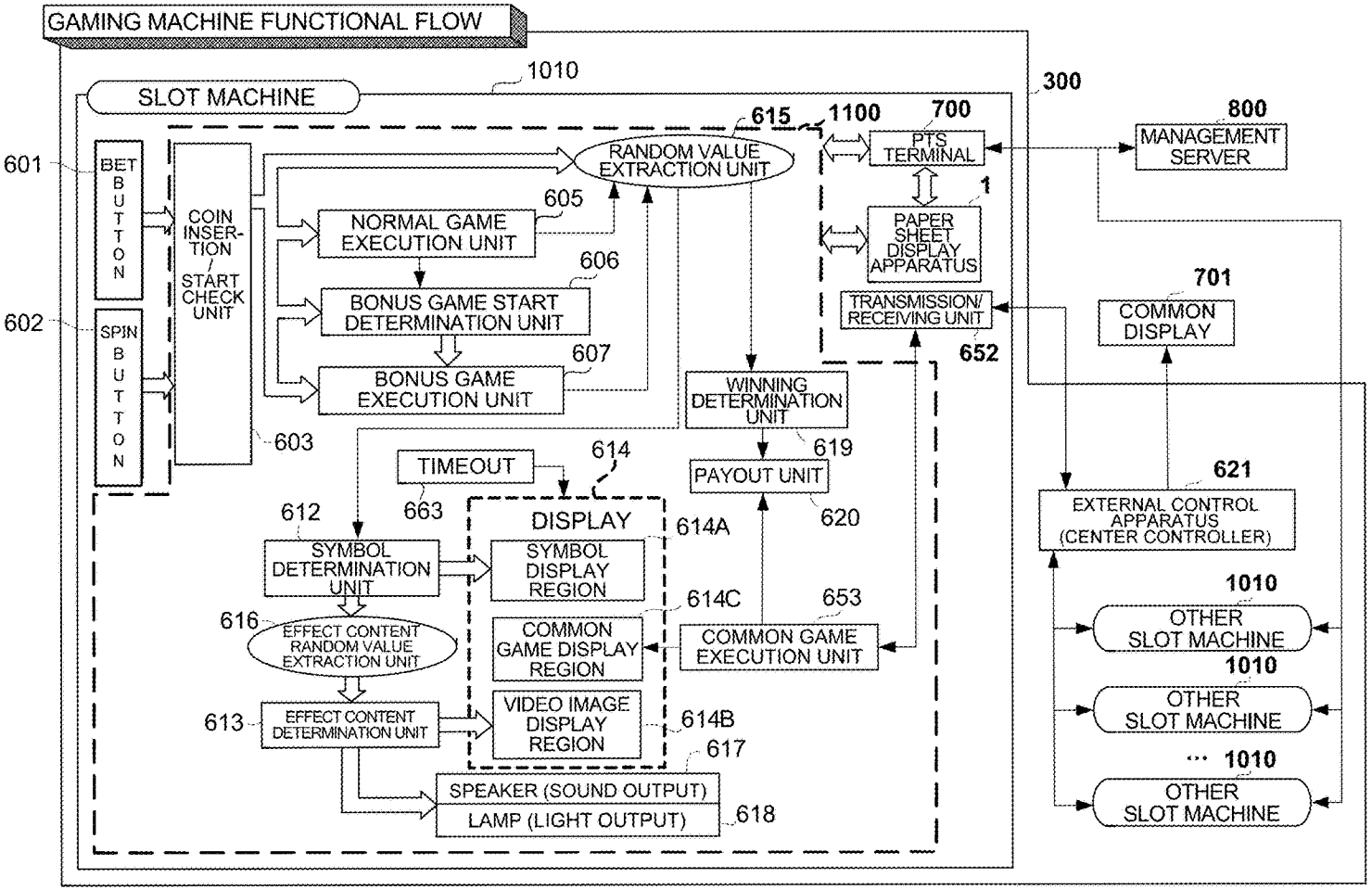
FIG. 47 is an explanatory diagram of a functional flow in a gaming machine.

As shown in FIG. 47, each slot machine 1010 includes a BET button 601, a SPIN button 602, a display 614, and further, a game controller 1100 for controlling these components. The BET button 601 and the SPIN button 602 are kinds of input devices. The slot machine 1010 further includes a transmission/receiving unit 652 for implementing data communication with the external control apparatus 621.

The BET button 601 has a function to receive an instruction about the amount of bet through the player's operation. The SPIN button 602 has a function to receive an instruction to start a game such as a normal game through the player's operation or a start operation. The display 614 has a function to display various kinds of symbols 501, still picture information such as numerical values and marks, and motion picture information such as effect video. The display 614 has a symbol display region 614A, a video image display region 614B, and a common game display region 614C.

The symbol display region 614A displays the symbols 501 shown in FIG. 57. The video image display region 614B displays a variety of image information for presentation effects provided in a game by motion picture or still picture. The common game display region 614C displays common games such as a jackpot game.

The game controller 1100 includes a coin insertion/start check unit 603, a normal game execution unit 605, a bonus game start determination unit 606, a bonus game execution unit 607, a random value extraction unit 615, a symbol determination unit 612, an effect content random value extraction unit 616, an effect content determination unit 613, a speaker 617, a lamp 618, a winning determination unit 619, and a payout unit 620.

The normal game execution unit 605 has a function to conduct a normal game under the condition where the BET button 601 is operated. The bonus game start determination unit 606 determines whether to conduct a bonus game based on the combination of rearranged symbols 501 in a normal game. That is to say, the bonus game start determination unit 606 determines that a bonus game is won when a trigger symbol is rearranged in a specified condition and shifts the processing to the bonus game execution unit 607 to conduct a bonus game from the next unit game.

The "unit game" is a series of operations from start of receiving a bet until becoming a state where a possible prize is determined. For example, a unit game in the normal game mode includes a bet time for receiving a bet, a game time for moving stopped symbols 501 to be rearranged, and a payout time for providing a payout. The unit game in the normal game mode is referred to a normal unit game.

The bonus game execution unit 607 has a function to conduct a series of bonus games where a free game is repeated for a plurality of times. The free game is conducted in response to operation of only the SPIN button 602.

The symbol determination unit 612 has a function to determine the symbols 501 to be rearranged with the random values received from the random value extraction unit 615, a function to rearrange the determined symbols 501 in the symbol display region 614A on the display 614, a function to output information on the rearranged symbols 501 to the winning determination unit 619, and a function to output an effect instruction signal based on the condition of the rearrangement of the symbols 501 to the effect content random value extraction unit 616.

The effect content random value extraction unit 616 has a function to extract an effect content random value in response to an effect instruction signal from the symbol determination unit 612 and a function to output an effect content random value to the effect content determination unit 613. The effect content determination unit 613 has a function to determine an effect content using the effect content random value, a function to output the image information of the determined effect content to the video image display region 614B on the display 614, and a function to output the audio and illumination information of the determined effect content to the speaker 617 and the lamp 618.

The winning determination unit 619 has a function to determine whether any prize is won in response to information on the rearranged symbols 501 to be displayed on the display 614, a function to calculate the amount of payout based on the prize if winning is determined, and a function to output a payout signal based on the amount of payout to the payout unit 620. The payout unit 620 has a function to pay gaming value to the player in the form of coins, medals, or credits. The payout unit 620 further has a function to add the amount of credit to be paid out to the credit data stored in the IC card 500 inserted in the later-described PTS terminal 700.

The game controller 1100 further includes a not-shown storage for storing data on the amounts to be bet. The storage is a device for storing data rewritably, such as a hard disk drive or a memory.

The game controller 1100 further includes a common game execution unit 653. The common game execution unit 653 has a function to output bet amount information based on the amount of bet selected in a normal game to the external control apparatus 621 at each unit game, a function to conduct a common game in response to a game start instruction from the external control apparatus 621, and a function to receive a bet operation with the BET button 601 for an amount of bet based on the bet amount data for common games, which specifies amounts that can be bet on a common game.

Figure 51:
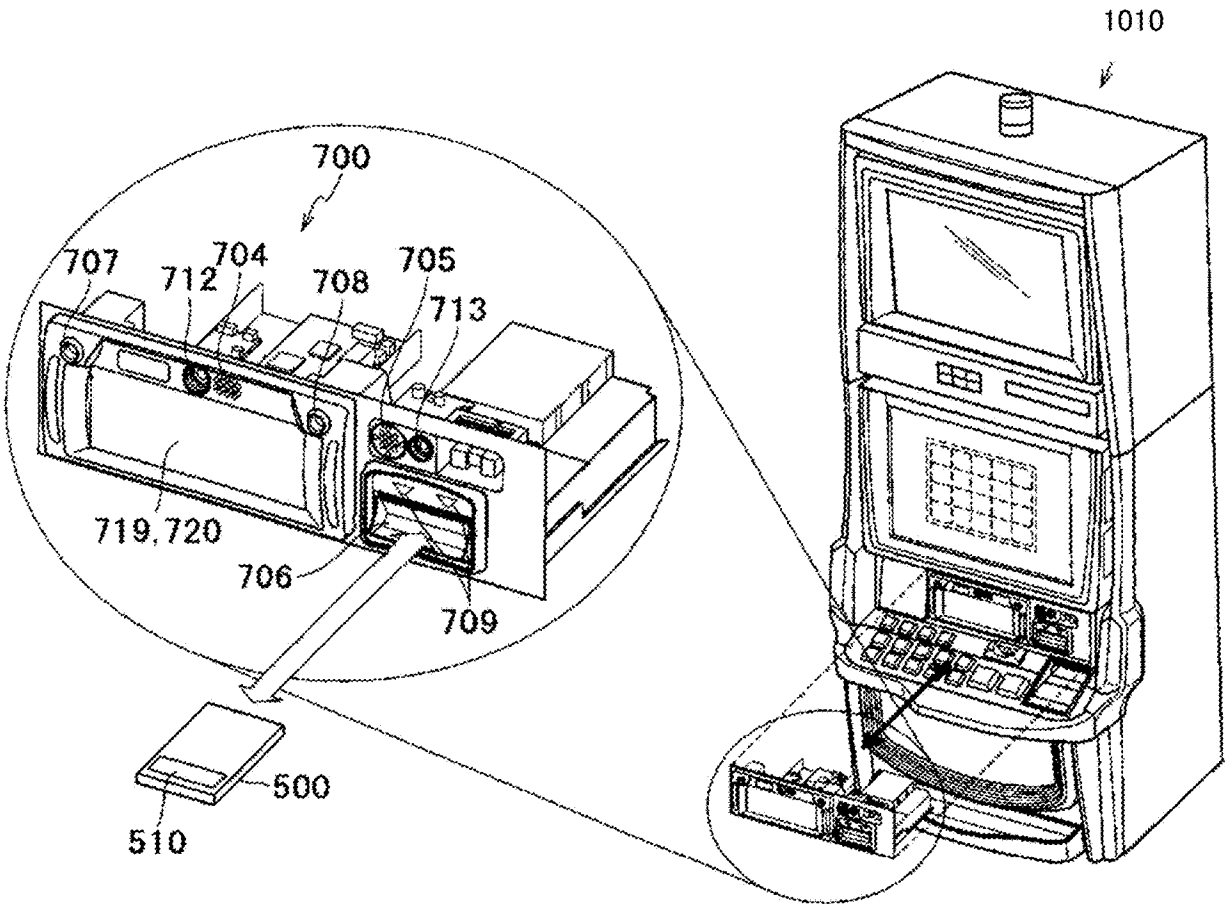
FIG. 51 is an enlarged perspective view of a PTS terminal.

The game controller 1100 is connected with the PTS terminal 700. As illustrated in FIG. 51, the PTS terminal 700 is a unit in which an LCD 719, microphones 704 and 705, human detection cameras 712 and 713 (which correspond to the imaging device in the present invention) are integrated and has a function to produce effects on the games and a function to permit the paper sheet processing apparatus 1 to output a bill T through communication with the game controller 1100 and the paper sheet processing controller M200. The PTS terminal 700 has a card slot 706 to receive an IC card 500. The player can use the credits stored in an IC card 500 on the slot machine 1010 by inserting the IC card 500 into the card slot 706. The mechanical configuration of the PTS terminal 700 will be described later.

The game controller 1100 updates the indication of credits on the display 614 upon receipt of credit data from the PTS terminal 700. Furthermore, the game controller 1100 outputs credit data to be cashed out to the PTS terminal 700 in response to a cashout request.

Each of the PTS terminals 700 of the slot machines 1010 included in the gaming machine 300 is connected with the management server 800 to be able to communicate and manages downloading images, an IC card 500, and credits. The management server 800 corresponds to the management apparatus in the present invention.

Functional Flow of Gaming Machine 300: External Control Apparatus

The gaming machine 300 configured as described above is connected with the external control apparatus 621. The external control apparatus 621 has functions to remotely monitor the operating states of the slot machines 1010 and to remotely change the settings of individual kinds of games. Furthermore, the external control apparatus 621 has functions to determine whether each of the game terminals satisfies the requirement to start a common game and upon determining that one of the game terminals satisfies the requirement to start a common game, start a common game on a plurality of slot machines 1010.

Figure 48:
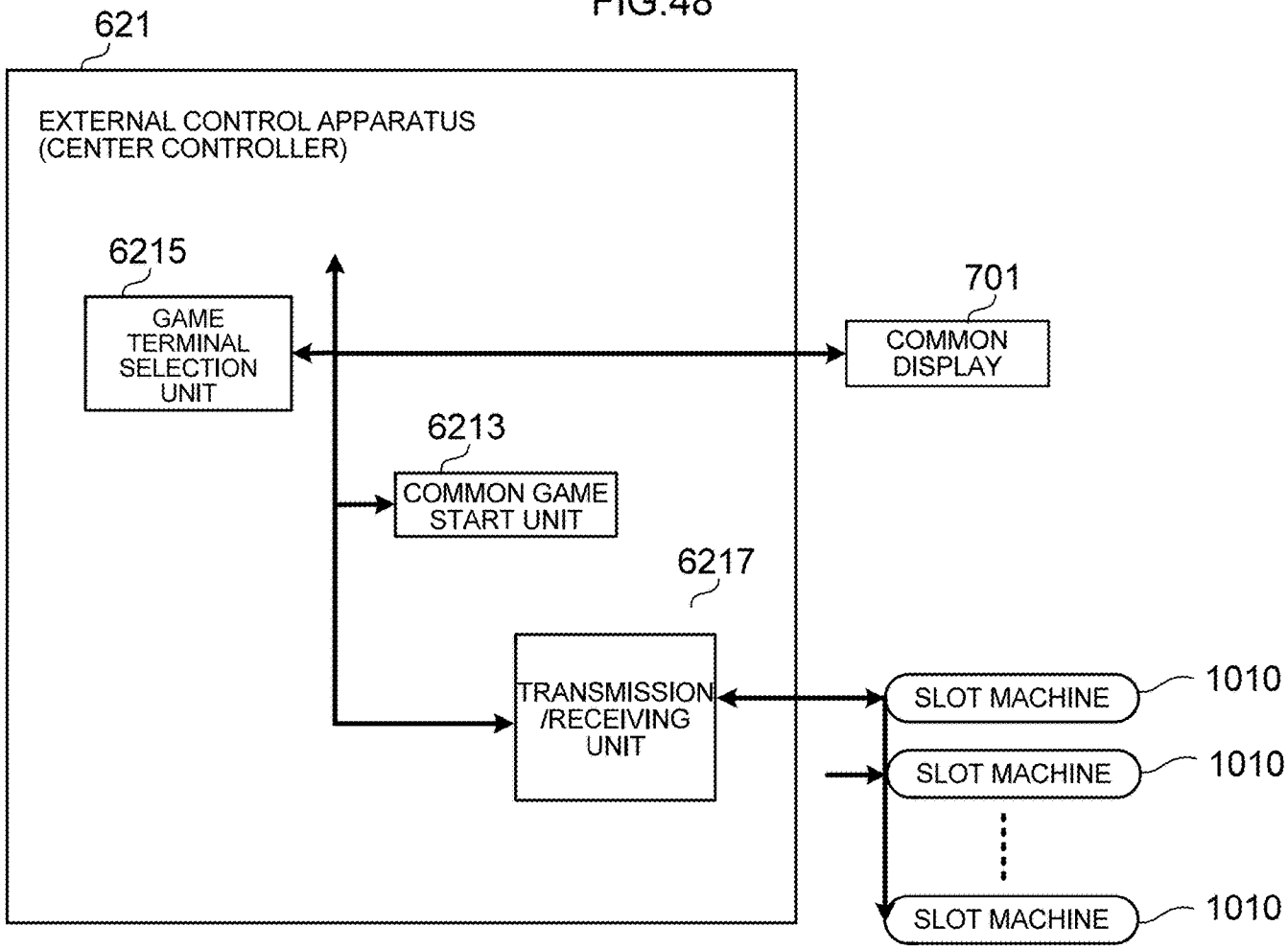
FIG. 48 is a block diagram of a gaming system.

In more detail, the external control apparatus 621 includes a common game start unit 6213, a game terminal selection unit 6215, and a transmission/receiving unit 6217 as illustrated in FIG. 48. The common game start unit 6213 has a function to determine whether the common game start requirement is satisfied based on the accumulated value of bet amount information sent from each slot machine 1010 at each unit game, a function to output game start instructions to the plurality of slot machines 1010, and a function to display the status until the common game start requirement is satisfied on the common display 701.

Whether the requirement to start a common game is satisfied can be determined based on any kind of accumulation increased with repeat of a unit game. Not only the accumulation of the bet amount information but also the number of normal games or the play time of normal games can be employed as the accumulation.

The common game start unit 6213 further has a function to output game start instructions to the slot machines 1010 in which the accumulation value increased with repeat of a normal game has satisfied the requirement to conduct a game. The common game start unit 6213 does not entitle the slot machines 1010 in which the accumulation value is lower than the specified minimum value; accordingly, this function enables the players to have intention to repeat a normal game.

The common game start unit 6213 further has a function to monitor the time periods the individual slot machines 1010 do not receive a start operation and a function to output game start instructions to the slot machines 1010 except for the slot machines 1010 that do not receive a start operation over the timeout period. These functions enable the common game start unit 6213 to determine that no player exists at a slot machine 1010 that does not receive a start operation over the timeout period and further, to eliminate the slot machine 1010 from conducting a common game.

The game terminal selection unit 6215 has a function to select specific slot machines 1010 from the plurality of slot machines 1010 and a function to output common game start instruction signals to the specific slot machines 1010. The transmission/receiving unit 6217 has a function to send data to and receive data from each slot machine 1010.

Mechanical Configuration of Slot Machine

Next, an overall configuration of the slot machine 1010 is described with reference to FIG. 49.

The slot machine 1010 employs a coin, a bill T, or electrically valuable information corresponding to these as a game medium. Particularly, credit-related data such as monetary data stored in the IC card 500 or a bill T is used in the present embodiment.

The slot machine 1010 includes a cabinet 1011, a top box 1012 provided on the upper side of the cabinet 1011, and a main door 1013 provided at the front face of the cabinet 1011.

The main door 1013 is provided with a lower image display panel 1141 (display 614) thereon. The lower image display panel 1141 is a clear liquid crystal panel. The screen displayed by the lower image display panel 1141 includes a display window 1150 at the center thereof. The display window 1150 is composed of five columns by four rows, twenty in total, of display blocks 1028. The four display blocks 1028 on each column form a pseudo reel. Each of the pseudo reels 1151 to 1155 showing four display blocks 1028 is scrolled down while varying the speed, so that the symbols 501 shown in the display blocks 1028 can be spun in the longitudinal direction and then stopped, namely rearranged.

As shown in FIG. 57, payline generation columns are provided symmetrically on the left end and the right end of the display window 1150. The payline generation column on the left end as seen from the player has 25 payline generators 1065L (1065LA, 1065LB, 1065LC, 1065LD, 1065LE, 1065LF, 1065LG, 1065LH, 1065LI, 1065LJ, 1065LK, 1065LL, 1065LM, 1065LN, 1065LO, 1065LP, 1065LQ, 1065LR, 1065LS, 1065LT, 1065LU, 1065LV, 1065LW, 1065LX, and 1065LY).

The payline generation column on the right end as seen from the player has 25 payline generators 1065R (1065RA, 1065RB, 1065RC, 1065RD, 1065RE, 1065RF, 1065RG, 1065RH, 1065RI, 1065RJ, 1065RK, 1065RL, 1065RM, 1065RN, 1065RO, 1065RP, 1065RQ, 1065RR, 1065RS, 1065RT, 1065RU, 1065RV, 1065RW, 1065RX, and 1065RY).

Each payline generator 1065L is paired with one of the payline generators 1065R and a payline L starting from the payline generator 1065L to the paired payline generator 1065R is predefined. Although FIG. 57 shows only one payline L for the simplicity of explanation, 25 paylines are defined in the present embodiment.

The payline L is enabled by connecting the payline generators 1065L and 1065R. Otherwise, the payline is disabled. The number of paylines to be enabled is determined based on the amount of bet. In the case of MAX BET or the maximum amount of bet, the maximum 25 paylines are enabled. Each enabled payline allows completion of various winning combinations of symbols 501. The details of the winning combinations are described later.

The present embodiment describes a case where the slot machine 1010 is a so-called video slot machine; however, the slot machine 1010 may employ so-called mechanical reels for a part of the pseudo reels 1151 to 1155.

Returning to FIG. 49, on the front of the lower image display panel 1141, a touch panel 1069 is provided; the player can input instructions by operating the touch panel 1069. The touch panel 1069 sends an input signal to the main CPU 1071 (see FIG. 49).

Below the lower image display panel 1141, a control panel 1030 is provided. The control panel 1030 includes buttons, a coin entry 1021 for receiving coins into the cabinet 1011, and a bill entry 1022. The bill entry 1022 is connected with the paper sheet processing apparatus 1 accommodated inside the slot machine 1010.

Figure 50:
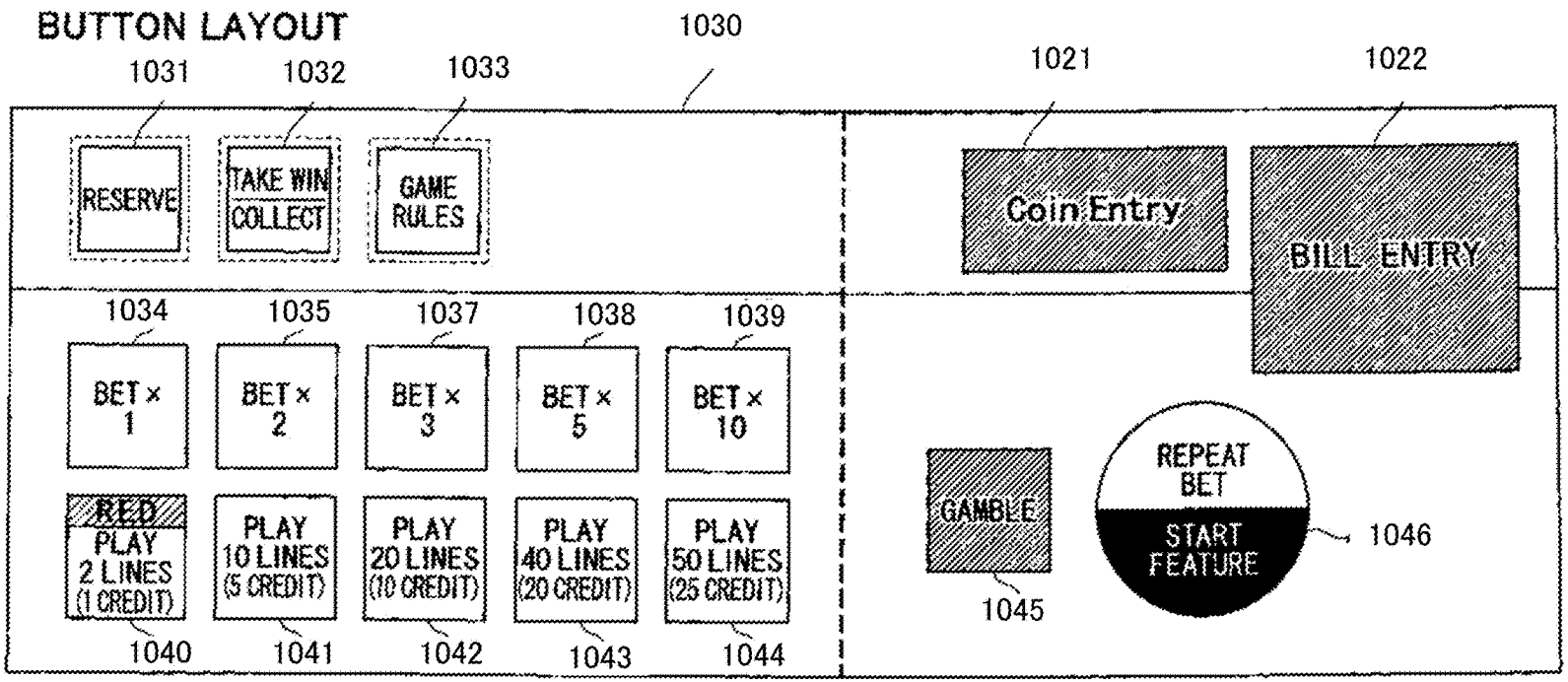
FIG. 50 is an explanatory diagram for illustrating a button layout of a control panel.

Specifically, the control panel 1030 includes a RESERVE button 1031, a COLLECT (CASHOUT) button 1032, and a GAME RULES button 1033 on the top of the left area thereof, as shown in FIG. 50. The control panel 1030 further includes a 1-BET button 1034, a 2-BET button 1035, a 3-BET button 1037, a 5-BET button 1038, and a 10-BET button 1039 on the middle row of the left area, and a PLAY 2 LINES button 1040, a PLAY 10 LINES button 1041, a PLAY 20 LINES button 1042, a PLAY 40 LINES button 1043, and a PLAY 50 LINES (MAX LINES) button 1044 on the bottom of the left area.

The control panel 1030 further includes the coin entry 1021 and the bill entry 1022 in the upper right area thereof and a GAMBLE button 1045 and a START button 1046 (which corresponds to the SPIN button 602 in FIG. 47) in the lower right area.

The RESERVE button 1031 is used when the player leaves the machine for a minute or wants to ask the staff of the game hall for exchange. The CASHOUT button 1032 is a so-called checkout button to add the credit data on the credits gained in the games to the credit data stored in the IC card 500 inserted in the PTS terminal 700. The CASHOUT button 1032 has a function to output a message by image or voice to the PTS terminal 700 to ask the player whether to pay the credits in cash. The GAME RULES button 1033 is used when the player is unfamiliar with the rules of the game or the operation of the machine. In response to a press of the GAME RULES button 1033, a variety of help information comes up on the later-described upper image display panel 1131 or the lower image display panel 1141.

The 1-BET button 1034 is to bet one credit on each enabled payline L from the player's current credits each time the player presses the button 1034. The 2-BET button 1035 is to start a game with a bet of two credits on each enabled payline L. The 3-BET button 1037 is to start a game with a bet of three credits on each enabled payline L. The 5-BET button 1038 is to start a game with a bet of five credits on each enabled payline L. The 10-BET button 1039 is to start a game with a bet of ten credits on each enabled payline L. Accordingly, the amount to be bet per enabled payline L is determined by press of the 1-BET button 1034, the 2-BET button 1035, the 3-BET button 1037, the 5-BET button 1038, or the 10-BET button 1039.

The PLAY 2 LINES button 1040 is to enable paylines L in response to press of the button 1040. The number of paylines L enabled by this button is 2. The PLAY 10 LINES button 1041 is to enable paylines L in response to press of the button 1041. The number of paylines L enabled by this button is 10. The PLAY 20 LINES button 1042 is to enable paylines L in response to press of the button 1042. The number of paylines L enabled by this button is 20. The PLAY 40 LINES button 1043 is to enable paylines L in response to press of the button 1043. The number of paylines L enabled by this button is 40. The MAX LINES button 1044 is to enable paylines L in response to press of the button 1044. The number of paylines L enabled by this button is the maximum 50.

The GAMBLE button 1045 is an operation button to be used to enter a gamble game mode after the end of a bonus game, for example. The gamble game is a game using the gained credits.

The START button 1046 is used to start scrolling the symbols 501. This START button 1046 also functions as a button to start a bonus game or to add the payout gained in a bonus game to the credits. The coin entry 1021 is to receive coins into the cabinet 1011. The bill entry 1022 is formed in such a shape that the bill to be handled by the paper sheet processing apparatus 1 in the cabinet 1011 can be handled from the external (for example, by the player).

Returning again to FIG. 49, on the lower front of the main door 1013, or below the control panel 1030, a coin tray 1018 for receiving discharged coins and a belly glass 1132 with a painting of the character of the slot machine 1010 are provided.

The top box 1012 is provided with an upper image display panel 1131 on the front of the top box 1012. The upper image display panel 1131 includes a liquid crystal panel, and forms the display. The upper image display panel 1131 displays images related to effects and images showing introduction of the game contents and explanation of the game rules. Further, the top box 1012 is provided with speakers 1112 and a lamp 1111. The slot machine 1010 produces effects on a game by displaying images, outputting sounds, and outputting light.

Below the upper image display panel 1131, a data display 1174 and a keypad 1173 are provided. The data display 1174 is made of a fluorescent display or an LED to show membership data retrieved from an IC card 500 inserted in the PTS terminal 700 or data entered by the player through the keypad 1173. The keypad 1173 is a device to input data.

Mechanical Configuration of PTS Terminal

FIG. 51 is a diagram for illustrating a PTS terminal 700 embedded in the slot machine 1010. The PTS terminal 700 communicates data with the gaming machine using a standardized data interface; accordingly, the PTS terminal 700 can be mounted to various types of gaming machines of various manufacturers.

The PTS terminal 700 is installed between the lower image display panel 1141 and the control panel 1030. As illustrated in FIG. 51, the PTS terminal 700 has an LCD 719 having a touch panel function. The LCD 719 is provided at the center of the PTS terminal 700. The LCD 719 displays effect images for producing effects on the games. Further, the LCD 719 displays information on a member, information for members, and a system error, for example.

On the upper side of the PTS terminal 700, human detection cameras 712, 713, microphones 704, 705, and a bass reflex speakers 707, 708 are provided as shown in FIG. 51.

The human detection cameras 712 and 713 detect a player with a camera function and output a signal to the later-described unit controller 730. The microphones 704 and 705 are used for the player to participate in a game with speech or to be authenticated by speech recognition. The speakers 707 and 708 are used for producing effects or outputting an alarm sound not to leave an IC card 500. The speakers 707 and 708 further output an alarm sound when authentication of the inserted IC card 500 is failed. The speakers 707 and 708 are installed behind the LCD 719 so that the sound can be heard at the front (by the player) in stereo through ducts; space-saving installation is achieved.

The PTS terminal 700 includes an LED 709 and an IC card slot 706. The LED 709 lights in different colors to indicate the number of IC cards 500 remaining in the later-described card stacker 714. Specifically, the LED 709 lights in yellow when the number of remaining IC cards 500 is 5 or less, in blue when the number is 6 to 24, and in green when the number is 25 or more. When the number of remaining IC cards 500 is 0 or 30, the LED 709 lights in gray and the game being executed is stopped. Accordingly, in a case where the LED 709 lights in yellow, the staff of the casino hall can instantly become aware that the remaining IC cards 500 are few and supply IC cards 500. In another case where the LED 709 lights in green, the staff of the casino hall can instantly become aware that the card stacker 714 is almost full and take out some IC cards 500. IC cards 500 can be supplied by inserting the IC cards 500 carried by the staff only into the IC card slot 706. To take out IC cards 500, in response to insertion of a card called supplement card into the IC card slot 706, ten IC cards 500 are ejected together with the supplement card. As noted from this description, it is unnecessary for the staff to check the number of remaining IC cards 500 in each slot machine 1010 through the management server or by actually opening the main door 1013 of the slot machine 1010; accordingly, the security is improved.

The IC card slot 706 is provided with a mechanism to feed in or take out an IC card 500. The IC card 500 is inserted with an indicator 510 up and opposite to the IC card slot 706. The entirety of the IC card 500 is kept inside the PTS terminal 700 when the player is playing games but ejected to expose the indicator 510 when the player checks out. With this configuration, the player can check the updated credit-related data such as monetary data. Alternatively, not completely entering the PTS terminal 700, the IC card 500 may be held with the indicator 510 exposed when the player is playing games. Then, the player can always check the status of updating the credit during games. It should be noted that the PTS terminal 700 is configured to take an IC card 500 into the card stacker 714 at checkout in the case where the IC card 500 is left but the human detection cameras 712 and 713 detect no player. This configuration prevents the IC card 500 from being held for a long time even if a player knows through the indicator 510 that the remaining credits are few and leaves the slot machine 1010 without taking the IC card 500 intentionally. The card stacker 714 can stock 30 IC cards 500 at maximum.

As described above, the PTS terminal 700 in the present embodiment is a unit in which devices having various functions such as a microphone function, a camera function, a speaker function, and a display function are integrated, so that space-saving is achieved. This single-unit structure eliminates inconvenience in arranging separate devices each having one function, such that the speakers cannot be placed to face the player, if the LCD is placed to face the player.

Electrical Configuration of Slot Machine

Figure 52:
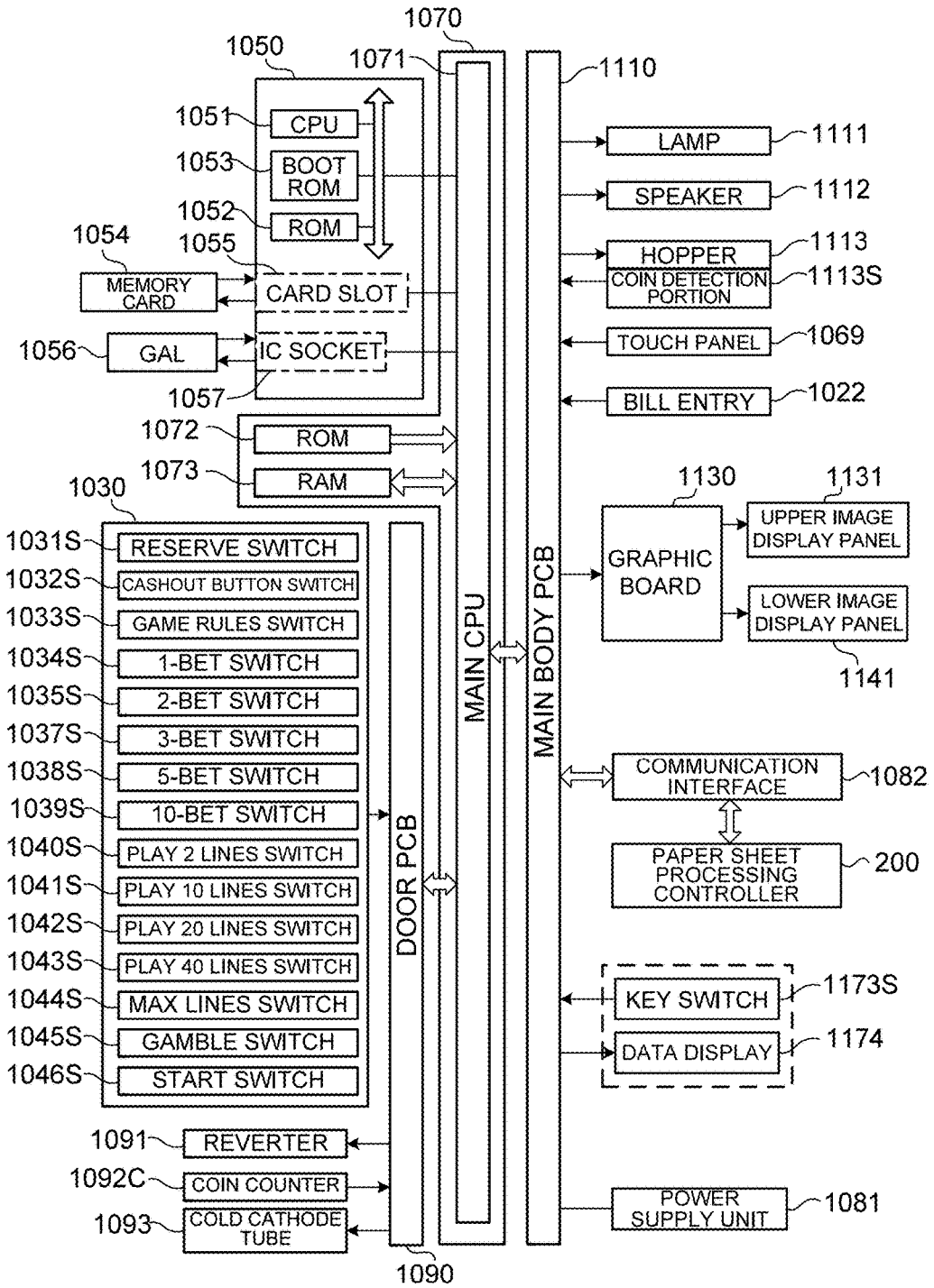
FIG. 52 is an electric block diagram of a slot machine.

Next, with reference to FIG. 52, a configuration of a circuit included in the slot machine 1010 is described.

A gaming board 1050 is provided with: a CPU 1051; a ROM 1052; a boot ROM 1053, which are mutually connected by an internal bus; a card slot 1055 corresponding to a memory card 1054; and an IC socket 1057 corresponding to a GAL (Generic Array Logic) 1056.

The memory card 1054 includes a non-volatile memory, and stores a game program and a game system program. The game program includes a program related to game progression and a program for producing effects by images and sounds. Further, the aforementioned game program includes a symbol determination program. The symbol determination program is a program for determining the symbols to be rearranged in the display blocks 1028.

The game program includes data of a symbol table for normal games specifying the correspondence relations of the symbols on the individual symbol arrays, code numbers, and random values, data of a symbol table for bonus games specifying the correspondence relations of the symbols on the individual symbol arrays, code numbers, and random values, data of a symbol number determination table, data of a code number determination table, data of a table for determining the number of wild symbols to be increased, data of a table for determining the number of trigger symbols to be increased, odds data specifying the correspondence relations of the kinds and the numbers of symbols rearranged on a payline L and the amounts of payout.

The card slot 1055 is configured so that the memory card 1054 can be inserted thereinto and removed therefrom, and is connected to a motherboard 1070 by an IDE bus. Accordingly, the kind and the content of the games to be conducted in the slot machine 1010 can be changed by removing the memory card 1054 from the card slot 1055, writing another game program to the memory card 1054, and inserting the memory card 1054 to the card slot 1055.

The GAL 1056 is a type of PLD (Programmable Logic Device) having a fixed OR array structure. The GAL 1056 is provided with a plurality of input ports and output ports, and predetermined input into the input port causes output of the corresponding data from the output port.

The IC socket 1057 is configured so that the GAL 1056 can be inserted thereinto and removed therefrom, and is connected to the motherboard 1070 by a PCI bus. The contents of the game to be played on the slot machine 1010 can be changed by replacing the memory card 1054 with another memory card 1054 having another program written therein or by rewriting the program written into the memory card 1054 as another program.

The CPU 1051, the ROM 1052 and the boot ROM 1053 mutually connected by the internal bus are connected to the motherboard 1070 by a PCI bus. The PCI bus enables a signal transmission between the motherboard 1070 and the gaming board 1050, and power supply from the motherboard 1070 to the gaming board 1050.

The ROM 1052 stores an authentication program. The boot ROM 1053 stores a pre-authentication program, a program (boot code) to be used by the CPU 1051 for activating the pre-authentication program, and the like.

The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 1070 is a commercially available general-use mother board (a printed-wiring board with basic components for a personal computer) and includes a main CPU 1071, a ROM (Read Only Memory) 1072, a RAM (Random Access Memory) 1073, and a communication interface 1082. The motherboard 1070 corresponds to the game controller 1100 in the present embodiment.

The ROM 1072 includes a memory device such as a flash memory, and stores a program such as BIOS (Basic Input/Output System) to be executed by the main CPU 1071, and permanent data. When the BIOS is executed by the main CPU 1071, processing for initializing predetermined peripheral devices is conducted; further, through the gaming board 1050, processing of loading the game program and the game system program stored in the memory card 1054 is started. In the present invention, the ROM 1072 may be rewritable or non-rewritable.

The RAM 1073 stores data and programs including the symbol determination program which are used in operation of the main CPU 1071. For example, when the processing of loading the aforementioned game program, game system program or authentication program is conducted, the RAM 1073 can store the program. The RAM 1073 is provided with working areas used for operations in execution of these programs. Examples of the areas include: an area that stores counters for managing the number of games, the number of BETs, the number of payouts, the number of credits and the like; and an area that stores symbols (code numbers) determined by lottery.

The communication interface 1082 is for communicating with the external control apparatus 621 such as a server and the paper sheet processing apparatus 1, through the communication line 3001. Further, the motherboard 1070 is connected with a later-described door PCB (Printed Circuit Board) 1090 and a body PCB 1110 by respective USBs. The motherboard 1070 is also connected with a power supply unit 1081. The motherboard 1070 is further connected with the PTS terminal 700 by USB.

When the power is supplied from the power supply unit 1081 to the motherboard 1070, the main CPU 1071 of the motherboard 1070 is activated, and then the power is supplied to the gaming board 1050 through the PCI bus so as to activate the CPU 1051.

The door PCB 1090 and the body PCB 1110 are connected with input devices such as switches and sensors, and peripheral devices the operations of which are controlled by the main CPU 1071.

The door PCB 1090 is connected with a control panel 1030, a reverter 1091, a coin counter 1092C and a cold cathode tube 1093.

The control panel 1030 is provided with a RESERVE switch 1031S, a CASHOUT button switch 1032S, and a GAME RULES switch 1033S, a 1-BET switch 1034S, a 2-BET switch 1035S, a 3-BET switch 1037S, a 5-BET switch 1038S, a 10-BET switch 1039S, a PLAY 2 LINES switch 1040S, a PLAY 10 LINES switch 1041S, a PLAY 20 LINES switch 1042S, a PLAY 40 LINES switch 1043S, a MAX LINES switch 1044S, a GAMBLE switch 1045S, and a START switch 1046S, which correspond to the aforementioned buttons. Each of the switches outputs a signal to the main CPU 1071 upon detection of press of the button corresponding thereto by the player.

The reverter 1091 and the coin counter 1021C are provided behind the coin entry 1021. The reverter 1091 determines whether each coin inserted into the coin entry 1021 is valid and ejects the coins other than valid coins from a coin payout exit. The coin counter 1092C detects and counts the accepted valid coins.

The reverter 1091 operates based on a control signal outputted from the main CPU 1071, and distributes valid coins validated by the coin counter 1092C into a hopper 1113 or a cash box (not illustrated). That is, coins are distributed into the hopper 1113 when the hopper 1113 is not filled with coins, while coins are distributed into the cash box when the hopper 1113 is filled with coins.

The cold cathode tube 1093 functions as a backlight installed on the rear face sides of the upper image display panel 1131 and the lower image display panel 1141, and lights up based on a control signal outputted from the main CPU 1071.

The body PCB 1110 is connected with the lamp 1111, the speakers 1112, the hopper 1113, a coin detecting portion 1113S, the touch panel 1069, the bill entry 1022, a graphic board 1130, a key switch 1173S and the data display 1174.

The lamp 1111 lights up based on a control signal outputted from the main CPU 1071. The speakers 1112 output sounds such as BGM, based on a control signal outputted from the main CPU 1071.

The hopper 1113 operates based on a control signal outputted from the main CPU 1071, and pays out coins of the specified number of payouts from the coin payout exit to the coin tray 1018. The coin detecting portion 1113S outputs a signal to the main CPU 1071 upon detection of coins paid out by the hopper 1113.

The touch panel 1069 detects a place on the lower image display panel 1141 touched by the player's finger or the like, and outputs to the main CPU 1071 a signal corresponding to the detected place.

The bill entry 1022 is to determine whether each bill T is valid and accept a genuine bill T to the paper sheet processing apparatus 1 in the cabinet 1011. The bill forwarded into the cabinet 1011 is exchanged into coins, the amount of credit corresponding to the exchanged coins are added to the credit owned by the player.

The graphic board 1130 controls display of images conducted by the respective upper image display panel 1131 and lower image display panel 1141, based on a control signal outputted from the main CPU 1071. The graphic board 1130 is provided with a VDP (Video Display Processor) generating image data, a video RAM temporarily storing the image data generated by the VDP, and the like. It is to be noted that the image data used in generation of image data by the VDP is included in the game program that has been read from the memory card 1054 and stored into the RAM 1073.

The key switch 1173S is provided in the keypad 1173, and outputs a predetermined signal to the main CPU 1071 when the keypad 1173 has been operated by the player.

The data display 1174 displays data read by a card reader 1172 and data inputted by the player through the keypad 1173, based on a control signal outputted from the main CPU 1071.

Electrical Configuration of PTS Terminal

Figure 53:
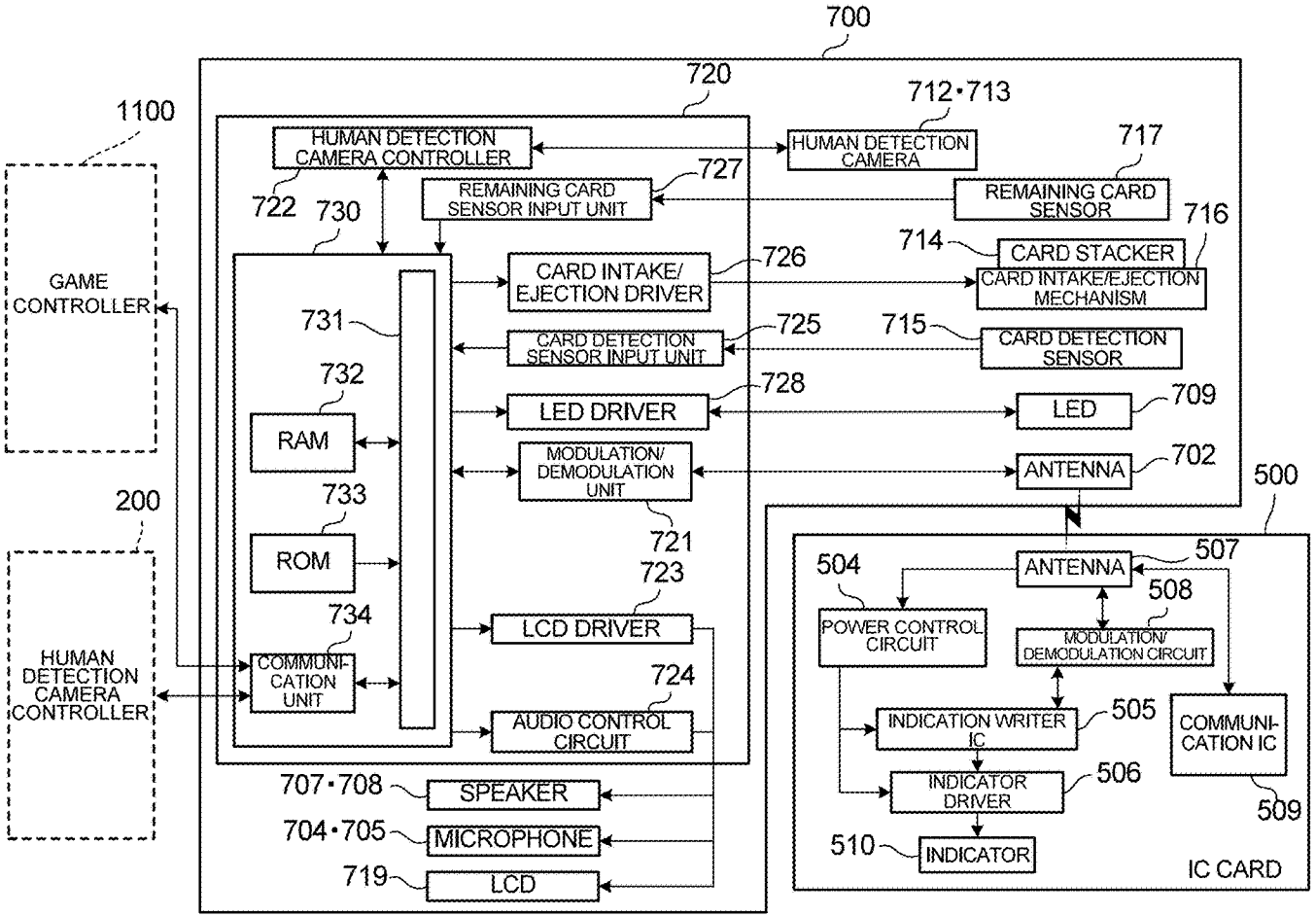
FIG. 53 is an electric block diagram of a PTS terminal.

Next, with reference to FIG. 53, a configuration of a circuit included in the PTS terminal 700 is described.

A PTS controller 720 for controlling the PTS terminal 700 includes a unit controller 730 as a main component connected with various function units; the unit controller 730 includes a CPU 731, a communication unit 734, a ROM 733, and a RAM 732.

The CPU 731 executes the programs stored in the later-described ROM 733, and carries out operations. In particular, the CPU 731 executes a credit update program to convert the credit data acquired from the game controller 1100 into monetary data, sum up the monetary data and the fractional monetary data stored in the management server 800, and send the sum to the IC card 500.

The CPU 731 also executes a human detection program to determine whether to collect an IC card 500 into the card stacker 714 using the human detection cameras 712 and 713 unless the amount of remaining credit based on the credit data acquired from the game controller 1100 is zero.

The CPU 731 also executes an authentication program to check the identification code in the IC card 500 against the identification codes in the management server 800.

The CPU 731 also executes an audio control program to control the later-described audio control circuit 724 based on the authentication result. This audio control is for CPU 731 to control the later-described audio control circuit 724 to report a failure in authentication from the speakers 707 and 708 when the authentication is failed. The communication unit 734 enables communication with the game controller 1100 and the paper sheet processing controller M200.

The CPU 731 also executes a device program to control operations of the LCD 719, the microphones 704, 705, and the speakers 707, 708. Further, the CPU 731 executes an LED control program to control the lighting of the LED 709 in accordance with the number of remaining IC card 500.

The ROM 733 includes a memory device such as a flash memory and stores permanent data to be used by the CPU 731. For example, the ROM 733 stores the credit update program for rewriting the credit data stored in an IC card 500 in accordance with an instruction from the game controller 1100, the human detection program, the authentication program, the audio control program, the device program, and the LED control program.

The RAM 732 stores data required to execute the programs stored in the ROM 733 on a temporary basis. For example, the RAM 732 stores credit data to be updated in accordance with a signal from the game controller 1100. The RAM 732 also stores a time of detection of a player by the human detection cameras 712 and 713 and a time counted from the time of detection.

The unit controller 730 is connected with a human detection camera controller 722, an LCD driver 723, an audio control circuit 724, a remaining card sensor input unit 727, a card intake/ejection driver 726, a card detection sensor input unit 725, an LED driver 728, and a modulation/demodulation unit 721.

The human detection camera controller 722 controls the human detection cameras 712, 713 to operate in accordance with an instruction of the unit controller 730.

The LCD driver 723 controls the LCD 719 to operate in accordance with an instruction of the unit controller 730.

The audio control circuit 724 controls the microphones 704, 705 and the speakers 707, 708 to operate in accordance with an instruction of the unit controller 730.

The remaining card sensor input unit 727 inputs a signal from the remaining card sensor 717 for reporting the number of IC cards 500 stocked in the card stacker 714 to the unit controller 730. The remaining card sensor 717 has a function to determine the number of remaining IC cards 500 stocked in the card stacker 714 with a not-shown infrared detection mechanism.

The card intake/ejection driver 726 controllably drives a card intake/ejection mechanism 716 in accordance with an instruction from the unit controller 730. The card intake/ejection mechanism 716 has a mechanism to feed an IC card 500 into the PTS terminal 700 and a mechanism to eject an IC card 500 to the external.

The card detection sensor input unit 725 inputs a signal from a card detection sensor 715 to the unit controller 730. The card detection sensor 715 acquires a variety of data such as monetary data or an identification code from an inserted IC card 500.

The LED driver 728 controllably drives the LED 709 to light in accordance with an instruction of the unit controller 730.

The modulation/demodulation unit 721 converts a high-frequency signal from an antenna 702 to a signal controllable by the unit controller 730 and further, converts a signal from the unit controller 730 to a signal that can be sent to the IC card 500 via the antenna 702.

The foregoing unit controller 730, the card intake/ejection driver 726, the card detection sensor input unit 725, and the modulation/demodulation unit 721 are collectively referred to as card unit controller.

Electric Configuration of IC Card

Figure 54:
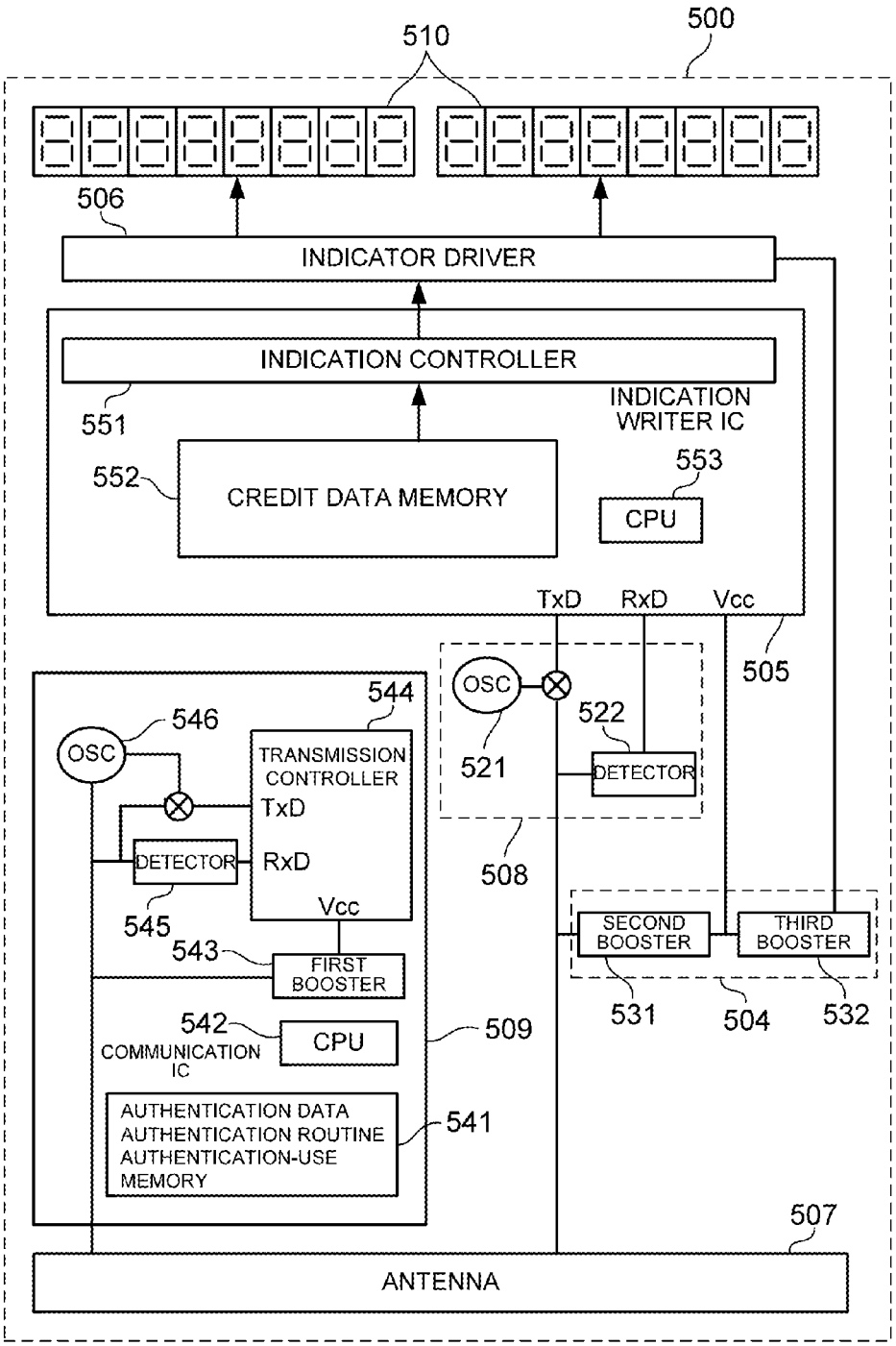
FIG. 54 is an electric block diagram of an IC card.

Next, with reference to FIGS. 53 and 54, a configuration of a circuit included in an IC card 500 is described.

The IC card 500 includes an antenna 507, a power control circuit 504, a modulation/demodulation circuit 508, an indication writer IC 505, an indicator driver 506, and an indicator 510.

The antenna 507 sends and receives various signals via the antenna 702 of a PTS terminal 700.

The power control circuit 504 includes a second booster circuit 531 and a third booster circuit 532. The second booster circuit 531 amplifies the signal from the antenna 507 to a voltage that can be processed by the later-described modulation/demodulation circuit 508. The third booster circuit 532 amplifies the voltage from the power source to the voltage for driving the later-described indicator driver 506.

The modulation/demodulation circuit 508 includes an oscillator 521 and a detector circuit 522. The oscillator 521 outputs a signal having a specific frequency to be mixed with the signal received from the antenna 507, so that the signal from the antenna 507 is converted to a signal that can be processed by the later-described indication writer IC 505. The detector circuit 522 detects a signal received from the antenna 507.

The indication writer IC 505 includes a CPU 553, a credit data memory 552, and an indicator controller 551.

The CPU 553 executes a monetary data rewrite program to rewrite and update the monetary data stored in the credit data memory 552 in accordance with the monetary data acquired from the PTS terminal 700.

The CPU 553 also controls the indicator controller 551 to display the monetary data stored in the credit data memory 552 on the indicator 510 with the later-described indicator driver 506.

The credit data memory 552 stores the aforementioned monetary data rewrite program and credit-related data such as monetary data, an identification code, and monetary data to be displayed. The credit related-data stored in the credit data memory 552 is used for both of calculation and display.

The indicator controller 551 acquires the credit data to be displayed stored in the credit data memory 552 and displays the data on the indicator 510 with the indicator driver 506 in accordance with a control signal from the CPU 553.

The IC card 500 includes a communication IC 509. The communication IC 509 includes a first booster circuit 543, an oscillator 546, a detector circuit 545, a transmission controller 544, a CPU 542, and an authentication-use memory 541. The first booster circuit 543 amplifies authentication data of the terminal acquired from the PTS terminal 700 to a voltage that can be processed by the later-described CPU 542.

The oscillator 546 outputs a signal having a specific frequency to be mixed with the signal received from the antenna 507, so that the signal from the antenna 507 is converted to a signal that can be processed by the CPU 542. The detector circuit 545 detects a signal received from the antenna 507.

The CPU 542 executes an authentication routine program and sends an identification code stored in the later-described authentication-use memory 541 to the PTS terminal 700 upon receipt of an authentication request from the PTS terminal 700. The authentication-use memory 541 stores the authentication routine program to be used by the CPU 542 and the identification code.

Symbols, Combinations, and Others

The symbols 501 to be displayed in the display window 1150 of the above-described slot machine 1010 form symbol arrays each including 22 symbols. The symbols included in a symbol array are assigned code numbers of 0 to 21 as shown in FIG. 55. The symbol array is a combination selected from the symbols of JACKPOT 7, BLUE 7, BELL, CHERRY, STRAWBERRY, PLUM, ORANGE, and APPLE.

Four consecutive symbols on each symbol array are displayed (arranged) on the top row, the upper middle row, the lower middle row, and the bottom row in the display window 1150 to form a symbol matrix of five columns by four rows. The symbols included in a symbol matrix start being scrolled when a game is started in response to press of the START button after press of a BET button. After elapse of a predetermined time from the start of scrolling, the scrolling is stopped (the symbols are rearranged).

Winning combinations are predefined for individual kinds of symbols. A winning combination is a combination of symbols stopped on a payline that is advantageous for the player. Being advantageous for the player means that coins corresponding to the winning combination will be paid, that the number of coins to be paid out will be added to the credit, that a bonus game will be started, or the like.

Specifically, when a combination of APPLE symbols is completed on a payline, a bonus trigger is made so that the game mode changes from normal games to bonus games. When a combination of CHERRY symbols is completed on a payline in a normal game, 20 coins (negotiable value) are paid out per BET. When a combination of PLUM symbols is completed on a payline in a normal game, 5 coins are paid out per BET.

A bonus game is a game advantageous over a normal game for the player. A bonus game can also be a game combined with other types of bonus games as far as the game is advantageous over a normal game. The other types of bonus games can include a game in which the player can acquire more coins than in a normal game, a game in which the player can acquire coins at higher probability than in a normal game, a game that can be played with fewer coins than a normal game, and a free game, for example.

Payout Management Table

FIG. 56 is a payout management table for managing payouts to be provided depending on the winning combination. This payout management table is stored in the ROM 1072 for the main CPU 1071 and information on each payout is associated with a kind of winning combination. For example, the payout for the winning combination of BELL is 10. The payout for the winning combination of BLUE 7 is 40. In the present embodiment, the payouts in normal games are determined to be equal to the payouts in free games.

Display of Slot Game

An example of display on the lower image display panel 1141 when the above-described slot machine 1010 is in operation is described specifically.

FIG. 57 shows an example of a normal game screen or a screen image of a normal game on the lower image display panel 1141.

Specifically, the normal game screen includes a display window 1150 provided at the center thereof and payline generators 1065L and 1065R provided symmetrically on the left and the right of the display window 1150. The display window 1150 shows five pseudo reels 1151 to 1155.

Above the display window 1150, a credit indicator 400, a fractional cash indicator 403, a bet indicator 401, a wild symbol indicator 415, a trigger symbol indicator 416, a payout indicator 402 are provided. These indicators 400, 401, 415, 416, and 402 are disposed in this order from left to right as seen from the player.

The credit indicator 400 indicates the number of credits. The fractional cash indicator 403 indicates the amount of fractional cash. The bet indicator 401 indicates the amount of bet in the current unit game. The wild symbol indicator 415 indicates the number of wild symbols 503A in the current unit game. This indicator 415 notifies in advance the player that five wild symbols 503A are provided in a normal game. The trigger symbol indicator 416 indicates the number of trigger symbols 503B in the current unit game. This indicator 416 notifies in advance the player that five trigger symbols 503B are provided in a normal game. The payout indicator 402 indicates the number of coins when a winning combination is made.

Below the display window 1150, a HELP button 410, a PAY TABLE button 411, a unit-of-bet indicator 412, a stock indicator 413, and a free game indicator 414 are provided. These buttons and indicators 410, 411, 412, 413, and 414 are disposed in this order from left to right as seen from the player.

The HELP button 410 is to execute a help mode when the player presses this button. The help mode is to provide the player with information to answer the questions about the games. The PAY TABLE button 411 is to execute a payout display mode for displaying information on payouts when the player presses this button. The payout display mode is to display an explanatory screen showing the relations between winning combinations and multipliers for payout.

The unit-of-bet indicator 412 indicates the unit of bet (the unit of payout) as of the moment. The unit-of-bet indicator 412 shows that the player can play games in units of one cent, for example.

The stock indicator 413 indicates the number of carried-over bonus games. The number of carried-over bonus games means that the number of remaining bonus games that can be played successively after a bonus game ends. That is to say, in the case where the stock indicator 413 indicates "3", a bonus game can be repeated for three consecutive times after the current bonus game ends. During a normal game, the stock indicator 413 indicates "0".

The free game indicator 414 indicates the number of carried-over free games together with the total number. That is to say, in the case where the free game indicator 414 indicates "0 of 0", the total number of free games is zero, meaning that the current game is not a bonus game. In the case where the free game indicator 414 indicates "5 of 8", the game being played is fifth free games out of eight free games in bonus games.

Operations in Slot Machine 1010: Start-up Processing

Next, start-up processing performed in a slot machine 1010 is described.

Figure 58:
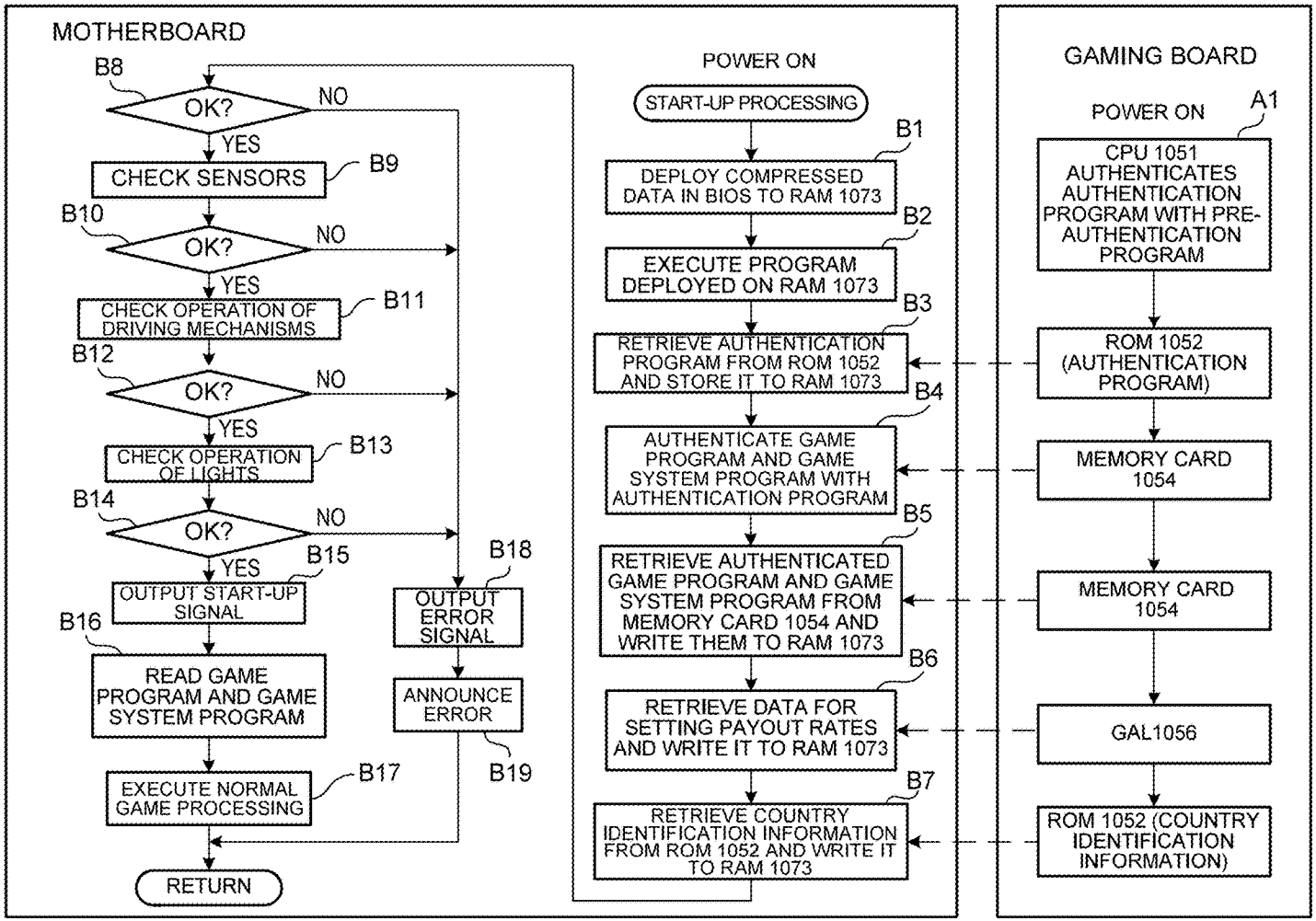
FIG. 58 is a flowchart of a routine for start-up processing.

When the slot machine 1010 is powered on, the routine for start-up processing shown in FIG. 58 is executed on the motherboard 1070 and the gaming board 1050. In the present embodiment, it is assumed that a memory card 1054 is in the card slot 1055 of the gaming board 1050 and a GAL 1056 is attached on the IC socket 1057 of the gaming board 1050.

When the power switch of the power supply unit 1081 is turned on (powered on), the motherboard 1070 and the gaming board 1050 are activated. Upon activation of the motherboard 1070 and the gaming board 1050, processing of the motherboard 1070 and processing of the gaming board 1050 are performed in parallel. That is to say, on the gaming board 1050, the CPU 1051 retrieves a pre-authentication program stored in the boot ROM 1053 and conducts pre-authentication with the pre-authentication program. The pre-authentication is to verify that the authentication program is not tampered in accordance with the pre-authentication program before the authentication program is loaded onto the motherboard 1070 (A1).

Meanwhile, on the motherboard 1070, the main CPU 1071 executes the BIOS stored in the ROM 1072. As a result, compressed data incorporated in the BIOS is deployed onto the RAM 1073 (B1). The main CPU 1071 executes the BIOS deployed on the RAM 1073 to check and initialize the peripheral devices (B2).

Subsequently, the main CPU 1071 retrieves the authentication program stored in the ROM 1052 via the PCI bus and stores the retrieved authentication program to the RAM 1073 (B3). The main CPU 1071 gets checksum through ADDSUM method (standard check function) in accordance with the standard BIOS function of the BIOS, so that the main CPU 1071 can check whether the authentication program is stored in the RAM 1073 without fail.

Next, the main CPU 1071 checks the components connected with the IDE bus. Thereafter, the main CPU 1071 accesses the memory card 1054 in the card slot 1055 via the IDE bus and retrieves a game program and a game system program from the memory card 1054. In this operation, the data of the game program and the game system program is retrieved by four bytes. Subsequently, the main CPU 1071 performs authentication to verify the retrieved game program and the game system programs are not tampered with the authentication program stored in the RAM 1073 (B4).

Upon successful completion of the authentication, the main CPU 1071 writes and stores the authenticated game program and the game system program to the RAM 1073 (B5).

Next, the main CPU 1071 accesses the GAL 1056 attached to the IC socket 1057, retrieves data for setting payout rates from the GAL 1056, and writes and stores the data to the RAM 1073 (B6). Thereafter, the main CPU 1071 retrieves the country identification information stored in the ROM 1052 of the gaming board 1050 and stores the retrieved country identification information to the RAM 1073 (B7).

Subsequently, the main CPU 1071 determines whether the programs and data are correct as a result of the above-described authentication processing (B8). If not determining that the programs and data are correct (B8: NO), the main CPU 1071 outputs an error signal including ID information for identifying the slot machine 1010 to a not-shown intensive monitoring apparatus. The intensive monitoring apparatus identifies the slot machine 1010 having a trouble based on the error signal, instructs a staff member standing by near the slot machine 1010 to address the trouble, and stores trouble history information such as the date and time and the place of occurrence of the trouble (B18). Thereafter, the speakers 1112 of the slot machine 1010 outputs sound and the lamp 1111 or the light emission unit outputs light to announce the error (B19). With these operations, this routine for the motherboard 1070 is terminated.

If determining the programs and data are correct (B8: YES), the main CPU 1071 checks the operation of the sensors included in the slot machine 1010 one by one (B9) and determines whether all the sensors work correctly (B10). If at least one of the sensors does not work correctly (B10: NO), the aforementioned B18 and B19 are performed and the main CPU 1071 exits this routine.

If all the sensors work correctly (B10: YES), the main CPU 1071 checks the operation of all the driving mechanisms one by one (B11) and determines whether all the driving mechanisms work correctly (B12). If at least one of the driving mechanisms does not work correctly (B12: NO), the aforementioned B18 and B19 are performed and the main CPU 1071 exits this routine. If all the driving mechanisms work normally (B12: YES), the main CPU 1071 checks the operation of all the lights one by one (B13) and determines whether all the lights work correctly (B14). If at least one of the lights does not work correctly (B14: NO), the aforementioned B18 and B19 are performed and the main CPU 1071 exits this routine.

If all the lights work correctly (B14: YES), the main CPU 1071 outputs a start-up signal indicating the slot machine 1010 has correctly started up to the not-shown intensive monitoring apparatus (B15). Thereafter, the main CPU 1071 performs normal game processing (B16, B17) and exits this routine.

Configuration of Kiosk Terminal

Figure 59:
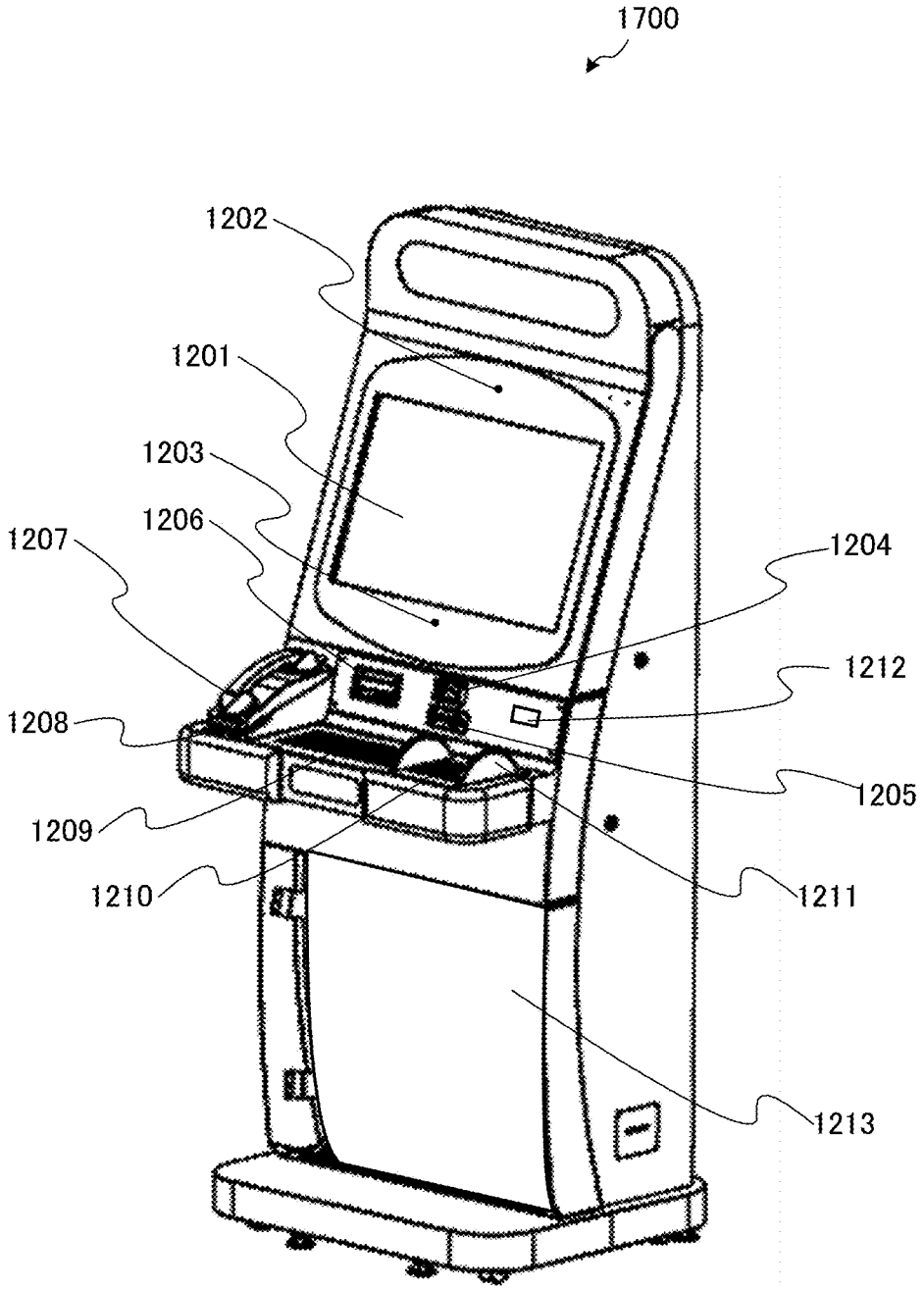
FIG. 59 is a perspective view showing an overall configuration of a kiosk terminal.

FIG. 59 illustrates a kiosk terminal 1700 to be used in the game system 350 in an embodiment of the present invention. The kiosk terminal 1700 is an information display apparatus to be used to mainly indicate information on the games being played in the hall, such as start of a bonus game held in a bonus server, countdown for the start of the bonus game, winning ranking of the day, and popular machine ranking. The kiosk terminal 1700 can be connected to the servers (such as the bonus server and the member management server) in the game system via the network.

The kiosk terminal 1700 includes an LCD 1201 having a touch panel function. The LCD 1201 may be a 24-inch liquid crystal display device (24 inches equal to approximately 60.96 cm). As described above, this LCD displays information on the games being played in the hall. Although the LCD 1201 in this example is configured to have a touch panel function, instructions may be input through other input devices such as a keyboard or a mouse.

The kiosk terminal 1700 further includes motion sensors 1202 and 1203 above and below the LCD 1201. The motion sensors 1202 and 1203 can be cameras; images taken by the motion sensors 1202 and 1203 are used to analyze the behaviors of the users of the kiosk terminal 1700 and the people walking down the aisles.

The kiosk terminal 1700 also includes a touch unit 1204, which includes an RFID module capable of data communication with a contactless IC card, or a cell phone or a smartphone having an NFC function. A member can log in the system by holding a membership card (IC card) associated with the member over the touch unit 1204 and display a menu screen for members and information on the member on the LCD 1201. The information on the member may be acquired from the member management server. In addition to the touch unit 1204 or instead of the touch unit 1204, an information recording medium reader for reading information stored in an information recording medium such as a magnetic card may be provided. In this case, the membership card can be a magnetic card, instead of the IC card 500.

The hall staffs can log in the system by holding an IC card 500 for staff and display a menu screen for staff on the LCD 1201.

The kiosk terminal 1700 has an IC card slot 1205 to insert or take out an IC card 500. The IC card slot 1205 is provided with an eject button.

At the corresponding place to the IC card slot 1205 inside the cabinet of the kiosk terminal 1700, a card unit 1230 is provided; the IC card slot 1205 is structured as a part of the card unit 1230.

When a membership card is inserted from the IC card slot 1205, the kiosk terminal 1700 can display a menu screen for members and information on the member on the LCD 1201. The card unit 1230 can issue and collect a card such as a limited card or a reward card.

The kiosk terminal 1700 has a ticket printer 1206. The ticket printer 1206 can issue and collect a ticket or a coupon; further, the ticket printer 1206 may have the functions of a bill validator.

The kiosk terminal 1700 further has a receiver 1207 to be used in VoIP calls. The user of the kiosk terminal 1700 can talk with a user of another kiosk terminal 1700 or a player of a gaming machine by using the receiver 1207. The incoming alert LED 1208 is controlled to light when a VoIP call is coming.

The kiosk terminal 1700 has a keyboard 1209 and a numeric keypad 1210 for the user to enter data (for membership registration or text chat); on the both sides of the numeric keypad 1210, LED plates 1211 are provided for privacy protection.

The kiosk terminal 1700 further has a QR code scanner 1212 for reading a QR Code™, which may be attached to an e-mail sent to a cell phone.

The kiosk terminal 1700 includes a cabinet 1213 containing the controller of the LCD and LEDs.

Configuration of Circuit in Kiosk Terminal

Figure 60:
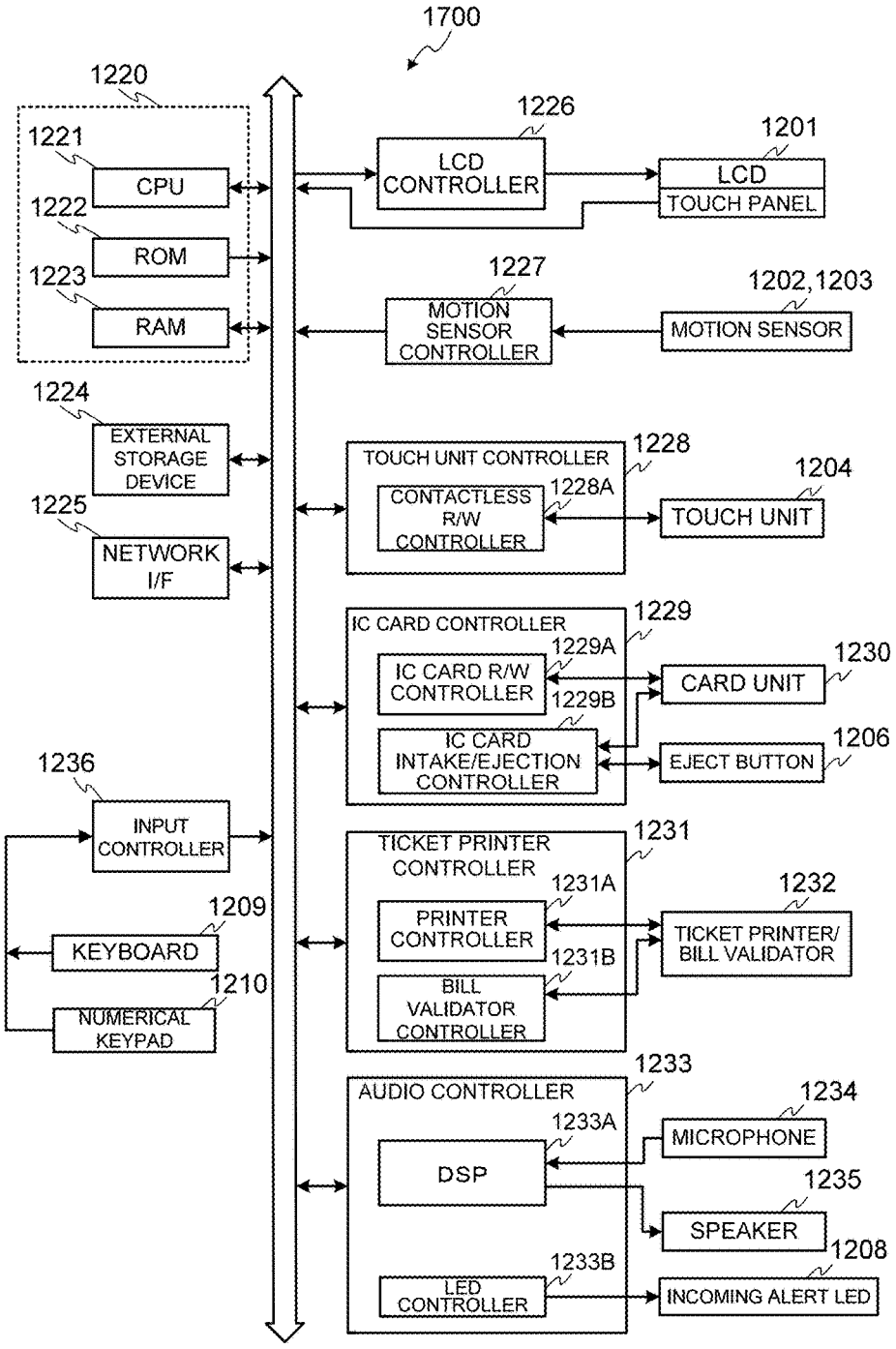
FIG. 60 is a diagram for illustrating a configuration of a circuit of the kiosk terminal.

Next, with reference to FIG. 60, a configuration of a circuit included in the kiosk terminal 1700 is described.

The kiosk terminal controller 1220 for controlling the kiosk terminal 1700 includes a CPU 1221, a ROM 1222, and a RAM 1223.

The CPU 1221 controls operation of the components of the kiosk terminal 1700 and executes the programs stored in the ROM 1222 and carries out operations.

The ROM 1222 includes a memory device such as a flash memory and stores permanent data to be used by the CPU 1221. For example, the ROM 1222 can store a VoIP phone control program.

The RAM 1223 stores data required to execute the programs stored in the ROM 1222 on a temporary basis.

The external storage device 1224 is a storage device such as a hard disk drive and stores programs to be executed by the CPU 1221 and data to be used by the programs executed by the CPU 1221.

The network I/F (interface) 1225 enables data communication with the servers that send a variety of information, such as the bonus server, the member management server, and a monitoring server, and the PTS terminals 700.

The LCD controller 1226 controls the LCD 1201 to display information such as the aforementioned information on the games. The LCD 1201 has a touch panel function, which sends an operation of the user to the CPU 1221. The LCD controller 1226 can also control the LCD 1201 to display a floor map created by the monitoring server.

The motion sensor controller 1227 receives images of a user or other objects captured by the motion sensors (for example, cameras) 1202 and 1203, applies predetermined image processing as necessary, and forwards the processed data to the CPU 1221. The motion sensor controller 1227 can acquire captured-image information from the motion sensors 1202 and 1203 and send the captured-image information to the monitoring server in response to an acquisition request of the monitoring server.

The touch unit controller 1228 controls data transmission responsive to a touch operation on the touch unit 1204 with an IC card or a cell phone. The touch unit controller 1228 includes a contactless R/W (reader/writer) controller 1228A.

The contactless R/W controller 1228A determines whether the touch unit 1204 has detected a touch operation with an IC card 500 or a cell phone and if the touch unit 1204 has detected a touch operation, acquires information retrieved by the touch unit 1204. The touch unit 1204 has an antenna for data communication with an IC card 500 or a cell phone using NFC.

The IC card controller 1229 controls intake and ejection of an IC card 500, and retrieval of data from the IC card 500. The IC card controller 1229 includes an IC card R/W (reader/writer) controller 1229A and an IC card intake/ejection controller 1229B.

The IC card R/W controller 1229A controls the card unit 1230 to read information such as the identification code stored in the IC card 500. The card unit 1230 has an antenna for data write to the IC card 500 using NFC.

The IC card intake/ejection controller 1229B controls intake and ejection of an IC card 500. In response to insertion of an IC card 500 into the IC card slot 1205 by the user, the IC card intake/ejection controller 1229B controls the IC card 500 to be held in the card unit 1230 until the user logs off. Furthermore, in response to press of the eject button, the IC card intake/ejection controller 1229B controls the IC card 500 to be ejected.

The ticket printer controller 1231 controls the ticket printer/bill validator 1232 to issue or collect a ticket or a coupon, and to identify a bill. The ticket printer controller 1231 includes a printer controller 1231A and a bill validator controller 1231B.

The audio controller 1233 inputs and outputs sounds with a microphone 1234 and a speaker 1235 included in the receiver 1207. The audio controller 1233 includes a DSP 1233A and an LED controller 1233B. The DSP 1233A performs predetermined audio signal processing in receiving sounds from the microphone 1234 and outputting sounds from the speaker 1235. The LED controller 1233B controls the incoming alert LED 1208 to light based on the incoming signal of a VoIP call.

The input controller 1236 converts inputs from the keyboard 1209 or the numerical keypad 1210 into a signal and sends it to the CPU 1221.

The present invention is not limited to the configurations of the foregoing embodiments and discloses the following configurations.

(1) The paper sheet inserted into the paper sheet processing apparatus 1 in the above-described embodiments are either a bill or a barcode ticket; in this connection, the bill is not limited to a bill in the currency of the country where the paper sheet processing apparatus 1 is installed. The paper sheet processing apparatus 1 is applicable to a configuration that accepts various currencies of different countries or a multicurrency configuration that accepts bills in multiple currencies.

(2) The above-described embodiments perform image data comparison processing within the paper sheet processing apparatus 1; however, the image data comparison unit 250 can be included in the PTS terminal 700 or the management server 800 to perform the image data comparison processing outside the paper sheet processing apparatus.

The present invention discloses a plurality of problems to be solved by the above-described embodiments and solutions thereof as follows.

APPENDIX

The present invention discloses the following aspect in accordance with the embodiments:

a paper sheet processing system including:

a paper sheet processing apparatus; and a host apparatus configured to manage the paper sheet processing apparatus.

The paper sheet processing apparatus includes:

a reading unit configured to read a paper sheet inserted through an insertion slot to acquire identification information including image information on the paper sheet;

a conveyer unit configured to convey the inserted paper sheet;

a verification unit configured to verity the paper sheet using the information on the paper sheet acquired by the reading unit;

a report device configured to report a result of the verification;

a control unit configured to control the conveyer unit to convey the paper sheet toward the insertion slot in a case where the verification unit determines that the paper sheet is counterfeit as a result of the verification;

a storage unit configured to store information on a paper sheet determined by the verification unit to be counterfeit;

a comparison unit configured to compare the information on the paper sheet inserted through the insertion slot with information on the paper sheet stored in the storage unit; and a counter configured to count number of times of detection of the same paper sheet based on a detection signal associated with image data of a paper sheet sent from the comparison unit in a case where the comparison unit determines the information on the paper sheet inserted through the insertion slot is identical to the information on the paper sheet stored in the storage unit.

The control unit is further configured to send a report signal to the host apparatus, generate another report signal different from the report signal sent to the host apparatus, and send a result in accordance with the generated report signal to the report device.

The host apparatus is configured to report a result in accordance with the report signal, and store image data to update the image data in a case where the image data does not include image data identical to the image data acquired for the verification.

The present invention discloses the following aspect in accordance with the embodiments:

a paper sheet processing system including a paper sheet processing apparatus, a gaming machine, and a server.

The paper sheet processing apparatus includes:

a reading unit configured to read a paper sheet inserted through an insertion slot;

a verification unit configured to verify the paper sheet using information on the paper sheet read by the reading unit; and a control unit configured to calculate a total amount from information on monetary amounts of successively inserted paper sheets and send image data of the paper sheets.

The gaming machine includes:

a storage unit configured to store the total amount sent from the paper sheet processing apparatus, a predetermined monetary amount, and a predetermined number of games;

a counter configured to count number of games in the gaming machine;

a detector configured to detect cashout from the gaming machine; and a control unit configured to calculate a monetary amount to be cashed out and send a result of the calculation, a count value of the counter, and a detection signal of cashout to the server.

The server includes a determination unit configured to, in response of detection of cashout from the gaming machine at the detector, compare the total amount with the predetermined amount stored in the storage unit, compare the count value of the counter with the predetermined number of games, calculate a rate of change in monetary amount at the cashout from an amount input before start of games and a remaining amount at end of the games, and determine whether the inserted paper sheets are wrong paper sheets in accordance with results of the comparison and a result of the calculation.

The present invention discloses the following aspect in accordance with the embodiments:

a paper sheet processing system including a paper sheet processing apparatus and a server.

The paper sheet processing apparatus includes:

a conveyer unit configured to convey a paper sheet;

a reading unit configured to read the paper sheet conveyed by the conveyer unit;

a verification unit configured to verify the paper sheet read by the reading unit;

a report device configured to report a result of verification by the verification unit; and a control unit configured to control the conveyer unit, the reading unit, the verification unit, and the report device and send the result of the verification to the server.

The server includes:

a report device connected with the paper sheet processing apparatus to be able to communicate and configured to report the result of the verification; and a control unit configured to create an error display command to display a result different from the result of the verification and send the error display command to the paper sheet processing apparatus.

The control unit in the paper sheet processing apparatus is further configured to control the conveyer unit to hold the paper sheet on which verification is done inside the paper sheet processing apparatus and control the report device to display an error different from the result of the verification in a case where the result of the verification is that the paper sheet is counterfeit.

The present invention discloses the following aspect in accordance with the embodiments:

a paper sheet processing system including a paper sheet processing apparatus, a paper sheet counter, and a server.

The paper sheet processing apparatus includes:

a reading unit configured to read a paper sheet inserted through an insertion slot and acquire image of the paper sheet;

an extraction unit configured to extract a serial number uniquely identifying the paper sheet from the image of the paper sheet acquired by the reading unit;

a holder unit configured to hold paper sheets read by the reading unit;

a control unit configured to associate the serial number extracted by the extraction unit with an apparatus ID and send the serial number and the apparatus ID to the server.

The paper sheet counter includes a control unit configured to read serial numbers of paper sheets collected from the paper sheet processing apparatus in counting the paper sheets, associate the serial numbers with the apparatus ID, and send the serial numbers and the apparatus ID to the server.

The server includes:

a storage unit configured to store the serial number associated with the apparatus ID sent from the paper sheet processing apparatus;

a comparison unit configured to extract serial numbers associated with an apparatus ID identical to the apparatus ID sent from the paper sheet counter from the storage unit, and compare the serial numbers sent from the paper sheet counter with the serial numbers extracted from the storage unit; and a control unit configured to report a result of the comparison by the comparison unit to a host apparatus in a case where the comparison unit detects a discrepancy in the serial numbers.

As set forth above, embodiments of the present invention have been described; however, they are merely specific examples and not to limit the present invention. The specific elements such as the individual units can be modified in design as appropriate. The effects described in the embodiments are merely the most advantageous effects achieved by the present invention and the effects of the present invention are not limited to the effects described in the embodiments.

In addition, the foregoing detailed description has mainly provided characteristic features for better understanding of the present invention. The present invention is not limited to the embodiments provided in the foregoing detailed description and can be applied to other embodiments to achieve a broader application range. Further, the terms and expressions used in the present specification are to appropriately describe the present invention, and not to limit the interpretation of the present invention. In addition, it would be obvious for those skilled in the art to conceive of configurations, systems, and/or methods other than those included in the concept of the present invention in view of the concept of the invention described in the present specification. Therefore, recitations of the claims must be regarded to include equivalent features within the scope of the technical idea of the present invention. The Abstract is provided for patent offices, general public institutions, or those skilled in the art who are not fully familiarized with patents, legal terms, and professional terminology to be able to readily understand the technical features and the essences of the present invention through simple investigation. Accordingly, the Abstract is not to limit the scope of the invention to be evaluated by the recitations of the claims. To fully understand the object(s) of the present invention and advantageous effect(s) unique to the present invention, it is encouraged to sufficiently refer to the documents already disclosed.

The detailed description provided hereinabove includes processing executed by a computer. The foregoing description and expressions are provided for those skilled in the art to most efficiently understand the present invention. In the present specification, each of the steps employed to derive a result is to be understood as processing without self-contradiction. In each of the steps, an electric or magnetic signal is transmitted, received, and/or recorded. Such a signal is expressed in the form of bit, value, symbol, character, term, number, or the like; however, it should be noted that these expressions are employed for clarity of explanation. Although some steps in the present specification are described using expressions common with human acts, the processing is actually executed by various devices. Furthermore, other elements necessary to perform the steps are obvious from the above description.

The present invention exemplified by the embodiments is configured to compare a paper sheet with the information (image information acquired by scanning) on the paper sheet supplied immediately before the paper sheet being processed to determine whether the paper sheets are identical. If the serial numbers of a paper sheet and the next paper sheet are the same, the first paper sheet is put in the cash box, but in putting the next paper sheet in the cash box or prior to that, an alert signal is sent to a host apparatus such as a management apparatus even if the supplied bills are a new type of paper sheets that cannot be determined in verification to be genuine or counterfeit. Accordingly, the present invention has an advantageous effect of possibly preventing use of a large number of counterfeit bills.

The invention claimed is:

1. A paper sheet processing system comprising:

a paper sheet processing apparatus configured to read a paper sheet inserted therein, and send data including information on a monetary amount of the inserted paper sheet;

a storage unit configured to store a total monetary amount calculated from the information on the monetary amount of the inserted paper sheet and sent from the paper sheet processing apparatus, a predetermined monetary threshold, and a predetermined threshold number of games;

a counter configured to count a number of games played at the gaming machine during a gaming session subsequent to the insertion of the paper sheet and prior to a cashout operation;

a detector configured to detect the cashout operation from the gaming machine; and a determination unit configured to, in response to detection of the cashout operation from the gaming machine at the detector, compare the total monetary amount with the predetermined monetary threshold stored in the storage unit, compare the number of games played at the gaming machine during the gaming session with the predetermined threshold number of games, and determine whether the inserted paper sheets are authentic based on the results of the comparisons.

2. The paper sheet processing system according to claim 1, wherein the determination unit is further configured to calculate a rate of change between the total monetary amount inserted and a monetary amount remaining at the time of the cashout operation, and determine whether the inserted paper sheets are authentic based on the results of the comparisons and a result of the calculation.

3. The paper sheet processing system according to claim 1, wherein the a paper sheet processing apparatus obtains image data of the paper sheet inserted therein and sends it to the storage unit, and wherein the storage unit is further configured to store predetermined paper sheet identification information, and wherein the determination unit is configured to extract a same type of paper sheet identification information as the predetermined paper sheet identification information from identification information included in the image data sent from the paper sheet processing apparatus, compare the extracted identification information with the predetermined identification information, and determine whether the inserted paper sheet is authentic.

4. The paper sheet processing system according to claim 1, wherein the paper sheet processing apparatus includes:

an imaging device configured to obtain a facial image of a supplier of an inserted paper sheet and acquire supplier image data; and a line sensor configured to scan identification information on the paper sheet inserted into the paper sheet processing apparatus, wherein the storage unit is configured to store the supplier image data acquired by the imaging device and the identification information read by the line sensor, and when the determination unit determines that the paper sheet inserted in the paper sheet processing apparatus is not authentic, associate the supplier image data acquired by the imaging device with the identification information read by the line sensor.

5. The paper sheet processing system according to claim 1, wherein the inserted paper sheet comprises one of a currency bill or a ticket including a bar code.

6. The paper sheet processing system according to claim 1, wherein the paper sheet processing apparatus reads a plurality of paper sheets successively inserted therein and sends image data including information on a monetary amount of the plurality of inserted paper sheets; and the storage unit stores a total monetary amount calculated from the information on the monetary amount of the plurality of paper sheets inserted and sent from the paper sheet processing apparatus; and, the counter counts the number of games played at the gaming machine during the gaming session subsequent to the insertion of the plurality of paper sheets and prior to the cashout operation; and the determination unit, in response to detection of the cashout operation from the gaming machine at the detector:

compares the total monetary amount with the predetermined monetary threshold stored in the storage unit, and when the total monetary amount is less than the predetermined monetary threshold, the cashout operation proceeds, and when the total monetary amount is greater than or equal to the predetermined monetary threshold, the determination unit compares the number of games played during the gaming session with the predetermined threshold number of games.

7. The paper sheet processing system according to claim 6, wherein when the number of games played during the gaming session is greater than or equal to the predetermined threshold number of games, the cashout operation proceeds, and when the number of games played during the gaming session is less than the predetermined threshold number of games, the determination unit calculates a rate of change in total monetary amount remaining at the time of the cashout operation, as compared to the total amount inserted.

8. The paper sheet processing system according to claim 7, wherein when the rate of change calculation satisfies predetermined criteria, the cashout operation proceeds, and when the rate of change calculation does not satisfy the predetermined criteria, a potential wrongdoing is determined and the authenticity of one or more of the plurality of inserted paper sheets is verified.

9. The paper sheet processing system according to claim 8, wherein if a potential wrongdoing is determined, an image of a supplier of one or more of the plurality of the inserted paper sheet is retained.

10. A paper sheet processing system comprising:

a paper sheet processing apparatus;

a gaming machine; and a server, the paper sheet processing apparatus including:

a reading unit configured to read a paper sheet inserted through an insertion slot;

a verification unit configured to verify the inserted paper sheet using information on the inserted paper sheet read by the reading unit; and a control unit configured to calculate a total monetary amount of a plurality of successively inserted paper sheets and send data corresponding to each of the plurality of inserted paper sheets, the gaming machine including:

a storage unit configured to store the total monetary amount sent from the paper sheet processing apparatus, a predetermined monetary threshold, and a predetermined threshold number of games;

a counter configured to count number of games played at the gaming machine during a gaming session subsequent to the insertion of the plurality of paper sheets and prior to a cashout operation;

a detector configured to detect the cashout operation from the gaming machine; and a control unit configured to calculate a monetary amount remaining to be cashed out, and send to the server, a result of the calculation, a count value of the number of games played during the gaming session, and a detection signal of cashout, and the server including a determination unit configured to, in response to the detection of the cashout operation from the gaming machine at the detector, compare the total monetary amount with the predetermined monetary threshold stored in the storage unit, compare the count value of the number of games played during the gaming session with the predetermined threshold number of games, calculate a rate of change in monetary amount at the time of the cashout operation based on the total monetary amount and the monetary amount remaining, and determine whether the plurality of inserted paper sheets are authentic in accordance with results of the comparisons and a result of the calculation.

11. The paper sheet processing system according to claim 10, wherein, when the determination unit determines that one or more of the plurality of inserted paper sheets is not authentic, the control unit of the paper processing apparatus:

sends a report signal reporting a wrongdoing to a host apparatus, and sends an error display signal irrelevant to the result of the determination to the gaming machine, which is different from the report signal sent to the host apparatus.

12. The paper sheet processing system according to claim 10, wherein, when the determination unit determines that one or more of the plurality of inserted paper sheets is not authentic, the control unit sends a report signal reporting a wrongdoing to a host apparatus and allows the paper sheet processing apparatus to pursue the cashout operation after sending the report signal to the host apparatus.

13. The paper sheet processing system according to claim 10, wherein the at least one of the plurality of the inserted paper sheets comprises one of a currency bill or a ticket including a bar code.

14. The paper sheet processing system according to claim 10, wherein when the number of games played during the gaming session is greater than or equal to the predetermined threshold number of games, the cashout operation proceeds, and when the count value of the number of games played during the gaming session and counted by the counter is less than the predetermined threshold number of games, the determination unit calculates a rate of change in total monetary amount remaining at the time of the cashout operation, as compared to the total amount inserted.

15. The paper sheet processing system according to claim 14, wherein when the rate of change calculation satisfies predetermined criteria, the cashout operation proceeds, and when the rate of change calculation does not satisfy the predetermined criteria, a potential wrongdoing is determined and the authenticity of one or more of the plurality of inserted paper sheets is verified.

16. The paper sheet processing system according to claim 15, wherein if a potential wrongdoing is determined, an image of a supplier of the plurality of one or more of the inserted paper sheets is retained.

* * * * *